US010036606B2

(12) United States Patent
Roberts et al.

(10) Patent No.: US 10,036,606 B2
(45) Date of Patent: Jul. 31, 2018

(54) SUPPRESSOR COVER ASSEMBLY AND METHOD

(71) Applicant: Magpul Industries Corp., Austin, TX (US)

(72) Inventors: Timothy Eric Roberts, Broomfield, CO (US); Turner Sessions, Lafayette, CO (US); William Bradley Bennett, Lafayette, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/364,016

(22) Filed: Nov. 29, 2016

(65) Prior Publication Data

US 2017/0153080 A1 Jun. 1, 2017

Related U.S. Application Data

(60) Provisional application No. 62/261,767, filed on Dec. 1, 2015.

(51) Int. Cl.
*F41A 21/44* (2006.01)
*F41A 21/30* (2006.01)

(52) U.S. Cl.
CPC ..... *F41A 21/44* (2013.01); *F41A 21/30* (2013.01)

(58) Field of Classification Search
CPC ..... F41A 13/02; F41A 13/10; F41A 13/12; F41A 21/30; F41A 21/44
USPC ..... 89/14.1; 42/77
See application file for complete search history.

(56) References Cited

U.S. PATENT DOCUMENTS

| | | | | |
|---|---|---|---|---|
| 1,004,665 | A | 10/1911 | Lewis | |
| 4,346,643 | A | 8/1982 | Taylor et al. | |
| 4,536,982 | A * | 8/1985 | Bredbury | F41C 23/16 42/71.01 |
| 4,762,048 | A | 8/1988 | Higashi et al. | |
| 5,016,148 | A | 5/1991 | Kohm | |
| 5,048,572 | A | 9/1991 | Levine | |
| 7,640,689 | B2 * | 1/2010 | Fluhr | F41C 23/16 42/72 |
| D632,751 | S | 2/2011 | Bowers et al. | |
| 8,397,615 | B2 | 3/2013 | Poling | |
| 9,140,511 | B2 | 9/2015 | Michal et al. | |

(Continued)

FOREIGN PATENT DOCUMENTS

WO 2014087401 A1 6/2014

OTHER PUBLICATIONS

Ellite Iron, "WRAPS", Retrieved from https://www.eliteiron.com/product-category/wraps/, Known to exist as early as Oct. 29, 2015, p. 2.

(Continued)

*Primary Examiner* — Stephen Johnson
(74) *Attorney, Agent, or Firm* — Neugeboren O'Dowd PC

(57) ABSTRACT

A firearm suppressor cover assembly and method of protecting a user while firing a weapon are disclosed. The cover assembly has an insulating cover assembly, a one or more clamps, one or more standoffs per clamp, and an optional heat shield. The standoffs are coupled to the one or more clamps and in contact with the insulating cover assembly thereby forming an air gap between the suppressor and the insulating cover assembly. The heat shield may be arranged within the air gap.

16 Claims, 48 Drawing Sheets

(56) References Cited

U.S. PATENT DOCUMENTS

| | | | | |
|---|---|---|---|---|
| 2010/0287808 | A1* | 11/2010 | King | F41C 23/02 42/85 |
| 2013/0061503 | A1 | 3/2013 | Klett et al. | |
| 2014/0059913 | A1 | 3/2014 | Diamond et al. | |
| 2015/0082679 | A1 | 3/2015 | Michal et al. | |
| 2015/0241159 | A1 | 8/2015 | Michal et al. | |

OTHER PUBLICATIONS

Griffon Industries, "Heat & Mirage Mitigation System", Retrieved from http://www.griffonindustries.com/product_p/gi-suppressor-hmms-01.htm, Known to exist as early as Oct. 29, 2015, p. 3.
Wikipedia, "MAC-10", Retrieved from https://en.wikipedia.org/wiki/MAC-10, Known to exist as early as Oct. 29, 2015, p. 6.
Manta, "Suppressor Cover—7.0"L × 1.5"D—Flat Dark Earth", Retrieved from http://www.manta.us/products.php#?/Suppressor-Cover-7-0-L-x-1-5-D-Flat-Dark-Earth/p/30771183/category=8235687, Known to exist as early as Oct. 29, 2015, p. 4.
Gunwebsites, "Nomex Suppressor Cover", Retrieved from https://www.youtube.com/watch? v=zx4uzJs2Veg, Nov. 1, 2011, p. 3.
Armageddon Gear, "Suppressor Cover", Retrieved from http://www.armageddongear.com/Suppressor-Cover, Known to exist as early as Oct. 29, 2015, p. 5.
T.A.B Gear, LLC, "Tab SAS", Retrieved from https://tabgear.configio.com/ShoppingCart.aspx? com=detailview&iid=829&source=search&returncom=productlist, Known to exist as early as Oct. 29, 2015, p. 3.
War Sport, "War Sport Suppressor Sock—556", Retrieved from http://shop.warsport.com/war-sport-suppressor-sock-556/, Known to exist as early as Oct. 29, 2015, p. 4.
Young, Lee W., "International Search Report and Written Opinion Re Application No. PCT/US16/64016", Apr. 21, 2017, p. 7, Published in: WO.
Chaudhary, Ronish, "Australian Examination Report Re Application No. 2016351310", Jun. 16, 2017, p. 2, Published in: AU.
Lahousse, Alexandre, "Extended European Search Report Re Application No. 16871361.8", dated Nov. 17, 2017, p. 5, Published in: EP.
Gruber, Stephen S., "Instructions for Responding to Israeli Office Action Re Application No. 248515.5", dated Mar. 26, 2018, p. 5, Published in: US.
Solomon, G., "Israeli Office Action Re Application No. 248515.5", dated Feb. 5, 2018, p. 5, Published in: IL.

* cited by examiner

SUPPRESSOR COVER ASSEMBLY AND METHOD

CROSS-REFERENCE TO RELATED APPLICATIONS

This application claims priority to U.S. Provisional Application No. 62/261,767 filed on Dec. 1, 2015 and entitled "SUPPRESSOR COVER ASSEMBLY AND METHOD," the entire disclosure of which is hereby incorporated by reference for all proper purposes.

FIELD OF THE DISCLOSURE

The present disclosure relates to firearms. In particular, but not by way of limitation, the present disclosure relates to systems and methods for reducing heat transferred from a firearm suppressor to exposed areas of a suppressor cover.

BACKGROUND OF THE DISCLOSURE

An operator of a firearm such as a pistol or rifle may attach a suppressor to a barrel of the firearm (or the suppressor may be a part of the barrel) so as to reduce the amount of concussive blast, noise, and visible muzzle flash generated by firing. Suppressors primarily reduce these effects by slowing and/or cooling the escaping propellant gas. When fired rapidly, suppressors can become very hot, thereby posing a safety risk and/or adversely affecting the accuracy and/or reliability of the weapon.

For example, although an operator is not typically expected to touch a suppressor during use, accidental contact between the user or other objects and a hot suppressor may cause injury or damage. For automatic and semiautomatic weapons (such as on carbines, infantry rifles and machine guns) an overheated suppressor may be a detrimental safety hazard during transitions to a secondary weapon, such as a pistol, or may pose a risk to nearby personnel or equipment, due to a risk of accidental contact. In the field, for example, an operator may drop a rifle having a suppressor to let it hang by a sling, and begin using a pistol, inadvertently allowing the rifle to contact his or her clothing or person. These safety hazards have become more acute since there has been a rise in suppressor usage to mitigate blast effects in urban combat which, by its nature, brings operators into close proximity with each other.

An overheated suppressor also affects the accuracy of sighting due to distortions in the air above the suppressor. Specifically, a mirage effect (refraction) is created by the heat of the suppressor during use, which can cause distortion in sighting, particularly when using telescopic sights. The mirage effect may be most acute in precision applications and/or long distance shooting, where even minute changes can have a significant impact on shot placement.

Moreover, operators who need to tighten a suppressor that has loosened under fire or to remove a suppressor that is damaged or no longer needed must provide a heat resistant barrier to even touch the device.

To address the above problems, firearm suppressor covers have been provided. The currently-available covers include silicone, foam, or other relatively insulative materials that a user wraps around the suppressor and tightens using ties or other fasteners. These covers, while suitable up to certain temperatures (or effective rates of fire), are not suitable for higher temperatures (or higher rates of fire), and are prone to melting or other heat-related damage, such as charring.

Currently-available suppressor covers may also be prone to loosening and/or sliding off a suppressor altogether, such as after repeated firings. For example, weapon recoil, material relaxation (such as softening when heated), thermal expansion (e.g. polymer covers expand more at a given temperature than metallic suppressors), and/or suppressor designs having a smooth cylindrical exterior all play a role in exacerbating the problem of suppressor covers loosening and/or sliding off a suppressor.

Furthermore, currently-available covers may "over insulate" the suppressor, thereby increasing the operating temperature of the suppressor, which may lead to premature failure from more abusive heat cycling over time, as well as immediate failure due to overheating.

Accordingly, a system and method to address the shortfalls of the present technology and to provide other new and innovative features is needed.

SUMMARY OF THE DISCLOSURE

Exemplary embodiments of the present disclosure that are shown in the drawings are summarized below. These and other embodiments are more fully described in the Detailed Description section. It is to be understood, however, that there is no intention to limit the disclosure to the forms described in this Summary of the Disclosure or in the Detailed Description. One skilled in the art can recognize that there are numerous modifications, equivalents and alternative constructions that fall within the spirit and scope of the disclosure as expressed in the claims.

The present disclosure can provide a system and method for protecting an operator, other personnel, and/or equipment from heat generated during firing of a weapon utilizing a suppressor or silencer. In one exemplary embodiment, the present disclosure can include a suppressor cover assembly having an outer body, a heat shield assembly, and a spacer clamp. In another exemplary embodiment, the present disclosure can include a cover assembly having an insulating cover assembly, one or more clamps configured to releasably attach to one or more portions of a suppressor, and one or more standoffs coupled to the one or more clamps and in contact with the insulating cover assembly to thereby form and maintain an air gap between the suppressor and an inside surface of the insulating cover assembly.

In one aspect, the disclosure describes a firearm suppressor cover assembly, comprising one or more clamps, an insulating cover assembly, and nine or fewer standoffs coupled to the one or more clamps. The one or more clamps can be configured to releasably couple the firearm suppressor cover assembly to a firearm suppressor. One of the clamps can be arranged near a rear end of the firearm suppressor cover assembly, distal from a muzzle of the firearm. The insulating cover assembly can be rigidly supported to maintain a generally cylindrical shape (e.g., see FIG. 51). The nine or fewer standoffs can be coupled to the one or more clamps. The nine or fewer standoffs can be in contact with the insulating cover assembly and configured to separate the firearm suppressor from the insulating cover assembly and configured to form an air gap therebetween.

In another aspect, the disclosure describes a method of protecting a user from a firearm suppressor during repetitive fire. The method can include providing a suppressor cover having an insulating cover assembly, three or fewer clamps, and nine or fewer standoffs coupling the clamps to the insulating cover assembly, the three or fewer clamps coupled to the firearm suppressor, the nine or fewer standoffs forming an air gap between the firearm suppressor and the insulating cover assembly. The method can further include exposing an inner surface of the clamps to a first temperature of 538 degrees Celsius or more (e.g., via conduction and convection from the suppressor and thermal energy generated via repeated firing through the firearm suppressor). The method can yet further include limiting heat transfer to an outer surface of the insulating cover assembly such that the outer surface does not exceed a second temperature of more than about 149 degrees Celsius via the air gap and a small thermal conduction cross section of the one or more clamps.

As previously stated, the above-described embodiments and implementations are for illustration purposes only. Numerous other embodiments, implementations, and details of the disclosure are easily recognized by those of skill in the art from the following descriptions and claims.

BRIEF DESCRIPTION OF THE DRAWINGS

Various objects and advantages and a more complete understanding of the present disclosure are apparent and more readily appreciated by reference to the following Detailed Description and to the appended claims when taken in conjunction with the accompanying Drawings wherein:

DETAILED DESCRIPTION

Figure 1:
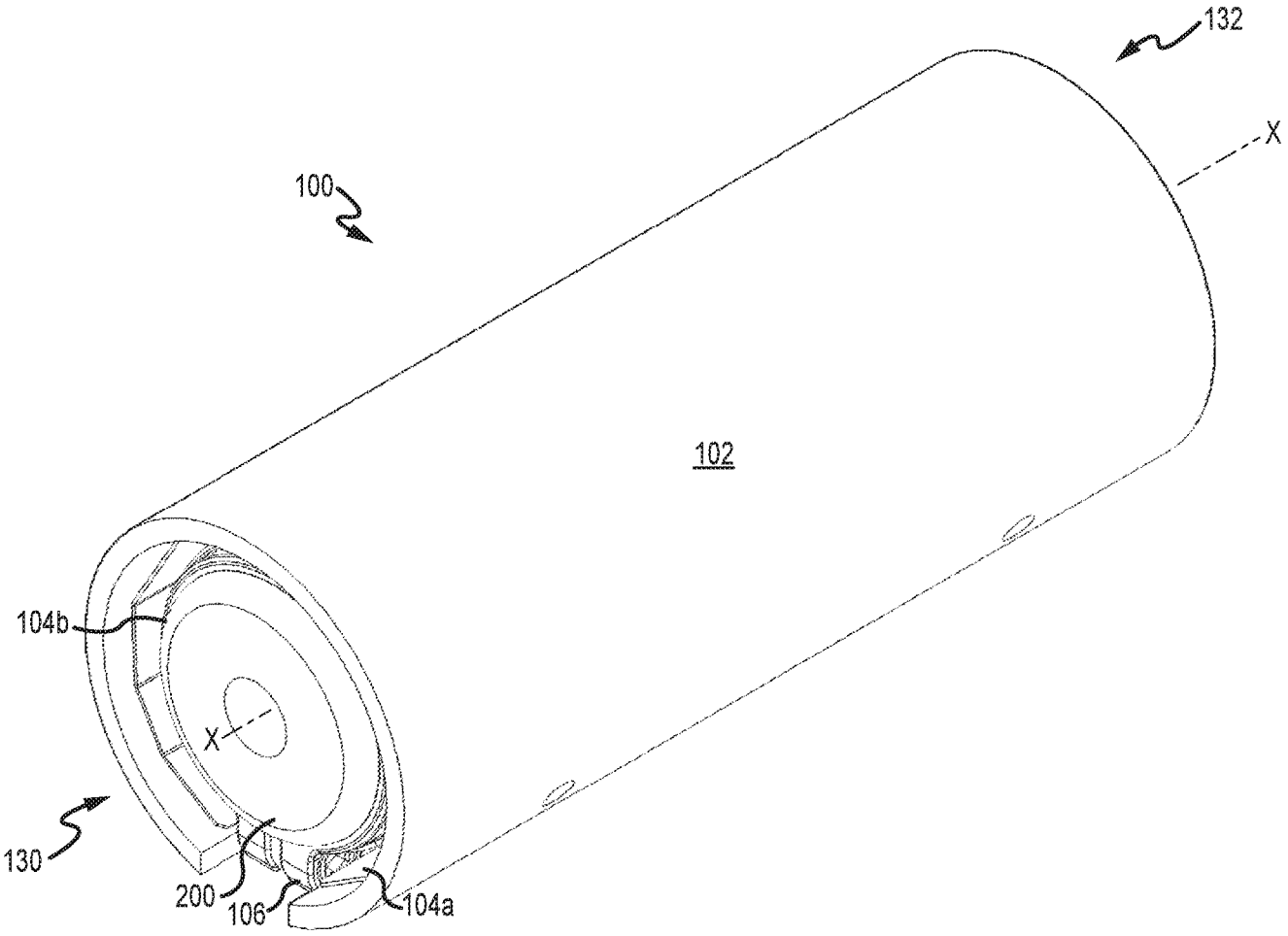
FIG. 1 illustrates an isometric view of components of a suppressor cover assembly coupled to a suppressor assembly according to some embodiments.
Figure 2:
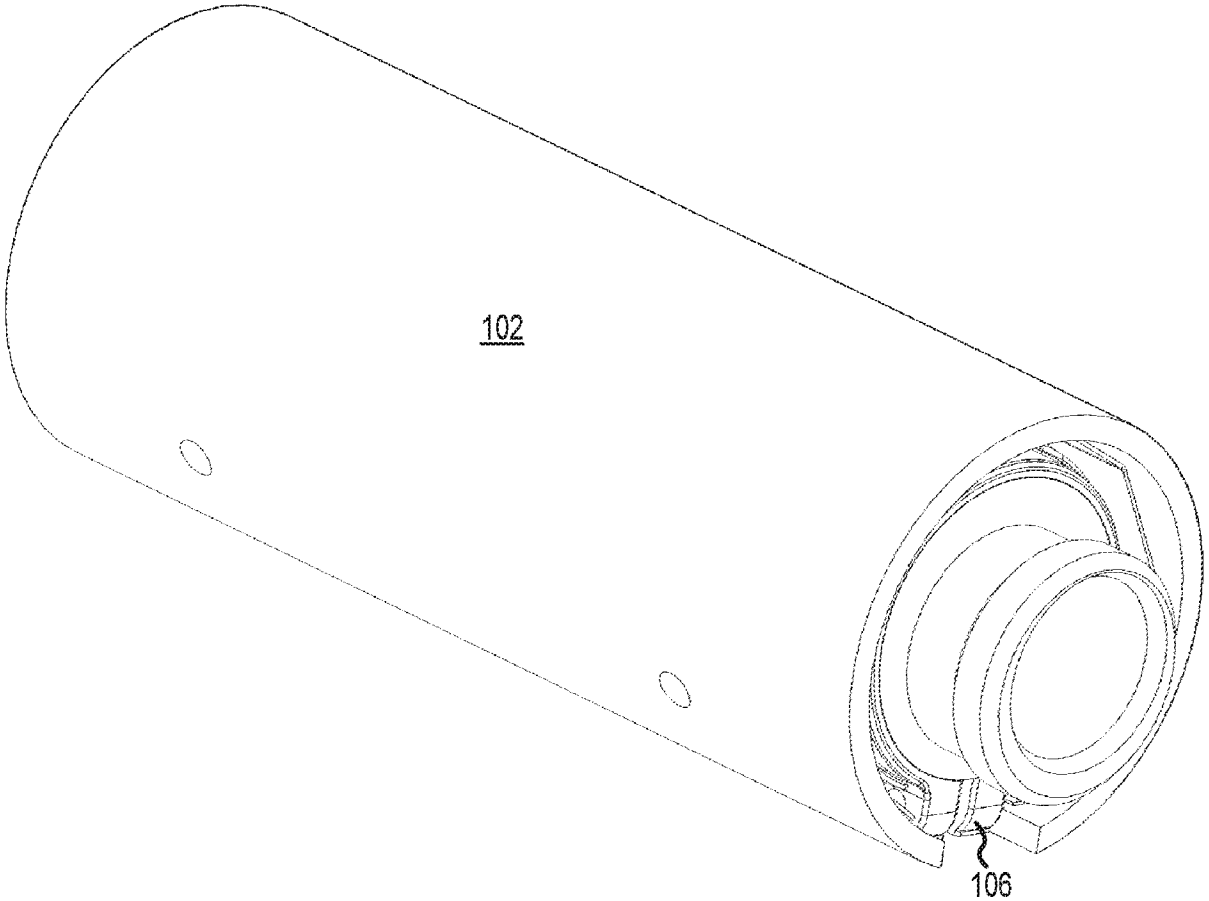
FIG. 2 illustrates an isometric view of components of a suppressor cover assembly coupled to a suppressor assembly according to some embodiments.
Figure 3:
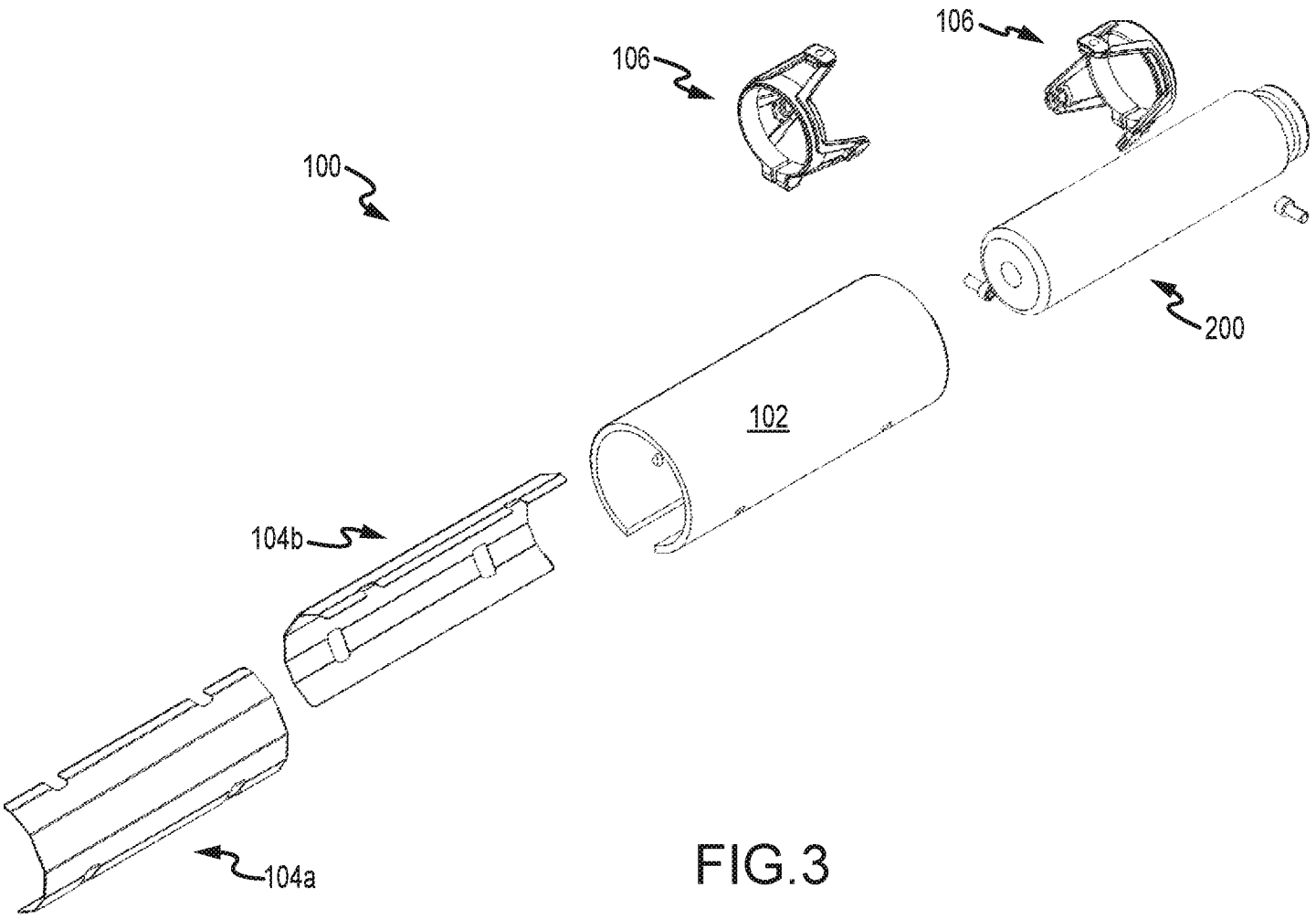
FIG. 3 illustrates an exploded isometric view of components of a suppressor cover assembly coupled to a suppressor assembly according to some embodiments.
Figure 4:
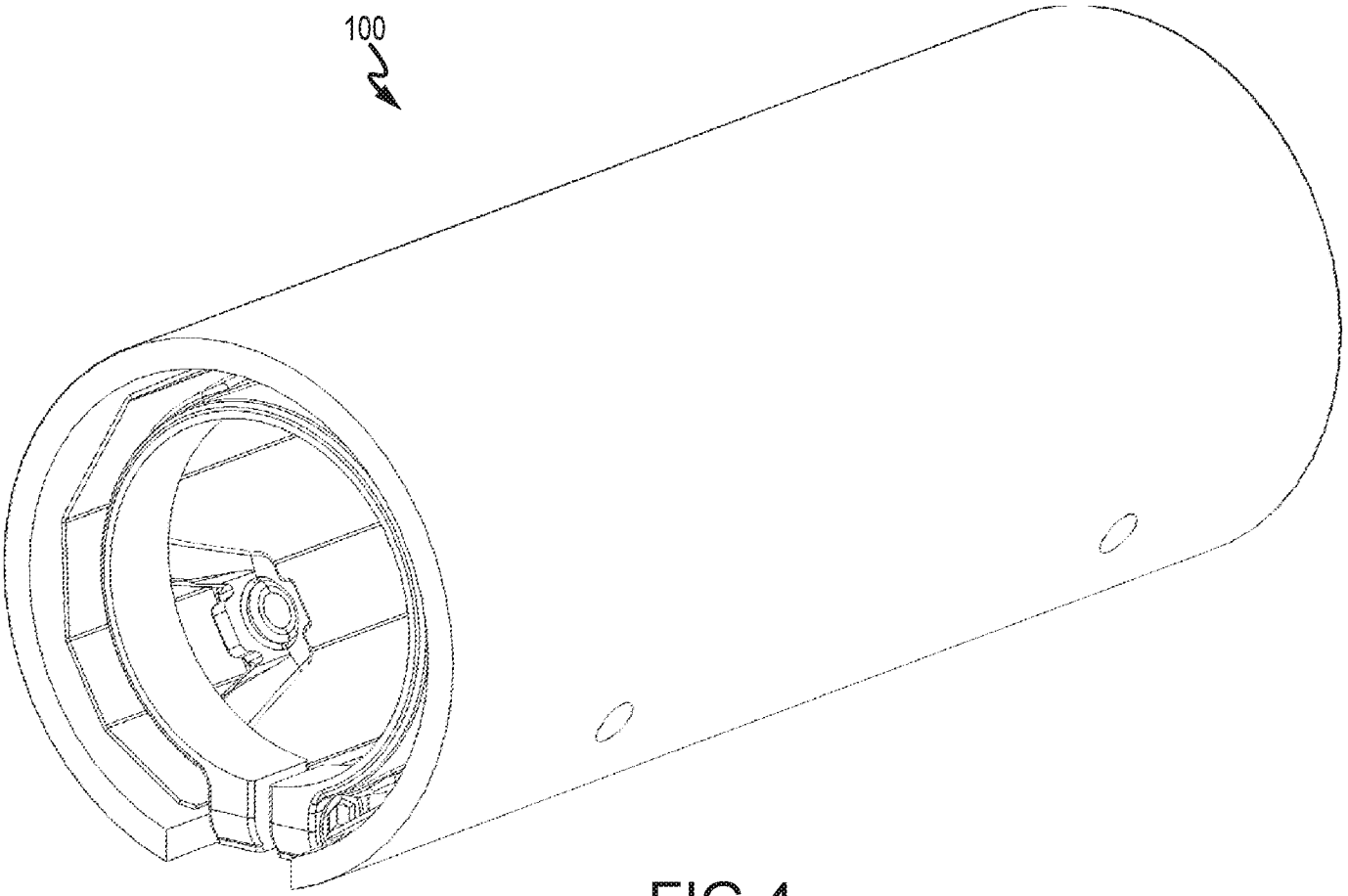
FIG. 4 illustrates an isometric view of components of a suppressor cover assembly according to some embodiments.

Referring now to the drawings, where like or similar elements are designated with identical reference numerals throughout the several views, and referring in particular to FIGS. 1-3, shown is a suppressor cover assembly 100 coupled to a suppressor assembly 200. Embodiments of the cover assembly 100 described herein may provide a relatively low exterior temperature (as compared to the prior art and/or the suppressor assembly 200 when in use), and/or minimize or eliminate the mirage effect caused by a hot suppressor assembly 200, and may do so without over insulating the suppressor assembly 200. In doing so, embodiments described herein may increase the accuracy of the weapon in use and/or reduce the likelihood of premature and/or immediate failure of the suppressor assembly 200. Embodiments described herein may also reduce or eliminate the possibility of the cover assembly 100 sliding off of the suppressor assembly 200.

The suppressor assembly 200 can be any suppressor assembly known to those skilled in the art, configured to couple to the barrel of a firearm to reduce the amount of noise, concussion, and/or visible muzzle flash generated by firing. Suppressor assemblies of varying lengths can be used.

The suppressor cover assembly 100, or cover assembly 100 has a first end 130, a second end 132, and a longitudinal axis X extending therebetween and coextensive with or parallel to a longitudinal axis of the suppressor assembly 200 and/or a barrel of a firearm. The first end 130 is closer to a muzzle of the firearm than the second end 132. Because of this, the first end 130 will typically be hotter than the second end 132.

Figure 19:
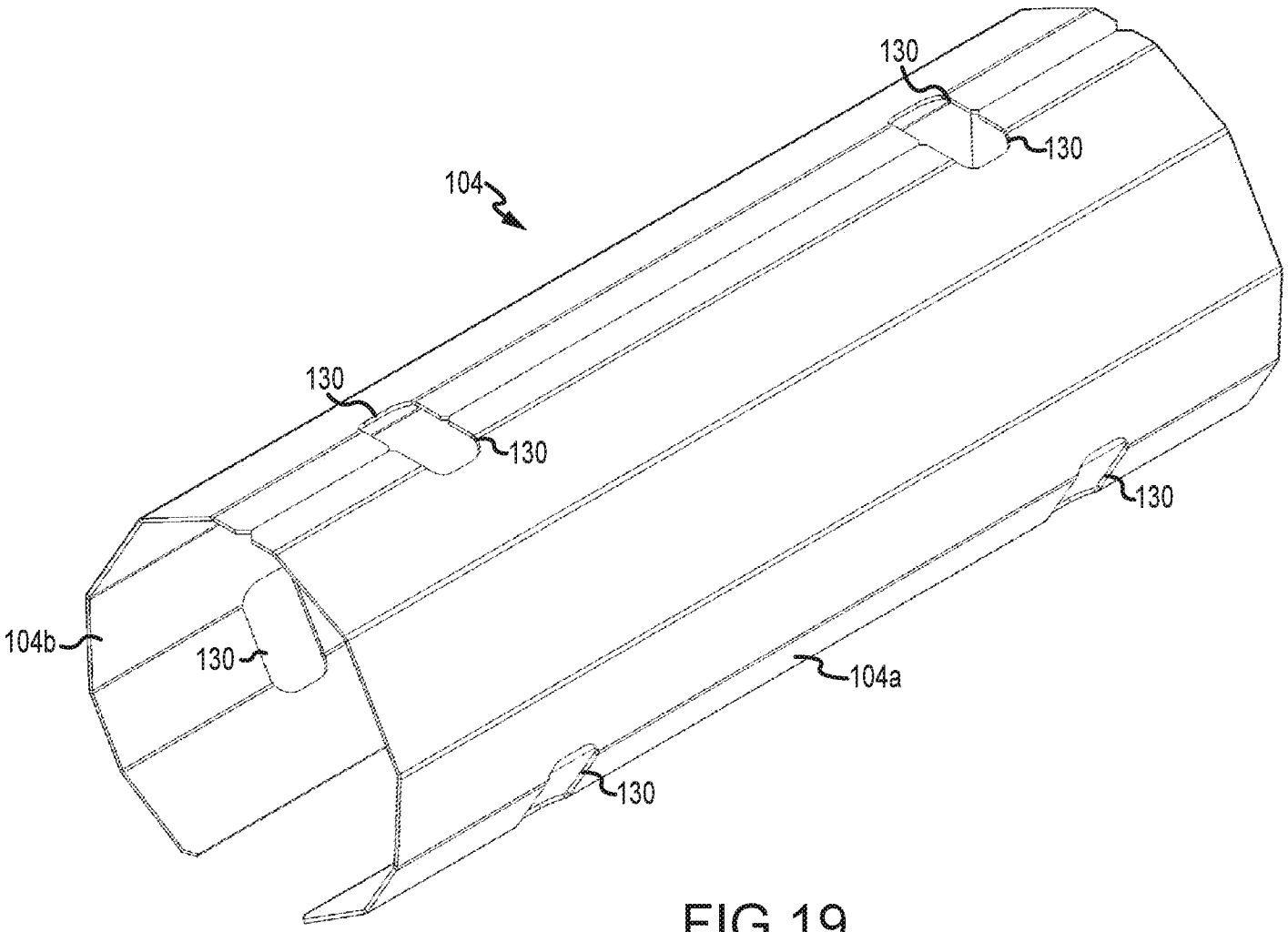
FIG. 19 illustrates an isometric view of a heat shield of a suppressor cover assembly.

The cover assembly 100 includes an outer cover 102 (or insulating cover assembly) having an outer surface that does not reach a temperature of more than about 300 degrees Fahrenheit (about 149 degrees), or 280 degrees Fahrenheit, or 285 degrees Fahrenheit, or 290 degrees Fahrenheit, 295 degrees Fahrenheit, or 305 degrees Fahrenheit, or 310 degrees Fahrenheit, or 315 degrees Fahrenheit, or 320 degrees Fahrenheit, during or after using the cover assembly 100 and an associated firearm to fire a number of rounds. In some embodiments, the rate of fire is associated with fully-automatic operation of the firearm such that a suppressor assembly reaches a temperature of about 1,000 degrees Fahrenheit (about 358 degrees Celsius). In some embodiments, the suppressor assembly 200 reaches a temperature of up to about 1,400 degrees Fahrenheit (about 760 degrees Celsius). In some embodiments, the suppressor assembly 200 reaches a temperature of more than 1,400 degrees Fahrenheit (about 760 degrees Celsius). The outer cover 102 (or insulating cover assembly) is configured to substantially enclose, encircle, or encase an optional heat shield assembly 104 (see e.g. FIG. 19), and may be manufactured of any number of materials that are at least somewhat insulative, such as polymers, ceramics, various composites, glass fibers, textiles, and/or rubber. Although such an embodiment is not illustrated, in some embodiments, the outer cover 102 may encircle the suppressor assembly 200 without interruption or without an interruption that spans a length of the cover assembly 100.

The heat shield assembly 104, which may optionally include multiple components, such as a first heat shield **104*a* and a second heat shield 104*b*, is configured to receive and distribute, disperse, reflect, and/or redirect heat generated during firing. The heat shield assembly 104 may do so using multiple means, such as by way of thermal convection, radiation, and/or conduction. For instance, the heat shield assembly 104 may be made of a thermally-reflective material such as polished metal or metal foil that is configured to reflect thermal radiation from the suppressor assembly 200. As another example, the heat shield assembly 104 may be thermally conductive (e.g., a metal) and have a thermal cross section sufficient to encourage conduction of thermal energy toward ends of the heat shield where thermal energy is most easily distributed to cooler air. As another example, the heat shield assembly 104 may be thermally insulating (e.g., made from a ceramic or textile) and may therefore prevent or reduce conduction to the outer cover 102. In some embodiments, the heat shield assembly 104 can include two or more materials. For instance, the heat shield assembly 104** could comprise a thermally conductive material and a thermally insulating material, for instance, with the thermally insulating material concentrically arranged outside of the thermally conductive material. These two layers may be closely bonded together or bonded together in a way that leaves a small air gap therebetween.

As noted, the heat shield assembly 104 is optional, and in other cases may be omitted.

Figure 11:
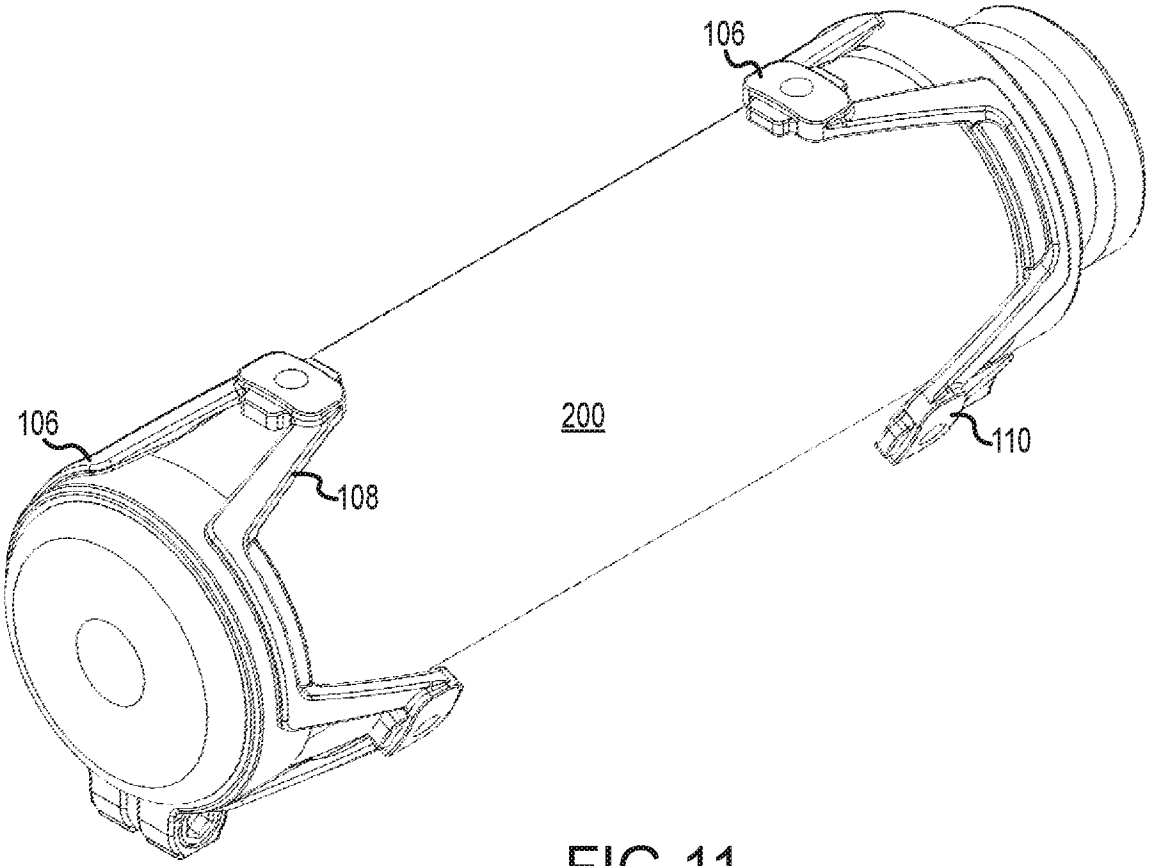
FIG. 11 illustrates an isometric view of components of a suppressor cover assembly coupled to a suppressor assembly, but with an outer body and heat shield hidden to reveal the spacer clamp.

The suppressor cover assembly 100 may further include one or more standoffs, such as spacer clamps 106 (see e.g. FIG. 11), used to create an air gap (e.g., airflow region 112) between the suppressor assembly 200 and the insulating cover assembly 102. The air gap allows both longitudinal and circular movement of air.

Figure 12:
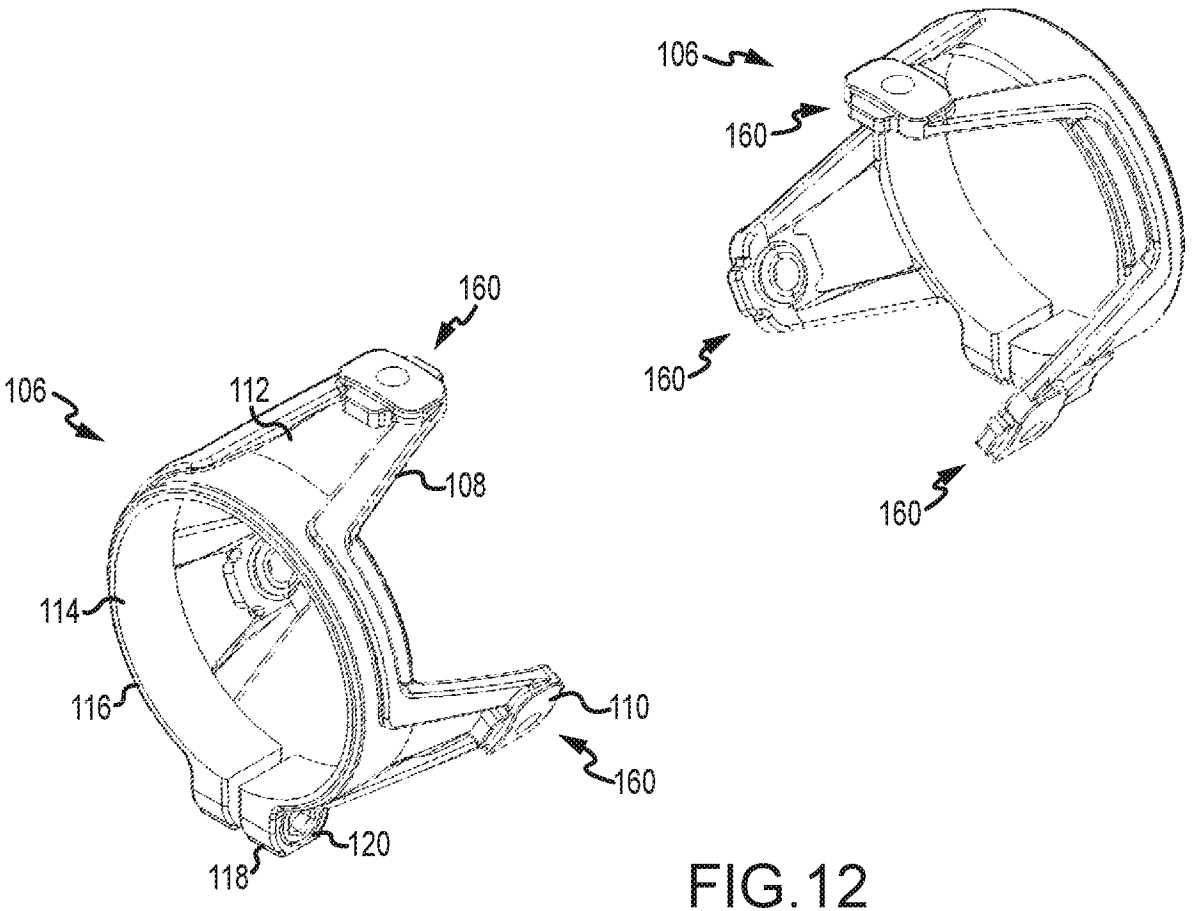
FIG. 12 illustrates an isometric view of spacer clamps of a suppressor cover assembly.

In the illustrated embodiment, the spacer clamps 106 are releasably-coupled to the suppressor assembly 200 and may conduct heat from the suppressor assembly 200 to the heat shield assembly 104 by way of one or more spacer legs 108 and 112 coupled to a clamp body 114 (see e.g. FIG. 12). The spacer legs 108 and 112 may also act as heat fins that dissipate thermal energy into the air gap. However, the thermal cross section of these components can be minimized in order to reduce the rate of heat transfer through this conductive path (i.e., by increasing a rate of convection relative to conduction and effectively decreasing a rate of thermal transfer to the outer cover 102. The clamp body 114 may have a collar 116 configured to fit around a feature in the suppressor assembly 200 (e.g., the collar 116 can releasably attach to a tubular profile of the suppressor assembly 200). The clamp body 114 may also be adjustable and/or removably coupled to the suppressor assembly 200 using a fastening mechanism 118 (or fastener flange). The fastening mechanism 118 may include a fastener 120 to provide a user the ability to adjust or tighten the clamp body 114 on the suppressor assembly 200. The spacer clamp(s) 106 may be made of or comprise a material that is less conductive than the heat shield assembly 104. The spacer clamp(s) 106 may be made of cast, machined, or formed carbon steel, stainless steel, titanium, various alloys, or Inconel. In some embodiments, the material of the spacer clamp(s) 106 is selected so as to withstand a temperature of up to about 1,000 degrees Fahrenheit (about 538 degrees Celsius). In some embodiments, the material of the spacer clamp(s) 106 is selected to provide some ductility or elasticity to allow a user to tighten the spacer clamp(s) 106 about the suppressor assembly and/or to allow the spacer clamp(s) 106 to deform as the firearm is used and heat is generated. The spacer clamp(s) 106 may also reduce or eliminate the chance of the cover assembly 100 loosening and/or sliding off the suppressor assembly 200.

Figure 13:
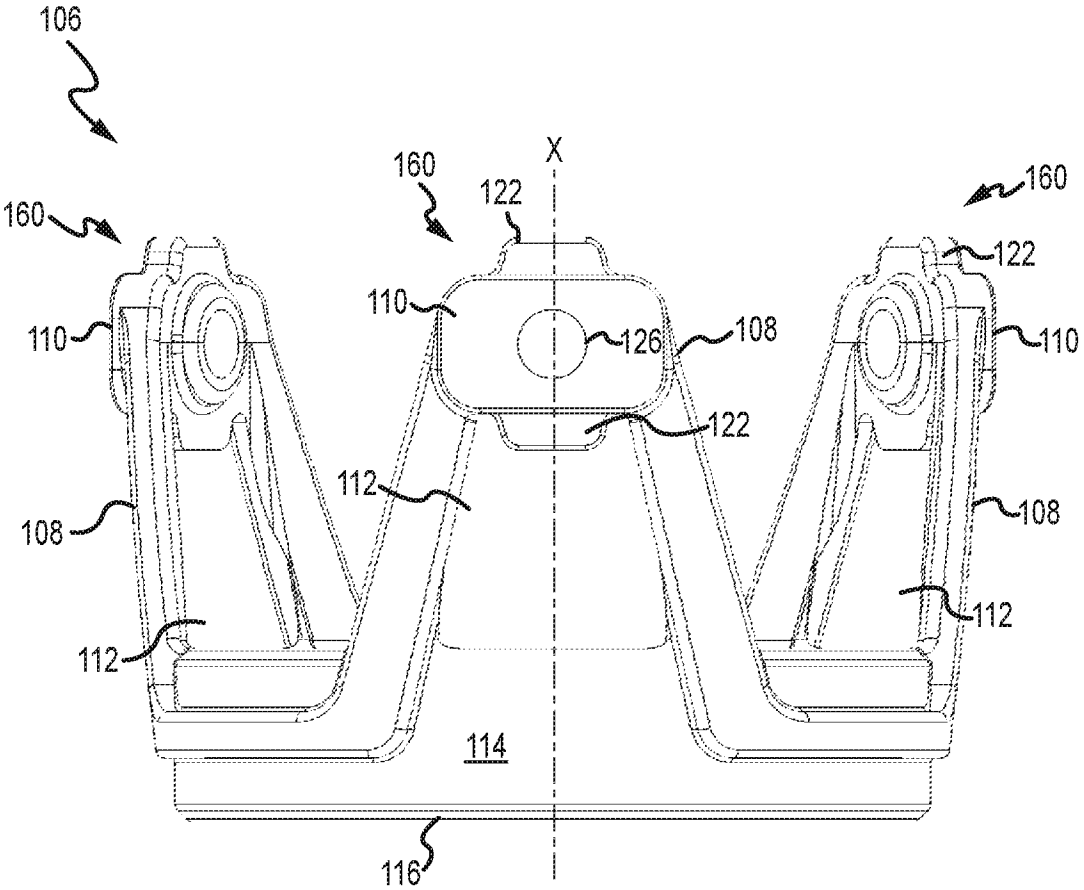
FIG. 13 illustrates a top view of a spacer clamp of a suppressor cover assembly.
Figure 15:
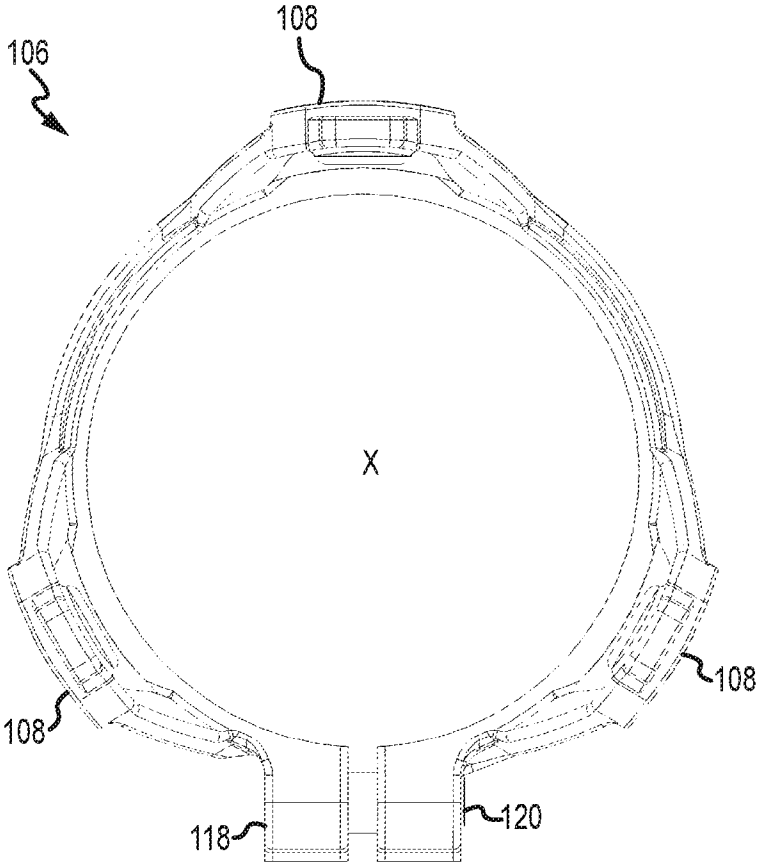
FIG. 15 illustrates a rear view of a spacer clamp of a suppressor cover assembly.
Figure 14:
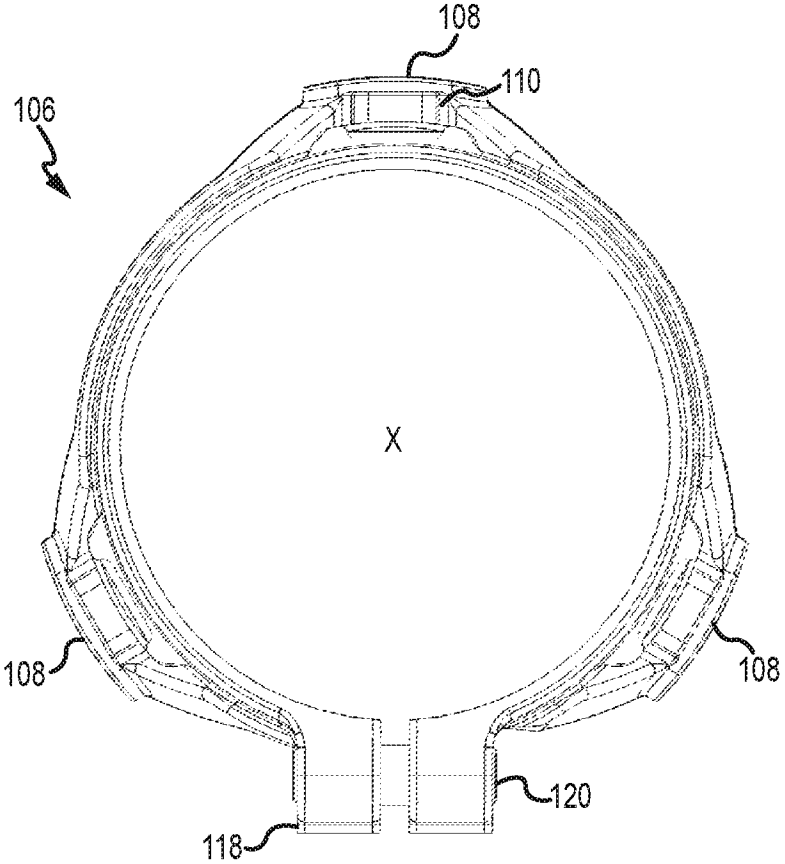
FIG. 14 illustrates a front view of a spacer clamp of a suppressor cover assembly.

As previously described, one or more spacer legs 108 may extend from the clamp body 114 and away from the longitudinal axis X. One or all of the spacer legs 108 may provide a tortuous path (that is, a path having at least one curve), a relatively long conduction path (which may be made possible through the use of a tortuous path in the space between the suppressor assembly 200 and the heat shield assembly 104), and/or a path having a higher resistance to conduction along the path, from the clamp body 114 to a heat shield interface 110 coupled to or part of an end region 160 of the spacer leg(s) 108 (see e.g. FIGS. 12-13). The end region(s) 160 of one or more spacer leg(s) 108 may be a region distal from the clamp body 114 or collar 116. The end region 160 may be further from the longitudinal axis X than the clamp body 114 or collar 116 is. That is, a distance from the longitudinal axis X to the clamp body 114 or collar 116 may be less than a distance from the longitudinal axis X to the end region(s) 160. One or more spacer leg(s) 108 may also have a gap, space, passage, or other airflow region 112 configured to allow air and associated heat to flow through the spacer leg(s) 108 towards an end 130, 132 of the cover assembly 100. That is, the spacer leg(s) 108 may be configured to allow for heat convection between an interior region of the cover assembly 100 to an end region 130, 132 or open region of the cover assembly 100. Those skilled in the art will understand that as the firearm and cover assembly 100 is used and heated, the hotter interior regions may generate pressure to promote air flow through, around, or between the spacer leg(s) 108 and thereby also promote a cooling effect.

Figure 5:
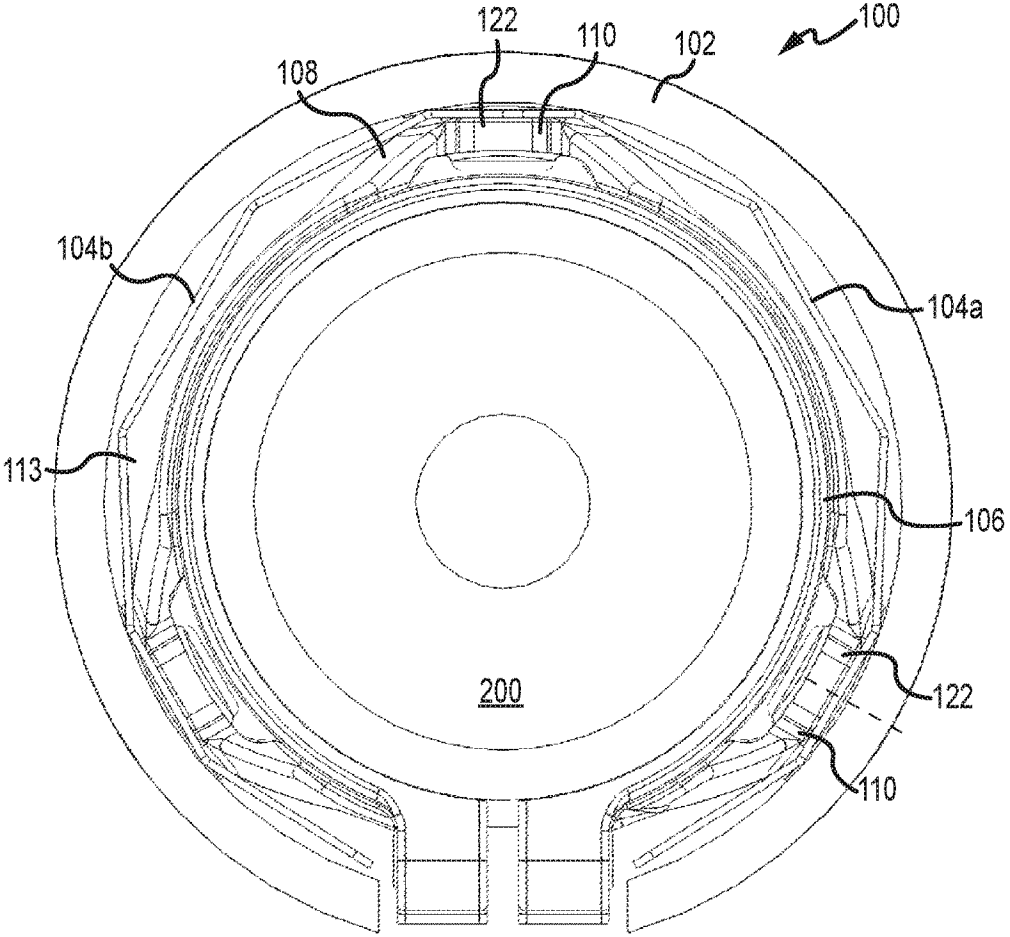
FIG. 5 illustrates a front view of components of a suppressor cover assembly coupled to a suppressor assembly according to some embodiments.

Moreover, the airflow region 112 and/or the space 113 (see e.g. FIG. 5) between the suppressor assembly 200 and the heat shield assembly 104 may redirect the flow of hot air away from the suppressor assembly 200 and/or the line of sight to eliminate or minimize the mirage effect previously described herein, thereby improving the accuracy of the optics/sight.

Figure 16:
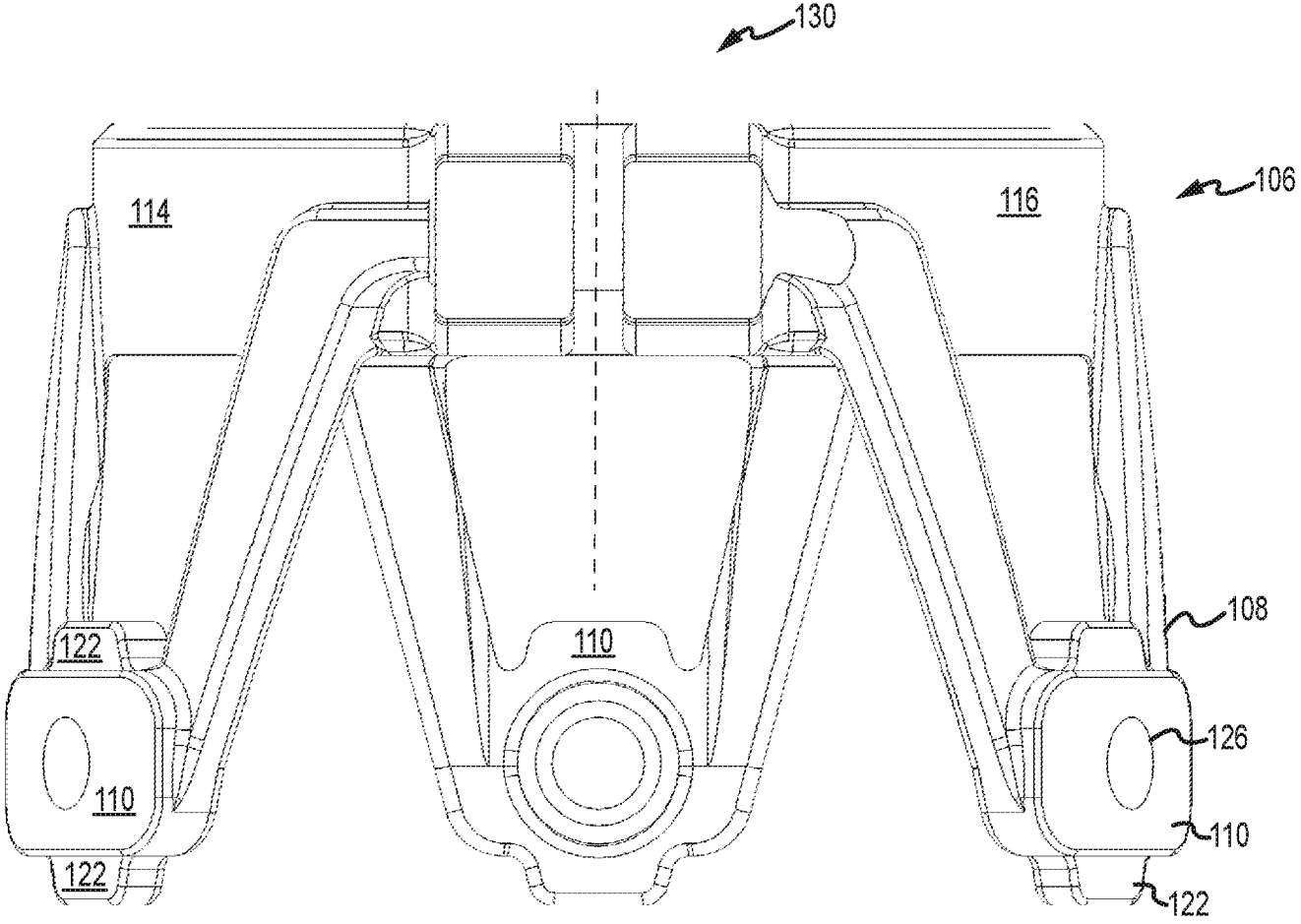
FIG. 16 illustrates a bottom view of a spacer clamp of a suppressor cover assembly.
Figure 18:
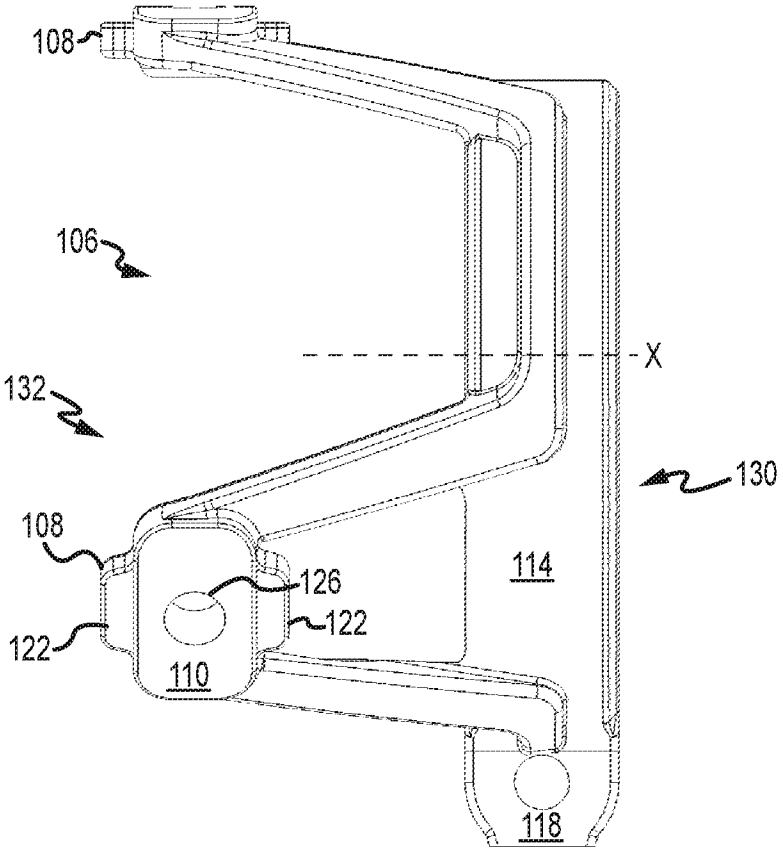
FIG. 18 illustrates a second side view of a spacer clamp of a suppressor cover assembly.

With reference to FIG. 16, the heat shield interface(s) 110 may be a motion limiter; that is, the heat shield interface(s) 110 may limit motion of the heat shield 104 relative to the spacer clamp(s) 106. In some embodiments, the heat shield interface(s) 110 may include one or more flanges 122 or flanged surfaces to limit or prevent the heat shield 104 from shifting towards the longitudinal axis X of the spacer clamp 106, and one or more protrusions 124 to prevent or limit the heat shield 104 from translating along or rotating about the longitudinal axis X. Those skilled in the art will understand that the heat shield interface(s) 110 may include any means for suitably locating the heat shield 104 relative to the spacer clamp(s) 106 and/or the suppressor assembly 200.

Figure 5A:
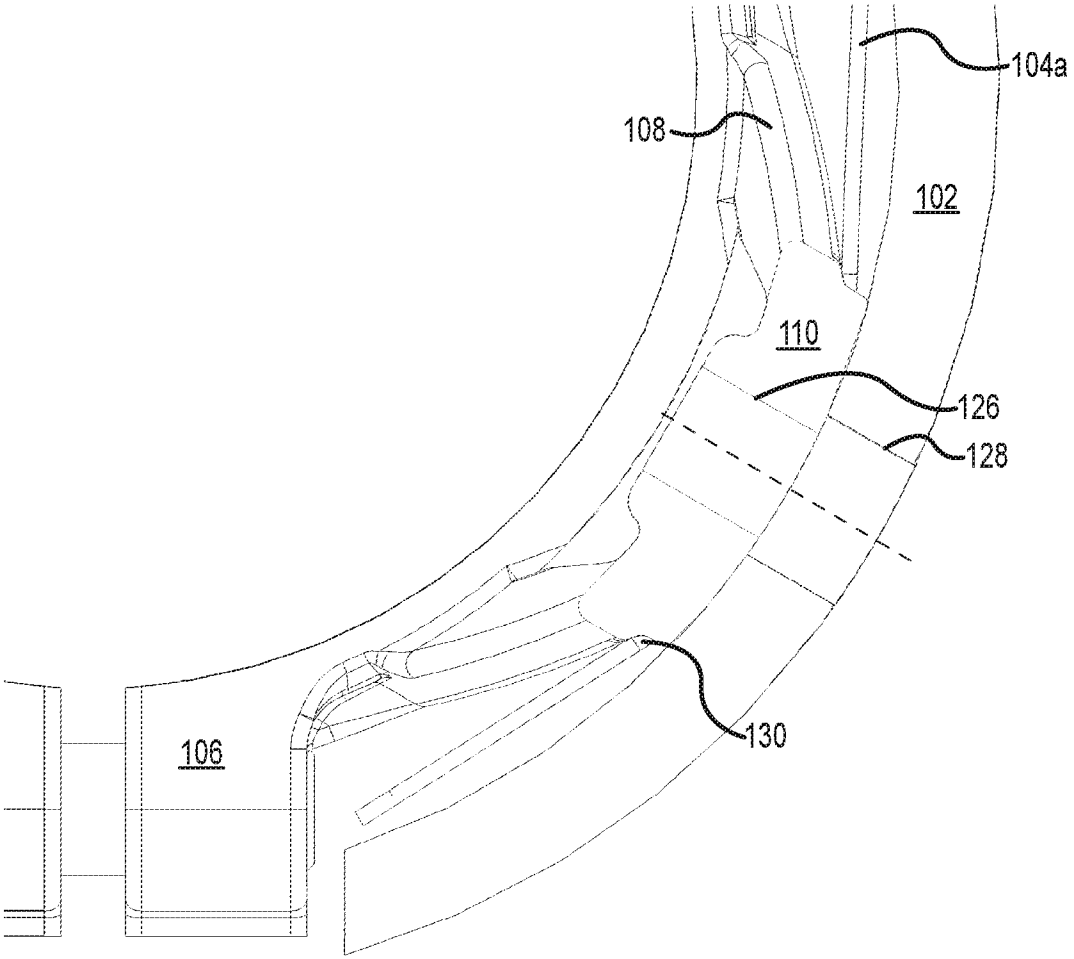
FIG. 5A illustrates a close up head on view of components of a suppressor cover assembly coupled to a suppressor assembly according to some embodiments.
Figure 5B:
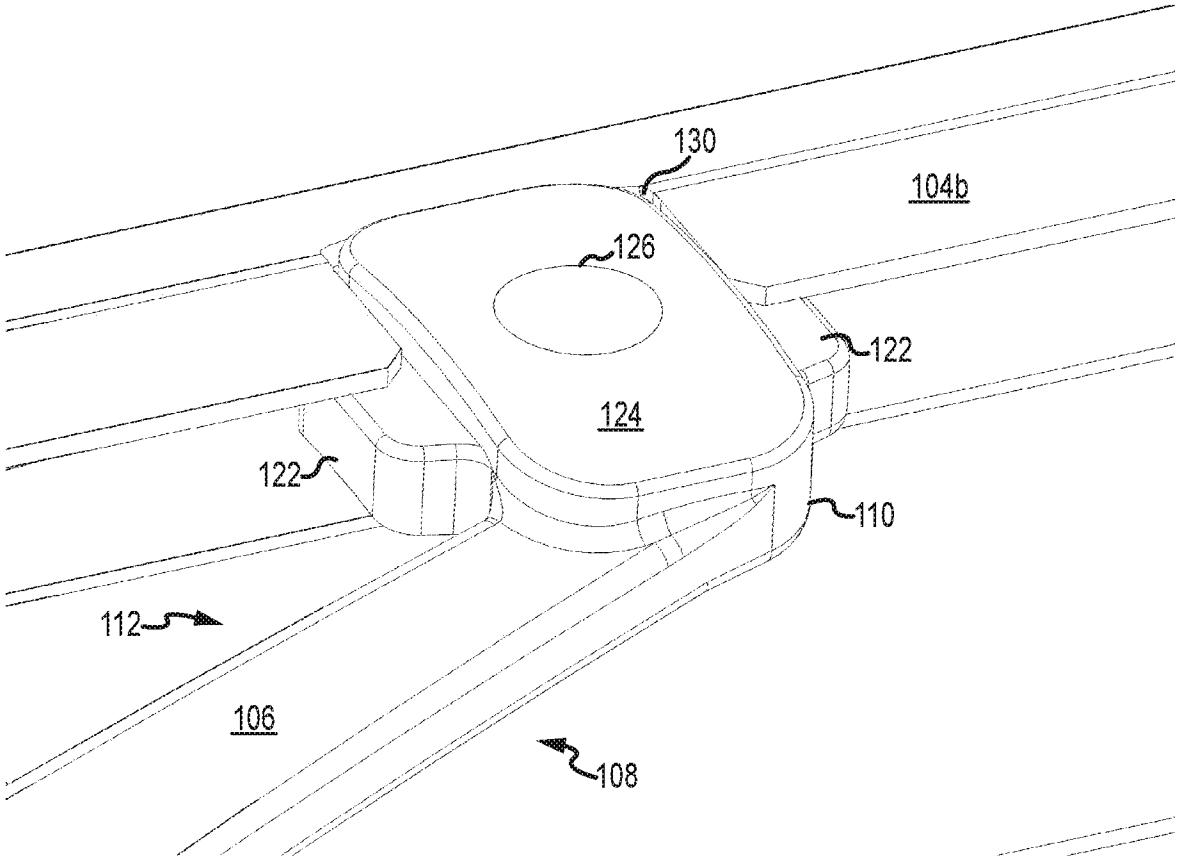
FIG. 5B illustrates a close up of components of a suppressor cover assembly according to some embodiments.
Figure 6:
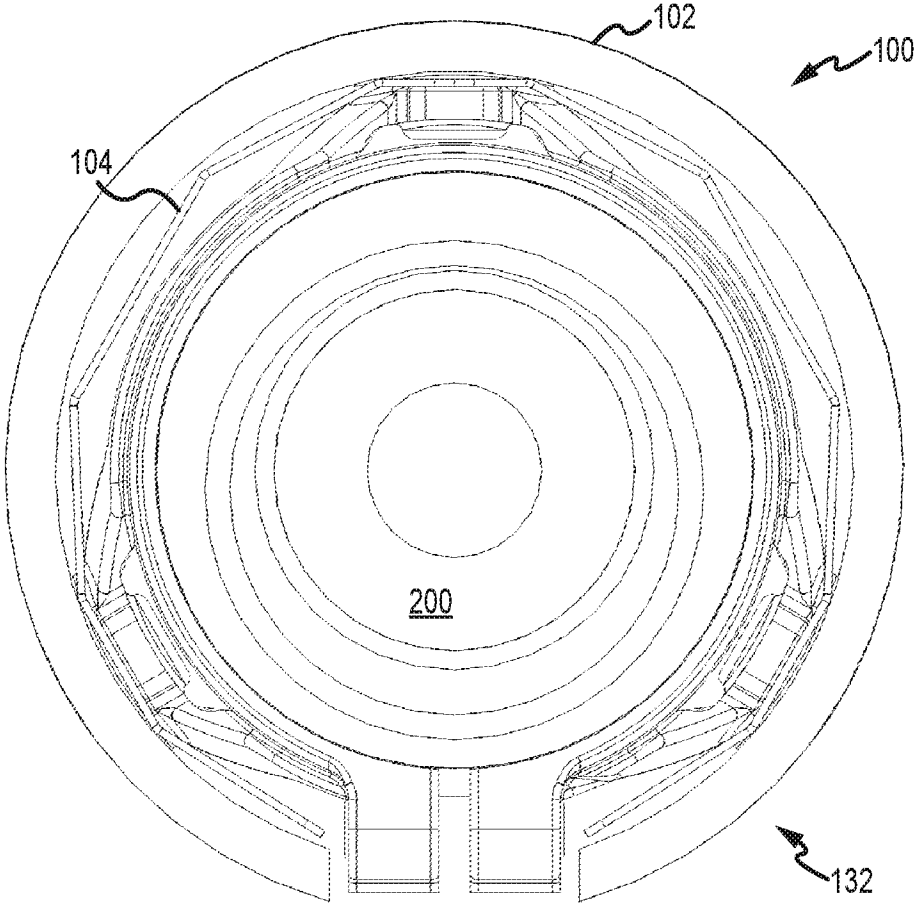
FIG. 6 illustrates a rear view of components of a suppressor cover assembly coupled to a suppressor assembly according to some embodiments.
Figure 9:
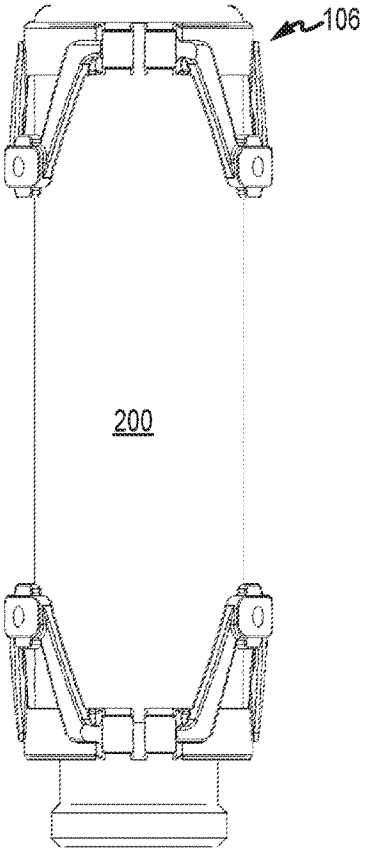
FIG. 9 illustrates a bottom view of components of a suppressor cover assembly coupled to a suppressor assembly, but with an outer body and heat shield hidden to reveal the spacer clamps.
Figure 8:
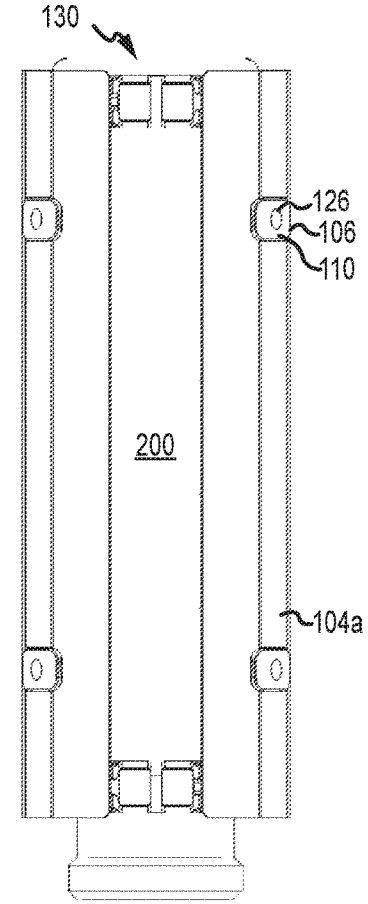
FIG. 8 illustrates a bottom view of components of a suppressor cover assembly coupled to a suppressor assembly, but with an outer body hidden to reveal the heat shield and spacer clamps.
Figure 7:
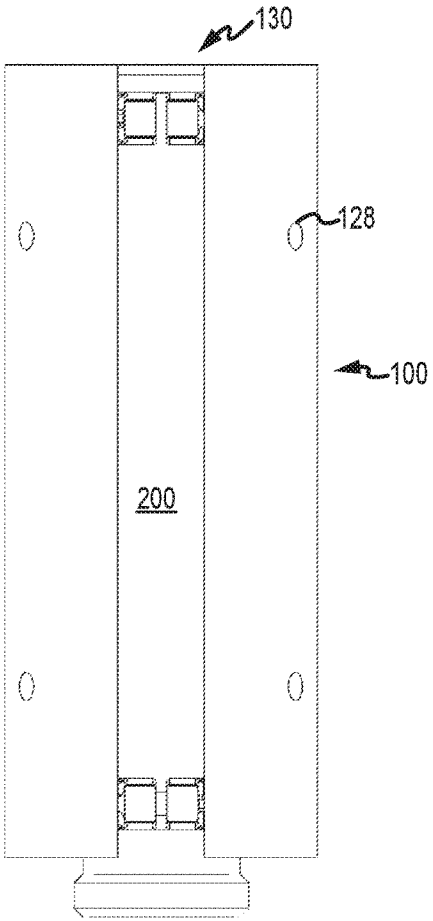
FIG. 7 illustrates a bottom view of components of a suppressor cover assembly coupled to a suppressor assembly according to some embodiments.
Figure 10:
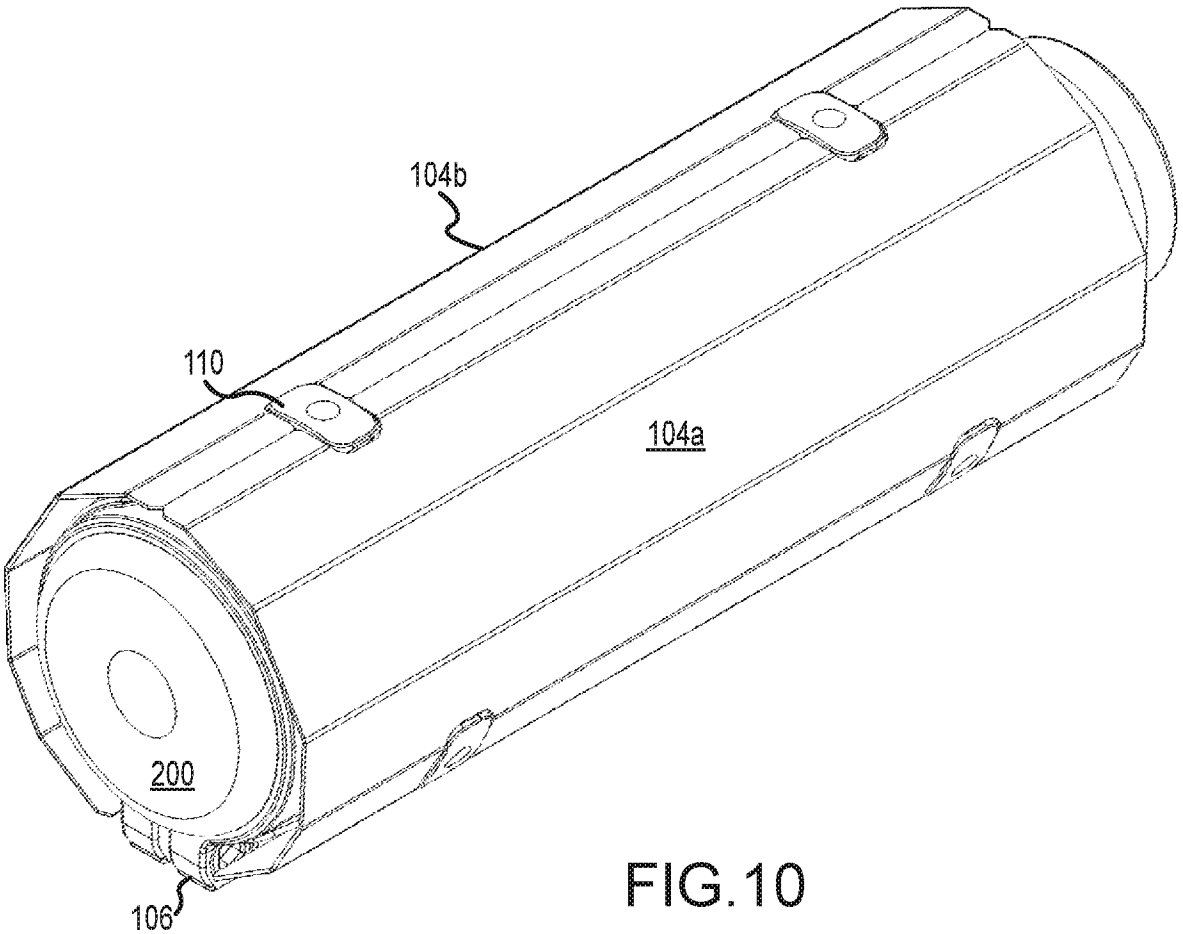
FIG. 10 illustrates an isometric view of components of a suppressor cover assembly coupled to a suppressor assembly, but with an outer body hidden to reveal a heat shield and spacer clamps.
Figure 17:
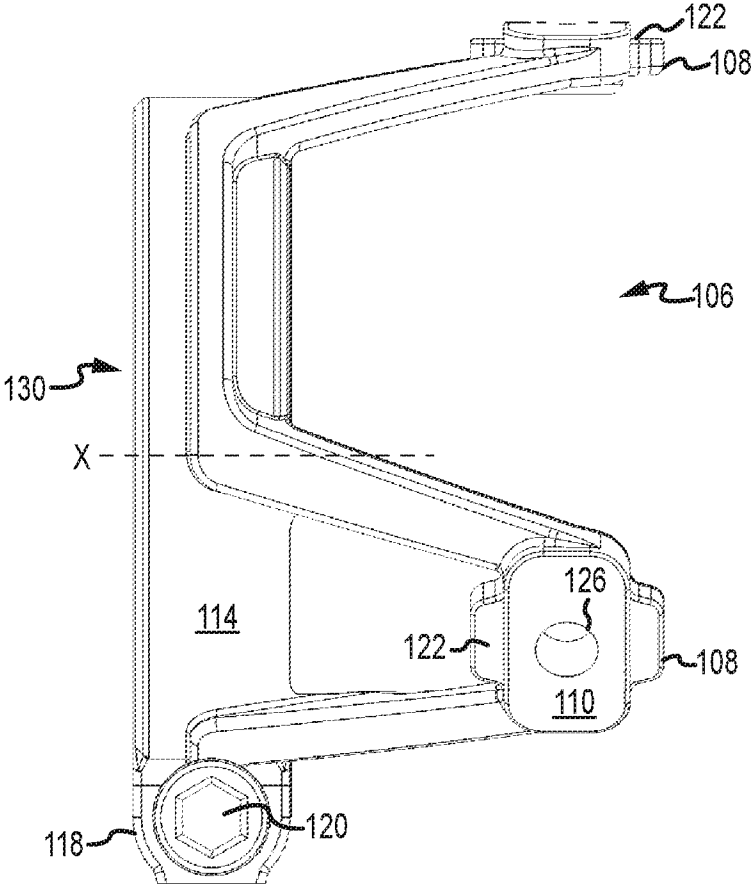
FIG. 17 illustrates a first side view of a spacer clamp of a suppressor cover assembly.

In some embodiments, the heat shield interface(s) 110 may have a fastener interface 126 and the outer body 102 may have a corresponding fastener interface 128 (see e.g. FIGS. 5A, 5B, 17) to enable a user to couple the outer body 102 to the spacer clamp(s) 106 with at least a portion of the heat shield assembly 104 positioned therebetween. The heat shield assembly 104 may have a corresponding passage 130 to allow a fastener (not illustrated) to pass therethrough for coupling the outer body 102 to the spacer clamp 106 with a portion of the heat shield assembly 104 fixed or located therebetween. In some embodiments, the heat shield assembly 104 may have an interference fit with the heat shield interface(s) 110 of the spacer clamp(s) 106.

Turning now to FIGS. 19-24, the heat shield or heat shield assembly 104 may include a first and second heat shield 104*a*, 104*b* configured to, when coupled together, substantially surround, enclose or encase the suppressor assembly 200, although those skilled in the art will understand that the heat shield assembly 104 may be made of a single unitary piece that fits over the suppressor assembly 200, or the heat shield assembly 104 may be made of more than two heat shields 104*a*, 104*b*. The heat shield assembly 104 may include one or more passages 130 to allow a user to couple the outer body 102 to the spacer clamp(s) 106 with the heat shield assembly 104 therebetween. The heat shield assembly 104 or first and second heat shields 104*a*, 104*b* may be made of a relatively thin conductive material such as a metal that is bent, extruded or otherwise formed into a shape suitable for surrounding a substantial portion of the suppressor assembly 200. The heat shield assembly 104 may be made of cast, machined, or formed carbon steel, stainless steel, titanium, various alloys, or Inconel. Those skilled in the art will understand that although the heat shield assembly 104 is illustrated as having a polygonal profile (see e.g. FIG. 20), a circular or other profile may also be provided.

Figure 20:
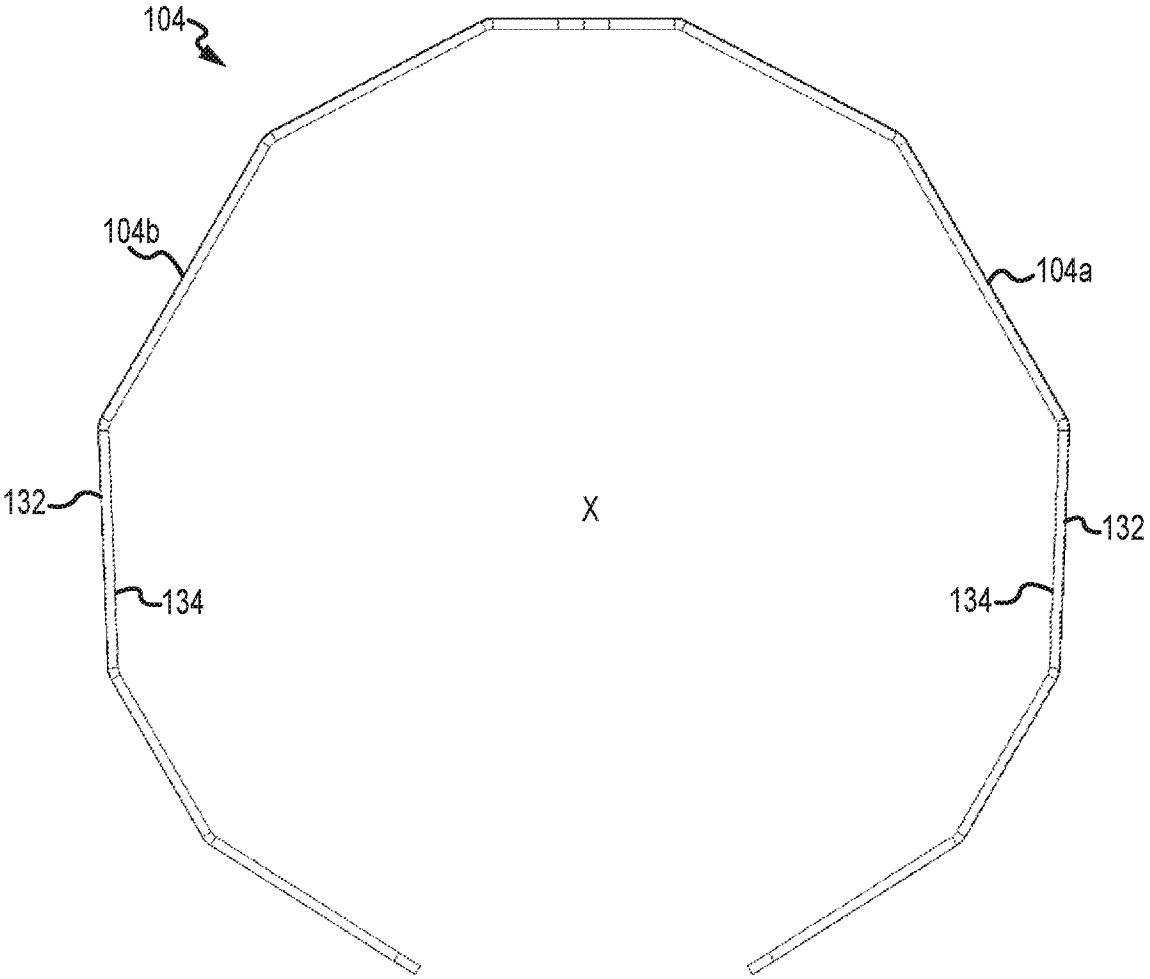
FIG. 20 illustrates a front view of a heat shield of a suppressor cover assembly.
Figure 21:
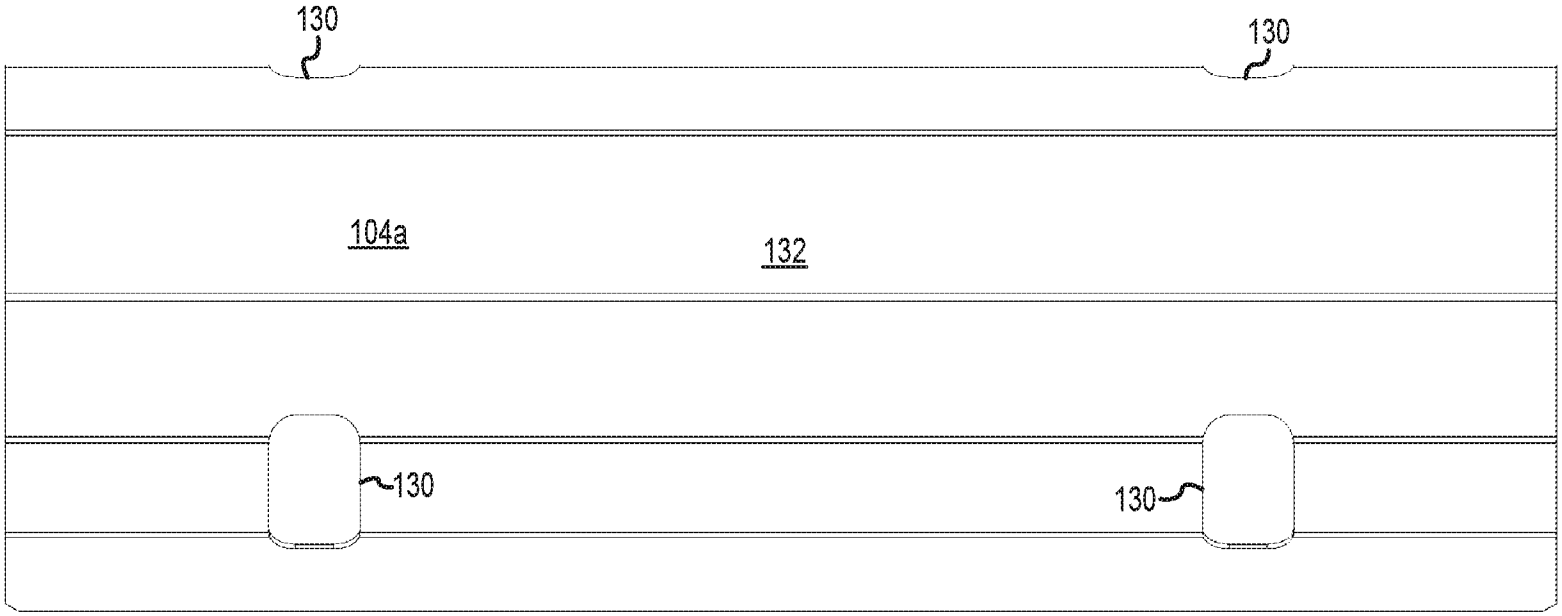
FIG. 21 illustrates a side view of a heat shield of a suppressor cover assembly.
Figure 23:
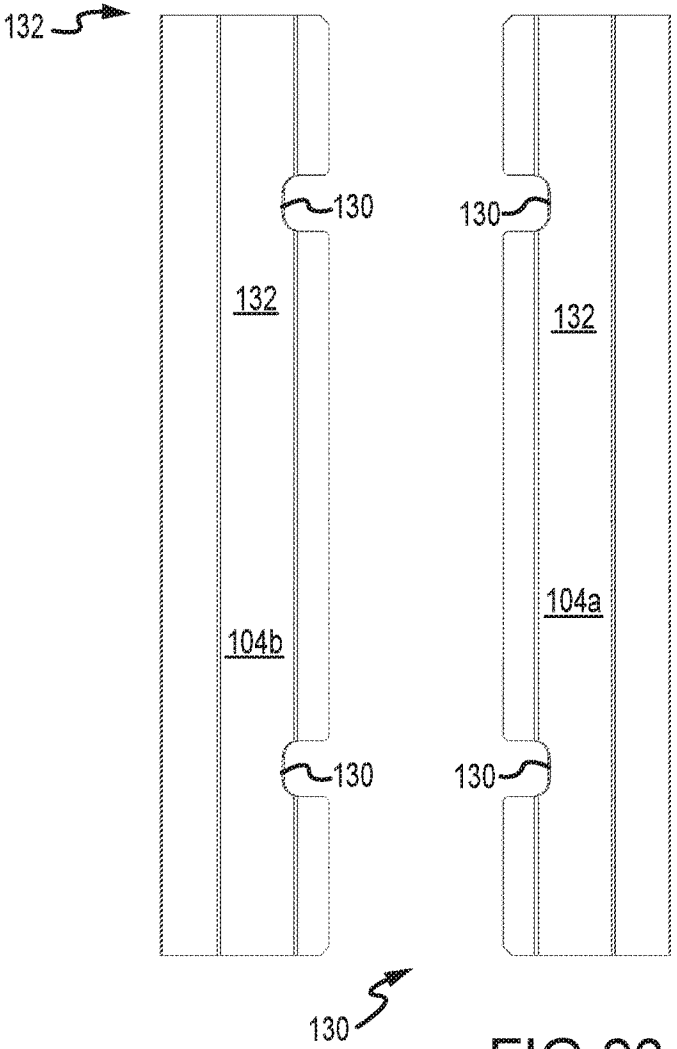
FIG. 23 illustrates an exploded bottom view of a heat shield of a suppressor cover assembly.
Figure 22:
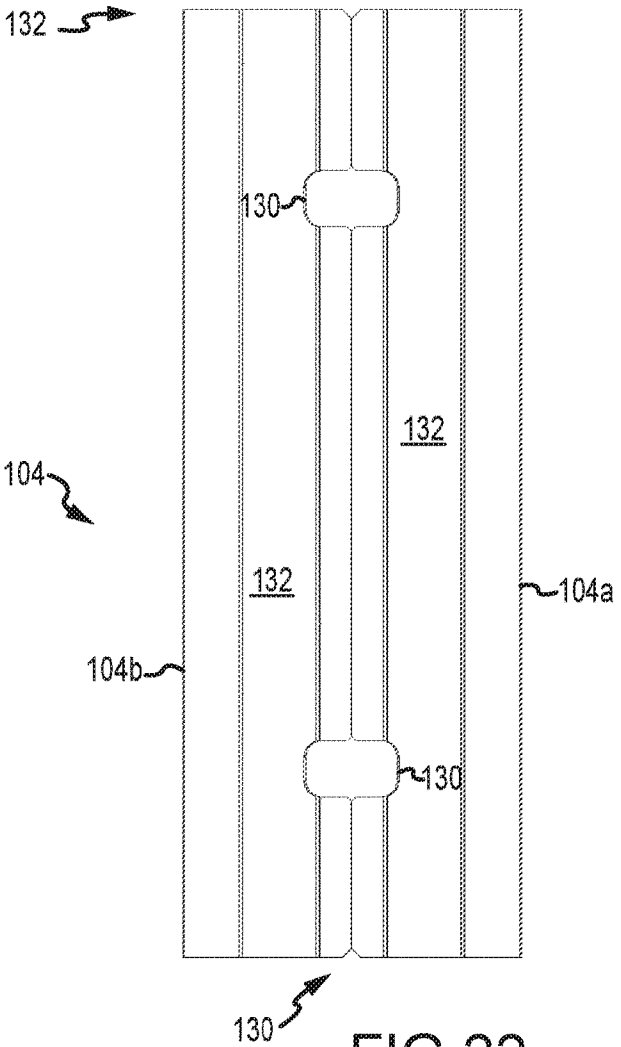
FIG. 22 illustrates a bottom view of a heat shield of a suppressor cover assembly.
Figure 24:
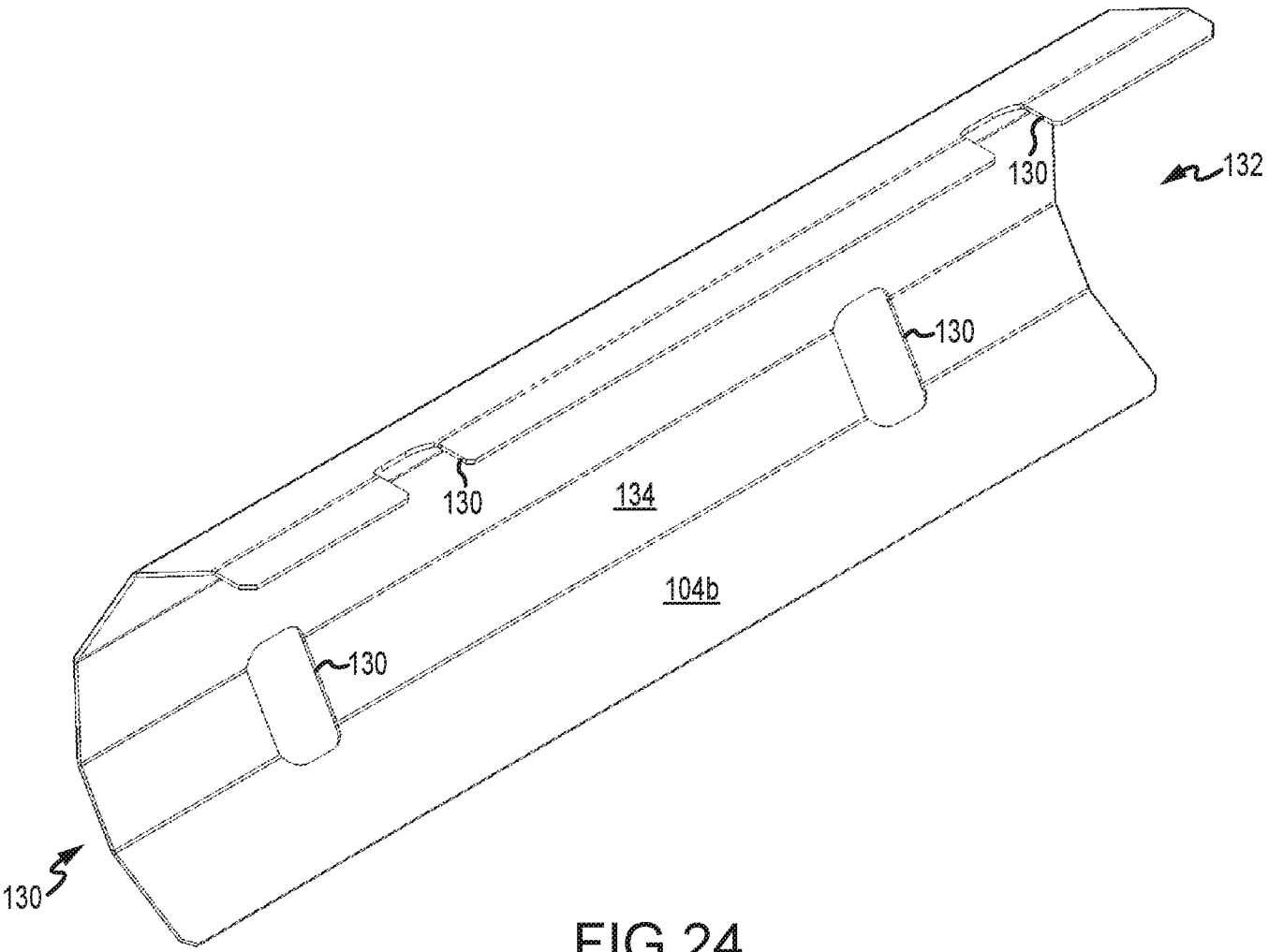
FIG. 24 illustrates an isometric view of a portion of a heat shield of a suppressor cover assembly.
Figure 25:
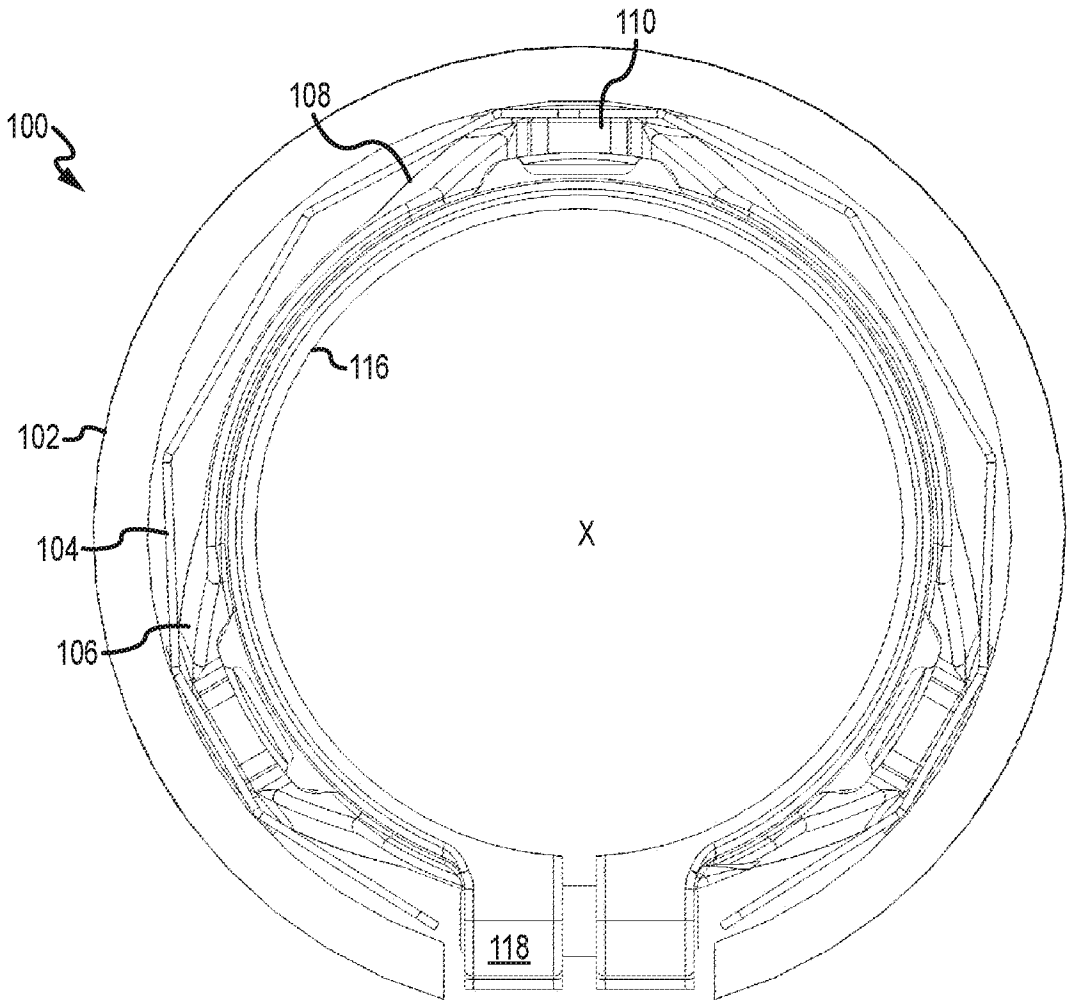
FIG. 25 illustrates a front view of a suppressor cover assembly according to some embodiments.
Figure 26:
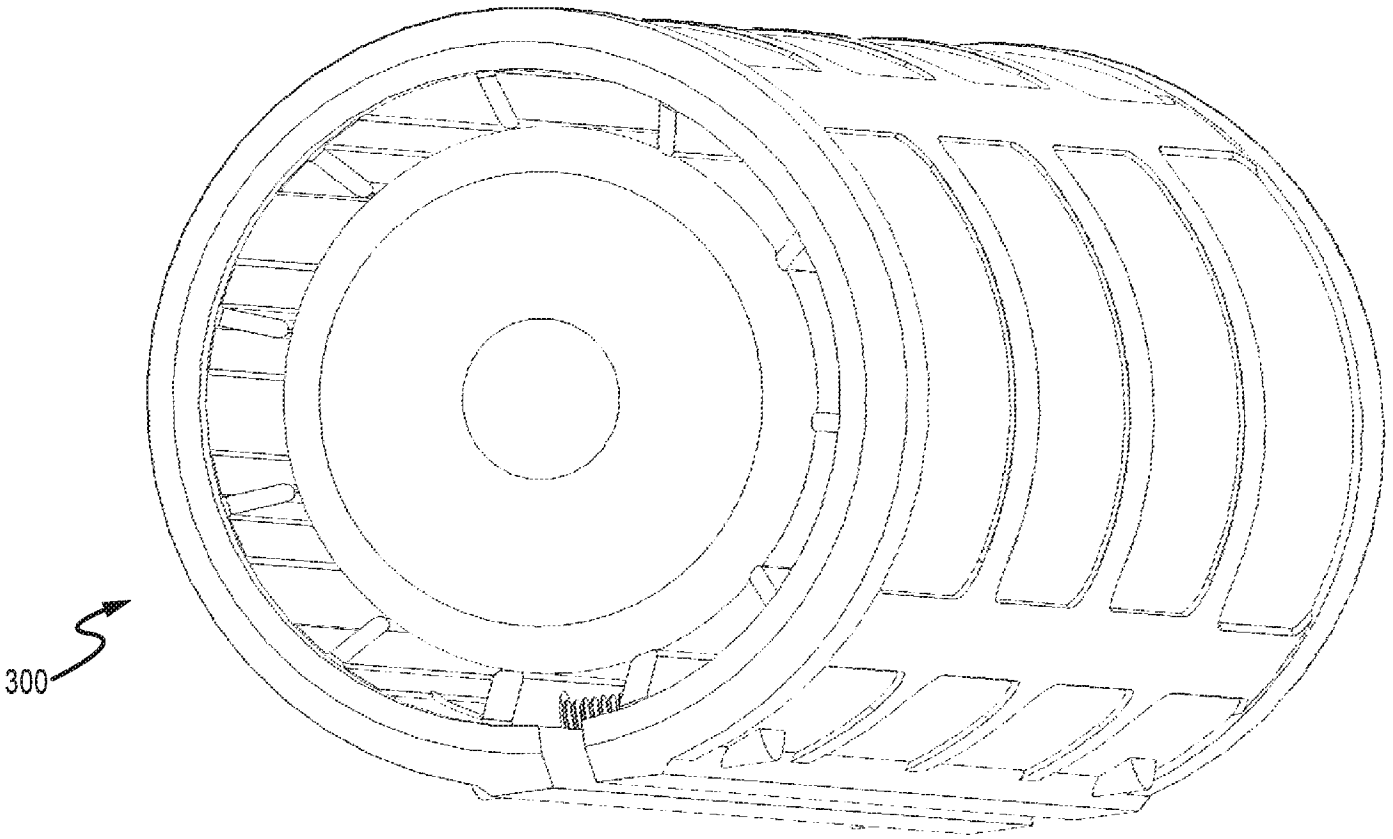
FIG. 26 illustrates a front right isometric view of components of a suppressor assembly according to some embodiments.
Figure 27:
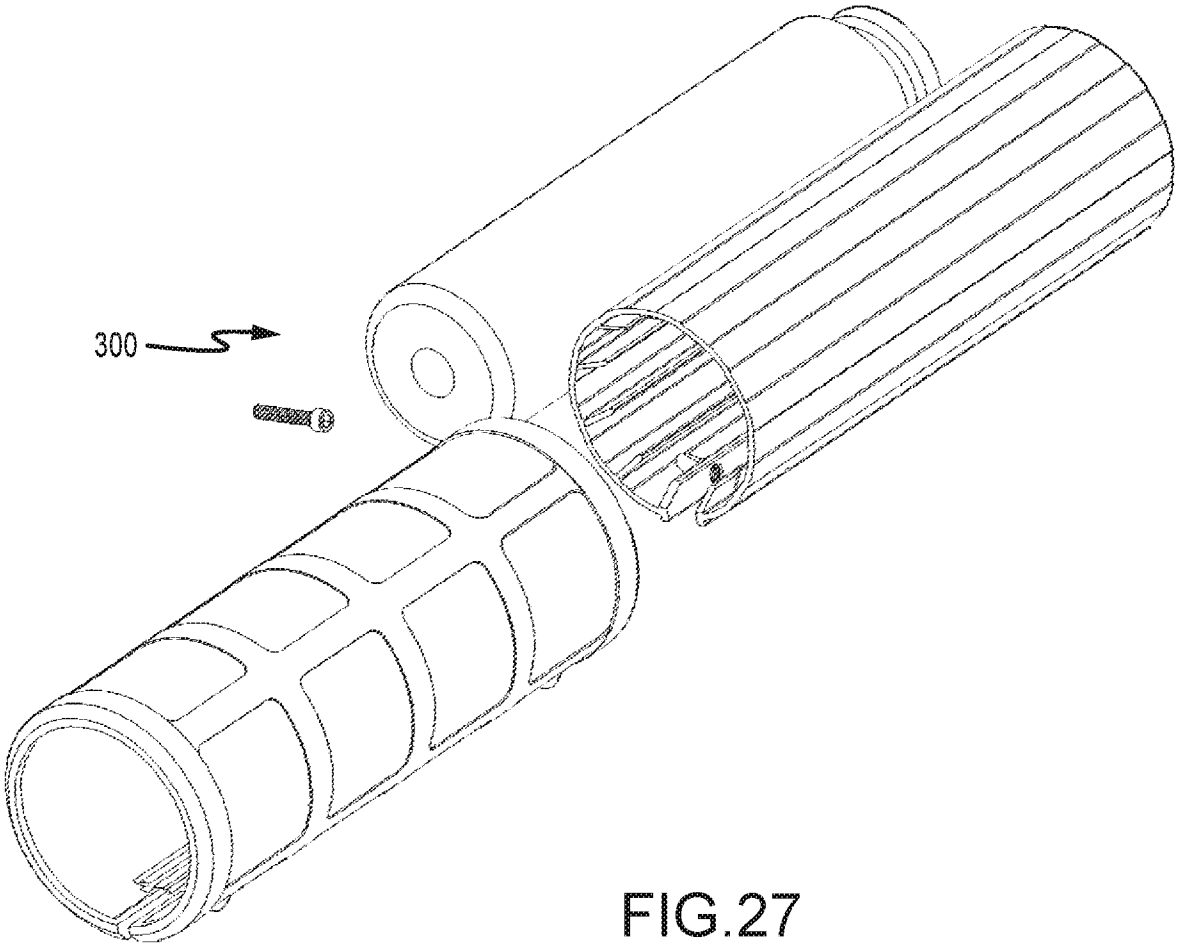
FIG. 27 illustrates an exploded isometric view of components of a suppressor assembly according to some embodiments
Figure 28:
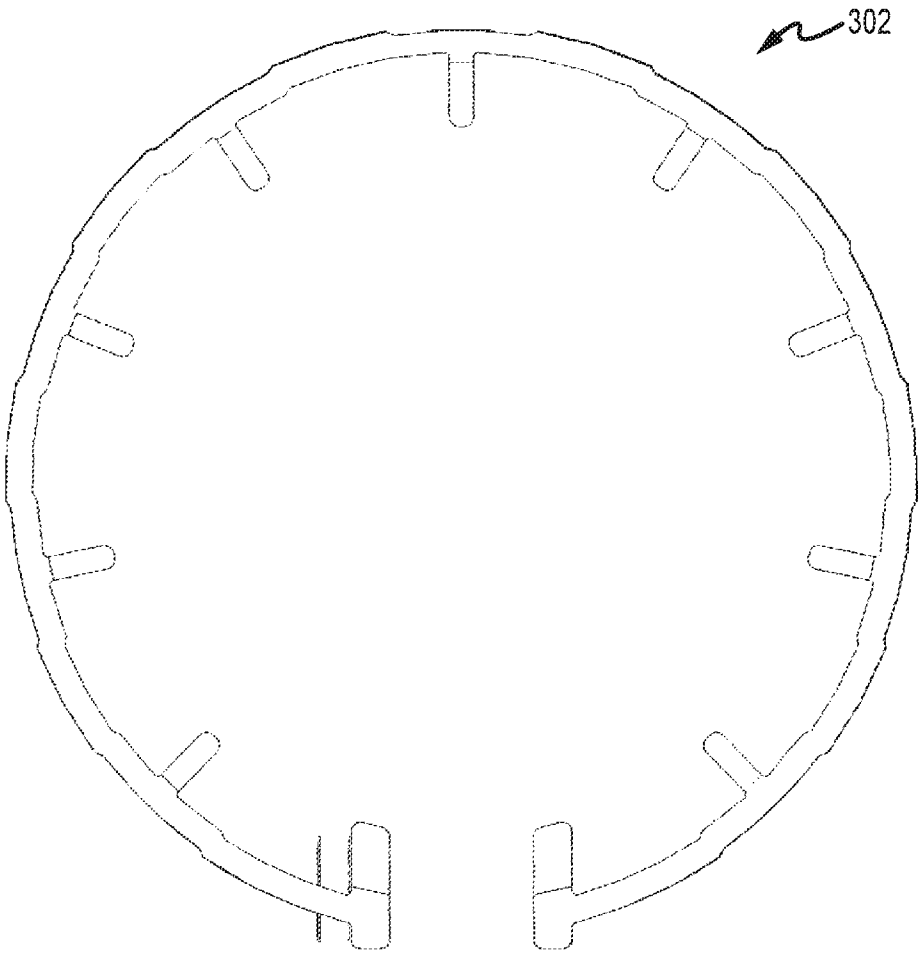
FIG. 28 illustrates a front view of a heat shield of a suppressor cover assembly according to some embodiments.
Figure 29:
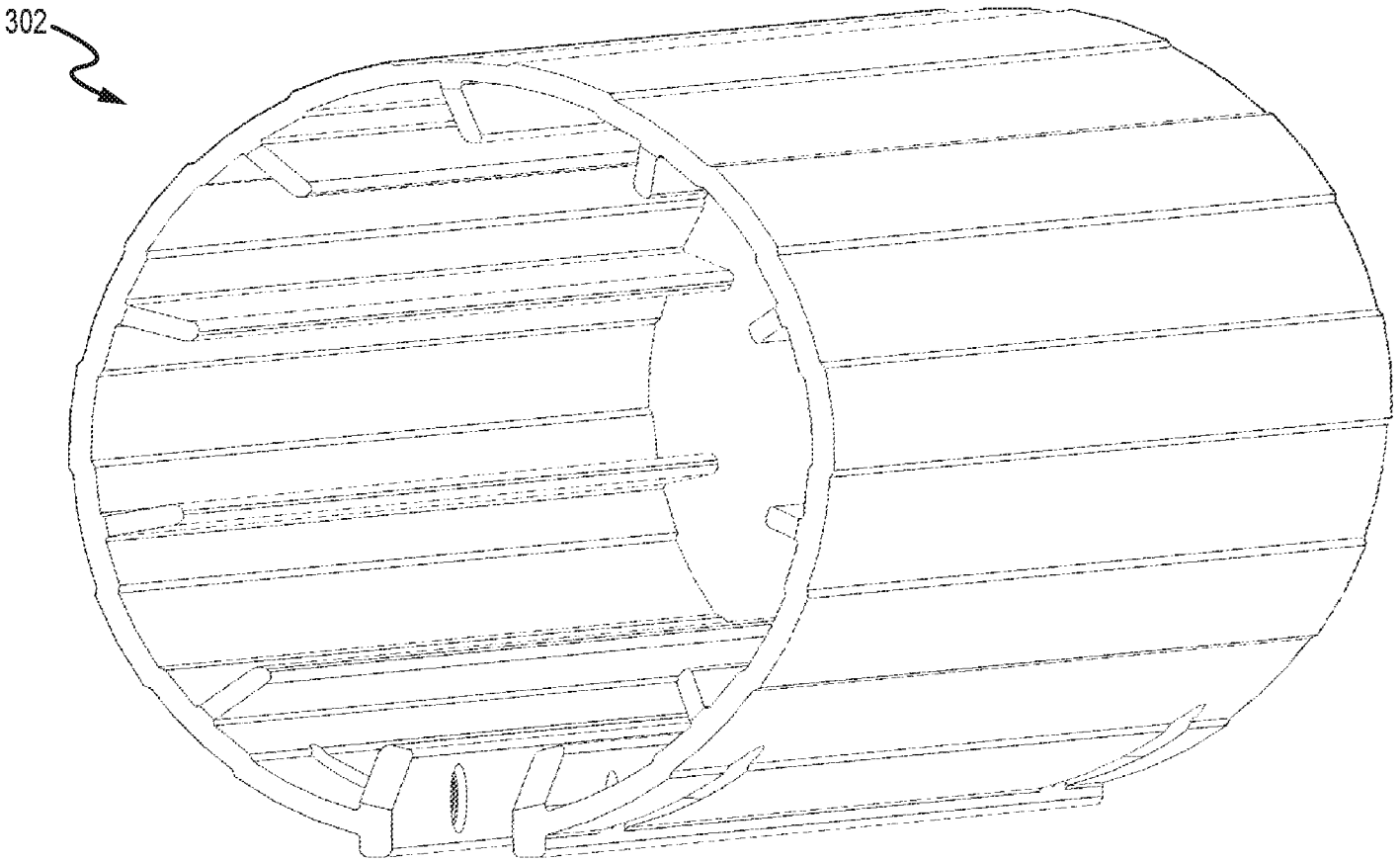
FIG. 29 illustrates an isometric view of a heat shield of a suppressor cover assembly according to some embodiments.
Figure 30:
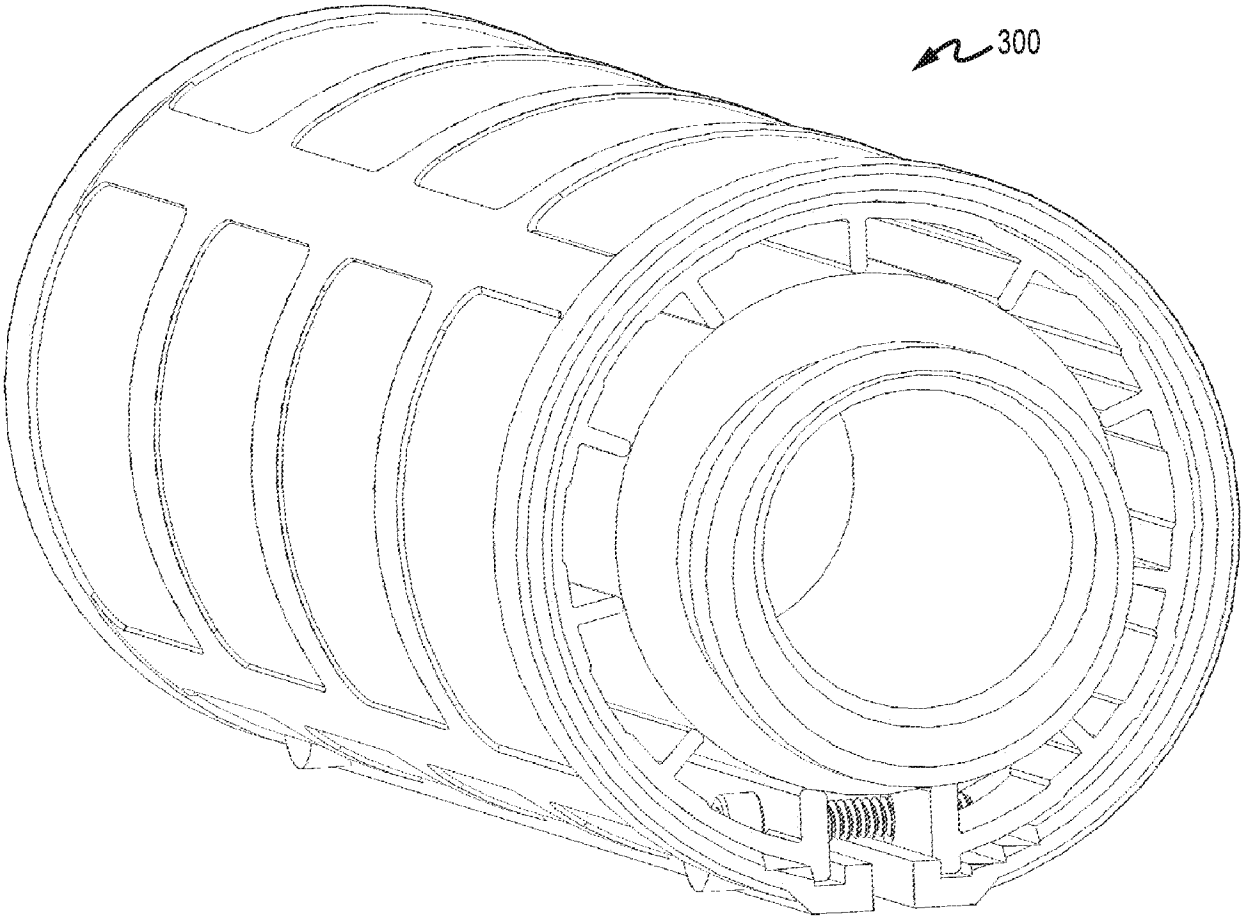
FIG. 30 illustrates a rear right isometric view of components of a suppressor cover assembly according to some embodiments.

Continuing with FIG. 20, the heat shield assembly 104 has an outer surface 132 and an inner surface 134, with the inner surface 134 facing the longitudinal axis X and/or the suppressor assembly 200. The heat shield assembly 104 may be configured, in addition to dissipating heat through conduction and convection, to minimize heat transfer to the outer body 102 through control of radiation heat transfer. Specifically, the inner surface 134 of the heat shield assembly 104 may be configured reflect or transmit as much heat as possible, while the outer surface 132 may be configured to absorb as much heat as possible. In some embodiments, the inner surface 134 may have a polished, smooth, and/or reflective surface, while the outer surface 132 may have an unfinished, rough, and/or heat absorptive surface. The inner surface 134 may be smoother and/or more optically and thermally reflective than the outer surface 132.

With reference now to FIGS. 26-30, an alternative embodiment of the cover assembly 300 is illustrated. As most clearly seen in FIG. 29, the cover assembly 300 may include a heat shield 302 that has one or more inwardly-protruding flanges for increasing the amount of heat transferred to the heat shield 302 by conduction.

Figure 31:
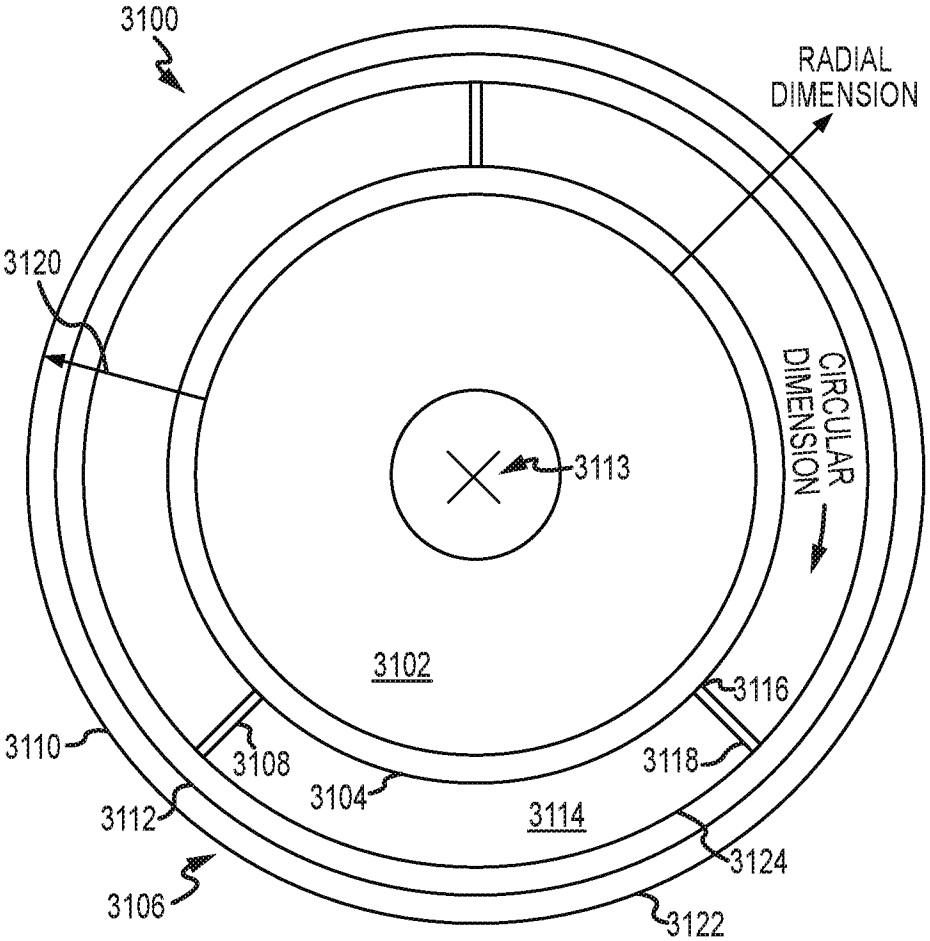
FIG. 31 illustrates another embodiment of a firearm suppressor cover assembly.

FIG. 31 illustrates another embodiment of a firearm suppressor cover assembly. The firearm suppressor cover assembly 3100 (hereinafter "cover assembly 3100") is designed to minimize conductive pathways between the suppressor and a user. To this end, the cover assembly 3100 includes clamps 3104 that constitute the only regions of contact between the cover assembly 3100 and the suppressor 3102. Thermal energy therefore only has conductive pathways through these clamps 3104, and otherwise exits the suppressor 3102 via convection through an air gap 3114 or radiation (both being more inhibiting to thermal transfer than conduction). The clamps 3104 can be configured to releasably fix the cover assembly 3100 to the suppressor 3102.

Figure 51:
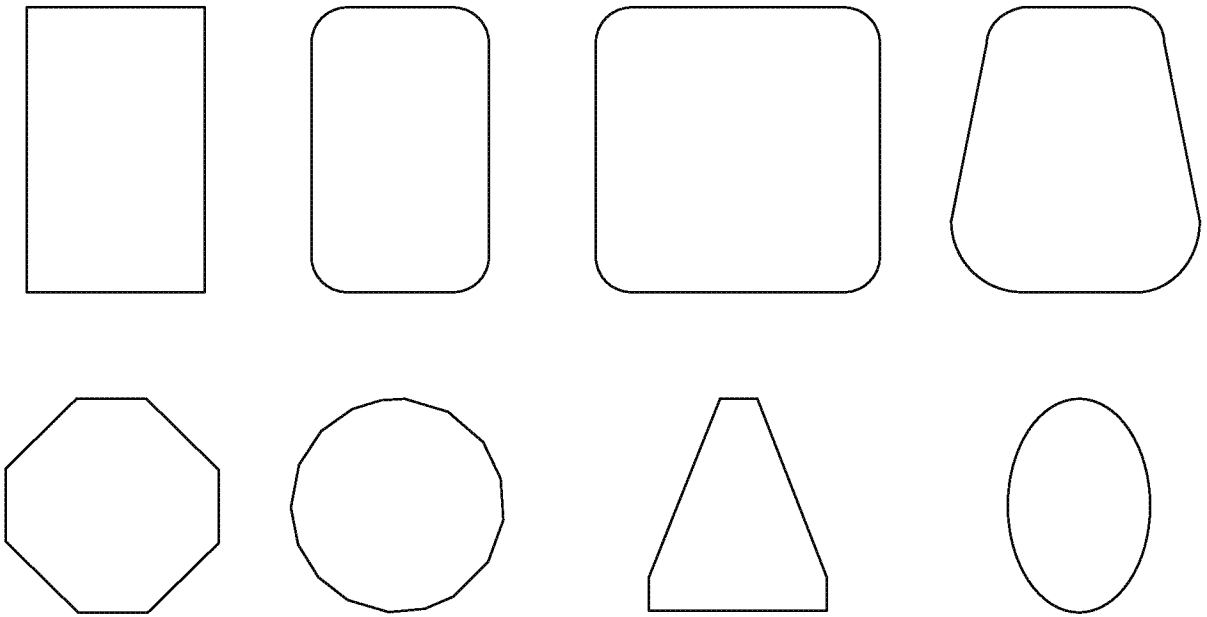
FIG. 51 illustrates various cross sections of shapes that could be considered generally cylindrical.

The cover assembly 3100 can also include an insulating cover assembly 3106 rigidly supported to maintain a generally cylindrical shape (see e.g., FIG. 51). The insulating cover assembly 3106 can include at least one insulating material such as textile or ceramic. The insulating cover assembly 3106 prevents excessive thermal energy from exiting an area of the suppressor 3102 above the suppressor 3102 where it can interfere with sighting, and also prevents a user from coming into contact with the hot suppressor 3102. Further, the insulating cover assembly 3106 is configured to minimize a rate of thermal transfer from an inside surface 3124 of the insulating cover assembly 3106 to an outer surface 3122 thereof. The insulating cover assembly 3106 also acts as a guide to channel thermal energy via convection toward ends of the cover assembly 3100. In some embodiments, the insulating cover assembly 3106 can include an insulating cover 3110 made from a textile, ceramic, or other insulating material, as well as a rigid support 3112 having a generally cylindrical shape. The rigid support 3112 can be in contact with the insulating cover 3110 to support and shape the insulating cover 3110. In this way, flexible materials such as textiles can be used in the insulating cover assembly 3106 while maintaining a generally tubular shape that is spaced apart from the clamps 3104 and thereby maintains the air gap 3114.

Figure 40:
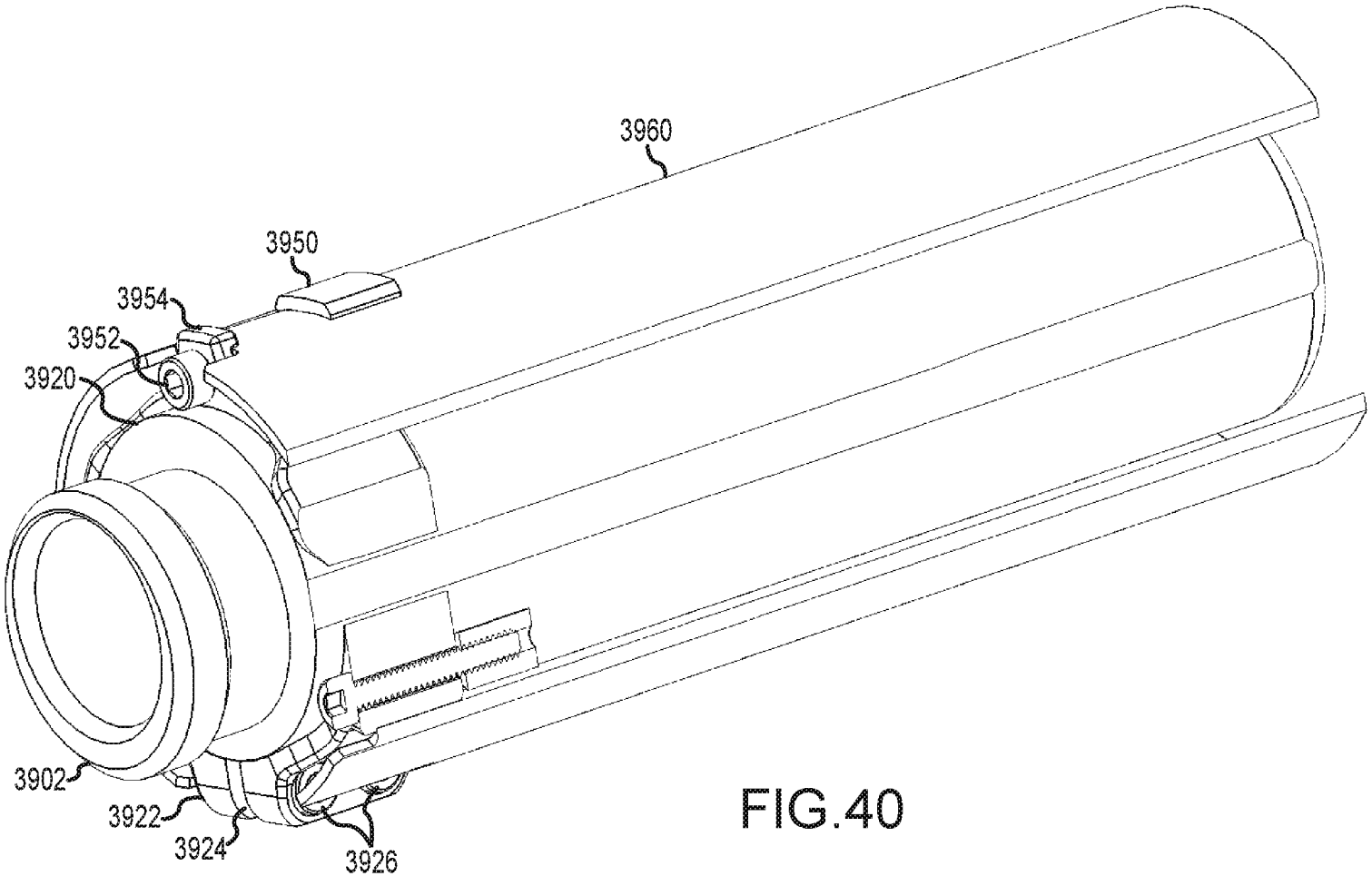
FIG. 40 illustrates a left rear cross section of an isometric view of components of a suppressor cover assembly with the insulating cover assembly hidden, according to some embodiments.
Figure 41:
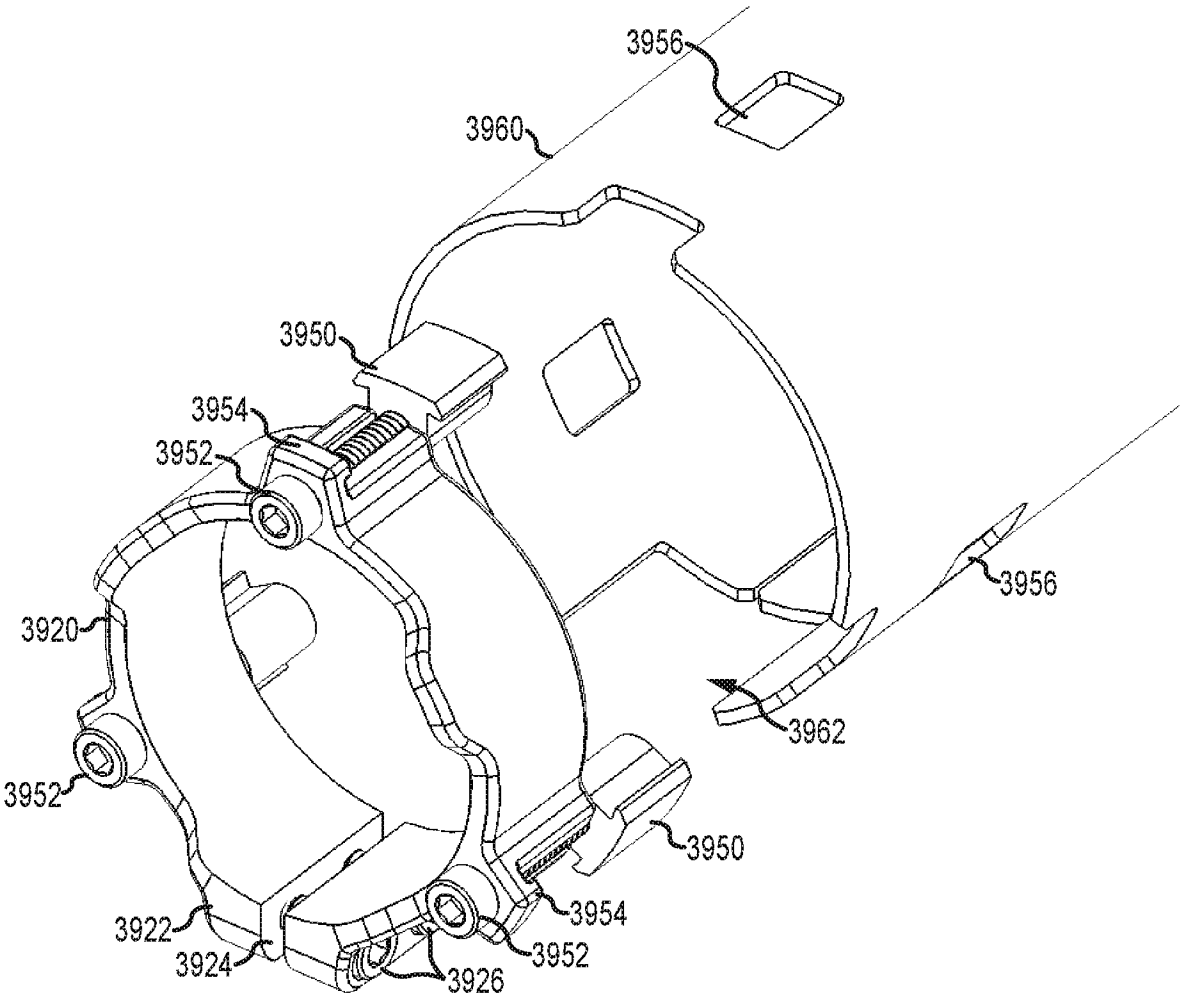
FIG. 41 illustrates an exploded left rear isometric view of components of a suppressor cover assembly with the insulating cover assembly hidden, according to some embodiments.
Figure 42:
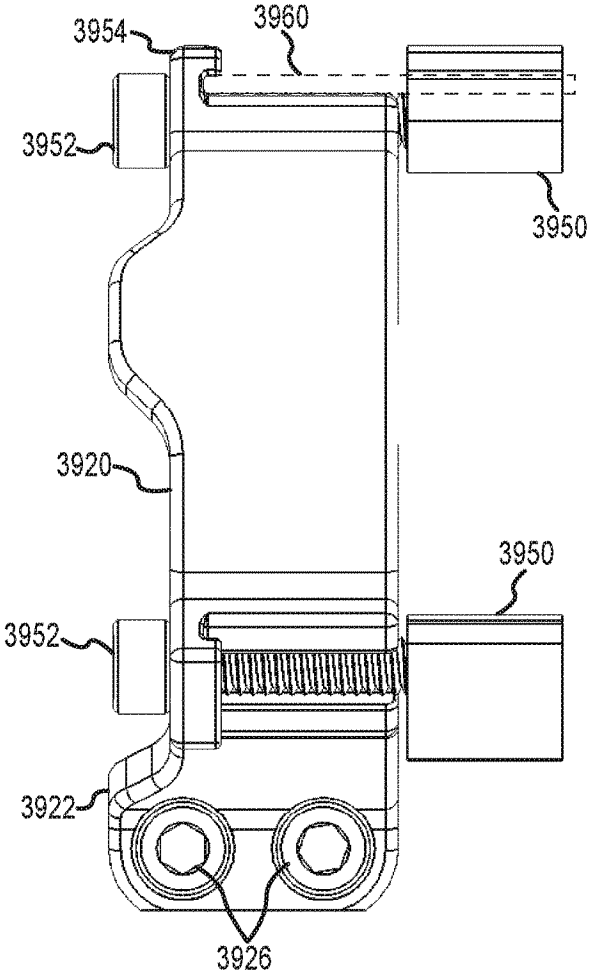
FIG. 42 illustrates a side view of a clamp of a suppressor cover assembly according to some embodiments.
Figure 43:
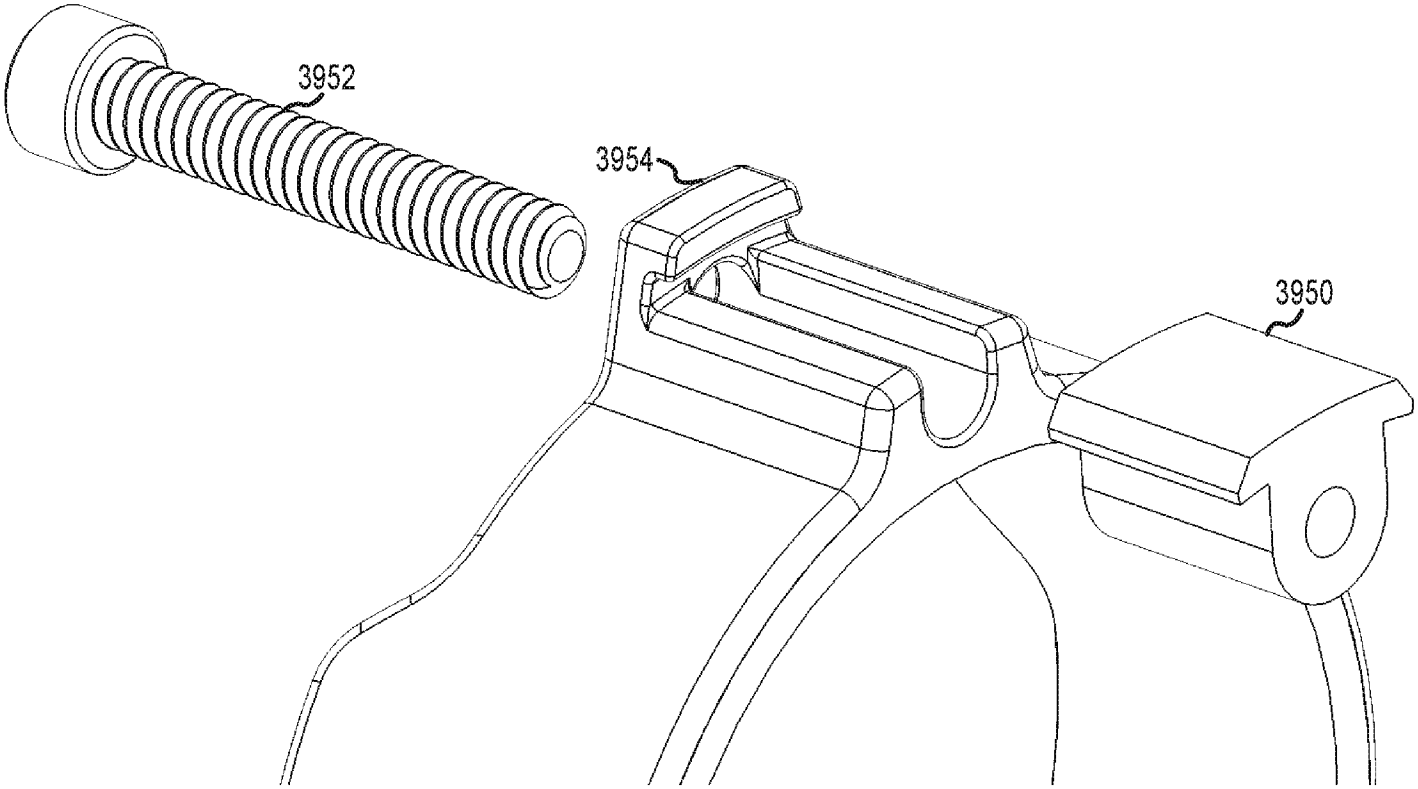
FIG. 43 illustrates an exploded isometric view of a clamp of a suppressor cover assembly according to some embodiments.

To inhibit a thermal path from the suppressor 3102 to an outer surface 3122 of the insulating cover assembly 3106, the number of clamps 3104 may be limited (e.g., three or fewer), and each of these clamps 3104 may have a longitudinal dimension that is less than a radius of the suppressor 3102, such that even a combined longitudinal dimension of three clamps 3104 is less than a length of the cover assembly 3100. In some embodiments, a single clamp 3104 can be used. At least one of the three or fewer clamps 3104 can be arranged near a rear of the cover assembly 3100, distal from a muzzle of the firearm (e.g., see FIG. 40). This is because thermal energy tends toward the muzzle, and therefore a coolest part of the suppressor 3102 is toward a rear of the suppressor 3102, distal from the muzzle. Thus, thermal energy that is to pass through a clamp 3104 near a rear of the cover assembly 3100 must pass along the length of the suppressor 3102 before reaching the clamp 3104 and being able to conductively move radially toward an outer surface 3122 of the cover assembly 3100. In other words, by arranging the clamps 3104 to a rear of the cover assembly 3100, a rate of thermal energy passing from the suppressor 3102 to an outer surface 3122 of the insulating cover assembly 3106, where user contact can occur, is reduced.

Some embodiments include a rigid support 3112 comprising a thermally conductive material such that thermal energy tends to move radially through the standoffs 3108 to the rigid support 3112, and then move longitudinally through the rigid support 3112 until dissipating into cooler air at the ends of the cover assembly 3100. Further, the standoffs 3108 can have a narrow cross section relative to thermal energy traveling between the clamps 3104 and the insulating cover assembly 3106, such that conduction through the standoffs 3108 is discouraged, and that thermal energy that does reach the rigid support 3112 can be conducted toward ends of the cover assembly 3100 and expelled into the air at the ends of the cover assembly 3100. In this way, thermal energy reaching the outer surface 3122 of the insulating cover assembly 3106 is reduced.

The standoffs 3108 are configured to separate the suppressor 3102 from the insulating cover assembly 3106. The standoffs 3108 can be coupled to the clamps 3104 and can be in contact with the insulating cover assembly 3106 to separate the suppressor 3102 from the insulating cover assembly 3106 and to form and maintain an air gap 3114. In some embodiments, the standoffs 3108 can be coupled to or merely in contact with: (1) the clamps 3104, the insulating cover assembly 3106, or both. The standoffs 3108 can have a length (measured along a longitudinal axis of the cover assembly 3100 extending therebetween and coextensive with or parallel to a longitudinal axis of the suppressor 3102 and/or a barrel of a firearm) that is less than a length of the cover assembly 3100. In some embodiments, the standoffs 3108 can have a length that is less than half a length of the cover assembly 3100. In some embodiments, the standoffs 3108 can have a length that is less than a third a length of the cover assembly 3100. In some embodiments, the standoffs 3108 can have a length that is less than a quarter a length of the cover assembly 3100.

In some embodiments the standoffs 3108 are arranged to enhance circular movement of air in the air gap 3114. This can include spacing adjacent standoffs 3108 in a circular dimension such that at least a 60° spacing exists between adjacent standoffs 3108. In some embodiments, at least a 30° spacing between adjacent standoffs 3108 is used. In other embodiments, at least a 90° spacing between adjacent standoffs 3108 is used. In some embodiments no more than nine standoffs 3108 are used. In some embodiments no more than three standoffs 3108 are used. In an embodiment, three standoffs 3108 per clamp 3104 are used, regardless of the number of clamps 3104, where each standoff 3108 is circularly separated from the other two standoffs 3108 by around 120° (e.g., see FIG. 31). Circular spacing between standoffs 3108 can be even, while in some embodiments this spacing need not be even. The circular dimension can refer to the circumference of a circle that is centered around the longitudinal axis of the cover assembly 3100.

In some embodiments, the standoffs 3108 can also be shaped to reduce conductive thermal transfer through them. In other words, they are designed to minimize a rate of thermal energy transfer from a first 3116 end to a second end 3118 (although the second end 3118 may extend partially into or wholly through the insulating cover assembly 3106. Along these lines, in some embodiments the standoffs 3108 can have a length and width that are shorter than a radial dimension of the standoff 3108. In other words, the circular and longitudinal dimensions can each be smaller than a radial dimension (e.g., the distance measured along a standoff 3108 between a clamp 3104 and the insulating cover assembly 3106). In some embodiments, the standoffs 3108 can include one or more interruptions along the radial dimension that impede conductive thermal transfer (e.g., slits, cuts, or gaps possibly filled with glue or another insulating material). The edges of the standoffs 3108 that are exposed to the air gap 3114 may also include ridges, texture, perturbations, and other imperfections in a linear edge that may inhibit conductive thermal transfer in a radial direction.

In some embodiments, the standoffs 3108 have an angled shape (e.g., from a front of the cover assembly 3100 toward a rear of the cover assembly 3100). In some embodiments, the standoffs 3108 have a curved shape or trace a tortuous path.

While some prior art systems allow some longitudinal convection via ribs of narrow longitudinal air pathways, the design of the herein disclosed standoffs 3108 allow circular as well as longitudinal movement of air (i.e., convection). Thus, the standoffs 3108 provide improved convection and movement of thermal energy to an outside of the cover assembly 3100 than seen in the art, without transferring this thermal energy to a user or to materials in the insulating cover assembly 3106. Said another way, various designs were tested wherein longitudinal ribs or other means were used to space the suppressor 3102 from the insulating cover assembly 3106, and most led to excessive heat at an outer surface 3122 of the insulating cover assembly 3106 or led to degradation of the material(s) in the insulating cover assembly 3106. When standoffs 3108 were used that allowed both longitudinal and significant circular movement of air in the air gap 3114, temperatures at the outer surface 3122 of the insulating cover 3110 become acceptable.

FIG. 31 illustrates a thermal path 3120 that extends radially from the outer surface of the suppressor 3102 to an outer surface 3122 of the insulating cover assembly 3106. This path 3120 may be a single straight line as shown, but in practice typically includes one or more different paths having different rates of thermal transfer and being other than straight. For instance, thermal energy may pass circularly around a one of the clamps 3104 before finding a radial path outward through a standoff 3108, and then radially through the insulating cover assembly 3106. This may describe a conductive aspect of the thermal path 3120, but thermal energy is also passing via convection through the air gap 3114 and then conductively through the insulating cover assembly 3106. Thus, the thermal path 3120 often includes multiple sub paths each including different methods of thermal transfer (e.g., conductive, radiative, convective).

In some embodiments, to reduce thermal transfer to the outer surface 3122 of the insulating cover assembly 3106, the thermal path 3120 can include a number of thermal breaks; that is locations where thermal energy must pass from one type of thermal transfer to another (e.g., an air gap forces thermal energy traveling via conduction to then transfer via convection). Typically, interruptions that require thermal energy to pass through convective regions are more effective at reducing thermal transfer than interruptions where conductive means constitute the gap. For instance, a convective gap along an otherwise conductive thermal path can reduce the rate of thermal energy transfer. In some embodiments, the standoffs 3108 can include one or more convective interruptions. In some embodiments, the insulating cover assembly 3106 can include one or more convective interruptions (e.g., between the rigid support 3112 and the insulating cover 3110). In some embodiments, the standoffs 3108 can be physically separate components from the clamps 3104 such that a convective interruption exists between these components. Further, if a friction fit or other mechanical coupling between the standoffs 3108 and the clamps 3104 can be arranged, then thermal transfer will be more deterred than if a welded connection is made. In other words, some embodiments utilize a non-welded connection between the standoffs 3108 and the clamps 3104.

In some embodiments, the interface of the clamps 3104 to the suppressor 3102 can be shaped to reduce the rate of thermal transfer. For instance, rather than a smooth curved surface that maximizes surface contact between the clamps 3104 and the suppressor 3102, the inside surface of the clamps 3104 can be textured, ridged, or dimpled to name a few non-limiting examples.

In some embodiments the clamps 3104 can include texture, ridges, or heat fins extending radially outward from the clamps 3104, but not extending far enough to bridge the air gap 3114 and reach the insulating cover assembly 3106. In other words, these features can be used to increase a surface area of the clamps 3104 exposed to air in the air gap 3114, while not forming conductive thermal pathways to the insulating cover assembly 3106. In this way, increased thermal energy can be expelled convectively and radiantly into the air gap 3114 and moved out of the cover assembly 3100 via convection, thereby reducing the amount of thermal energy that passes radially through the standoffs 3108 and reaches the insulating cover assembly 3106.

Figure 46:
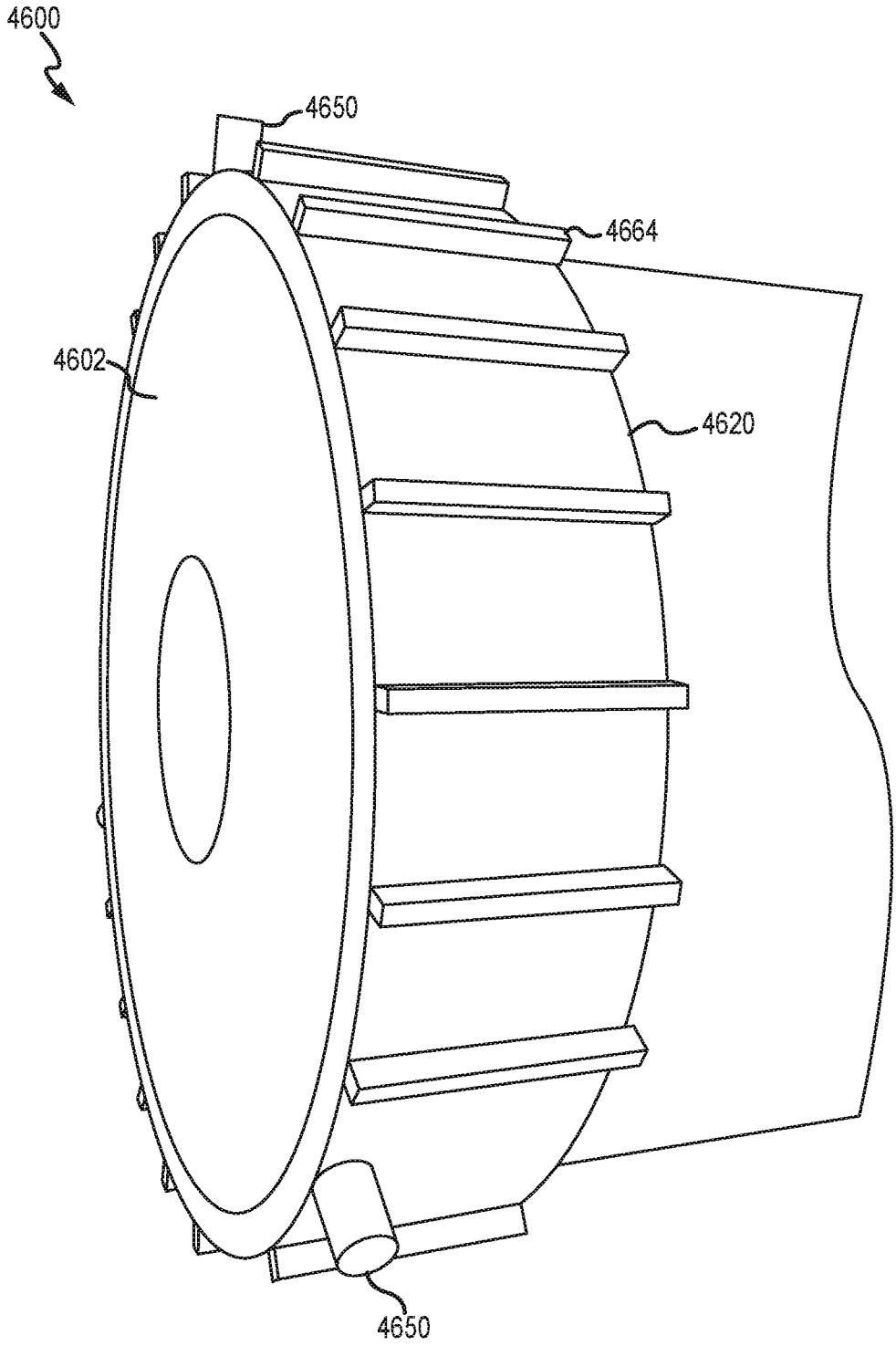
FIG. 46 illustrates an embodiment of components a suppressor cover assembly where heat fins of a clamp enhance dissipation of thermal energy into the air gap.

FIG. 46 illustrates an example of a clamp having heat fins as well as standoffs. The illustrated embodiment shows a clamp 4620 releasably attached to a suppressor 4602, but with an optional heat shield and insulating cover assembly not shown. Here, the clamp 4620 includes heat fins 4664, ridges, texture, dimples, or other structure on an outside surface of the clamp 4620 that increases a surface area of the clamp 4620 thereby enhancing thermal discharge into the air gap through convection and radiation. This also reduces an amount of thermal energy that passes through the standoffs 4650 to the insulating cover assembly (not illustrated).

Figure 47:
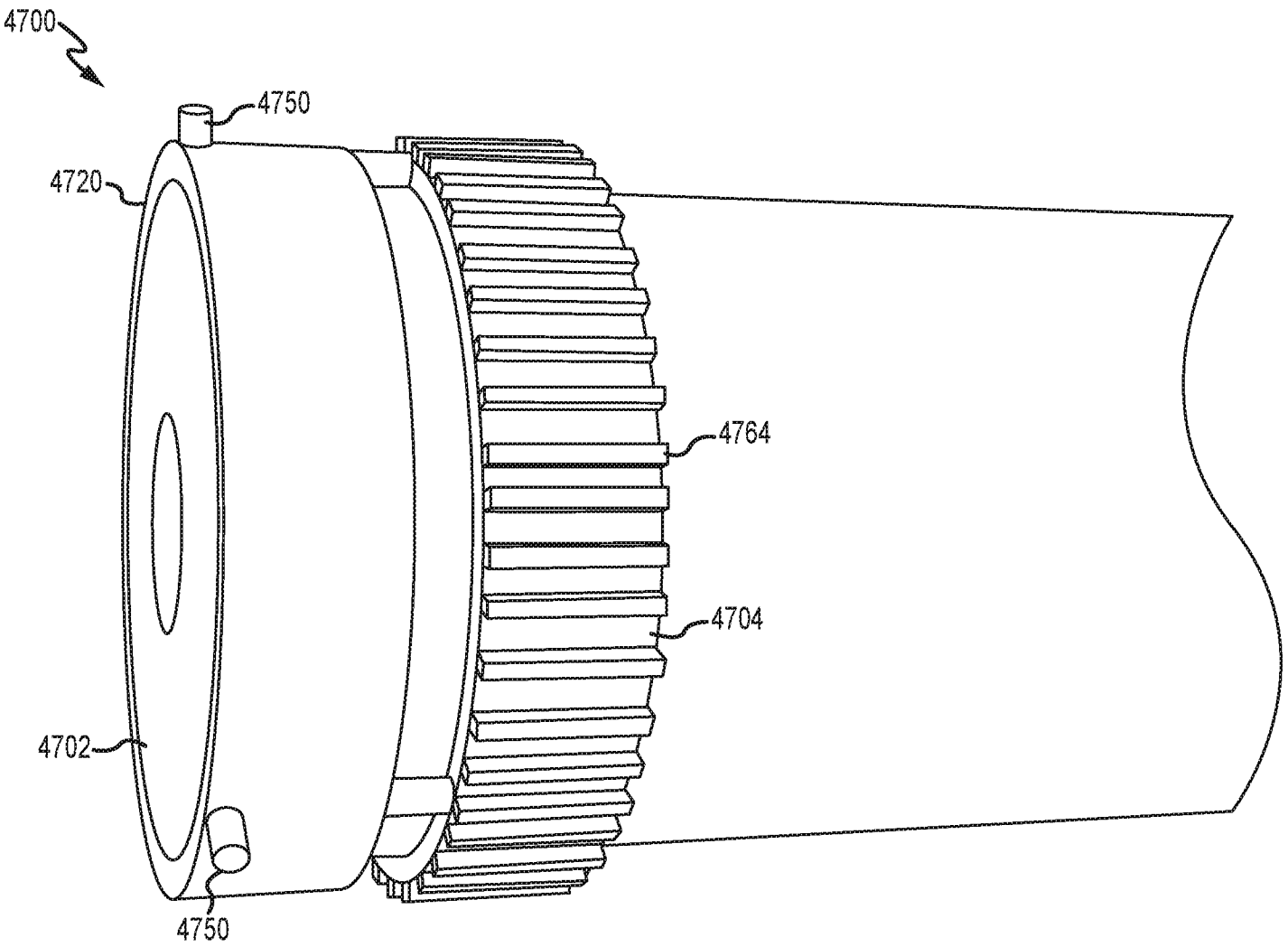
FIG. 47 illustrates another example of a cover assembly that attempts to increase expulsion of thermal energy via convection into the air gap.

FIG. 47 illustrates another example of a cover assembly that attempts to increase expulsion of thermal energy via convection into the air gap. In some embodiments the cover assembly 4700 can include one or more clamps that do not include standoffs 4750 or any other feature that bridges an air gap between the suppressor 4702 and an insulating cover assembly (not illustrated). Instead, one or more secondary clamps 4704 can be configured to contact the suppressor 4702 and contact one or more primary clamps 4720 (clamps having standoffs 4750 coupling the primary clamps 4720 to the insulating cover assembly (not illustrated)). The one or more secondary clamps 4704 can include heat fins 4764, texture, ridges, or other means of increasing a surface area of the secondary clamps 4704. The increased surface area increases a rate of thermal expulsion into the air gap. In other words, the secondary clamps 4704 effectively increase a surface area of the suppressor 4702 and increases a rate of convectively/radiantly expelled thermal energy. These one or more secondary clamps 4704 can have different shapes than the primary clamps 4720 and need not totally encircle the suppressor 4702. However, in the illustrated embodiment, the primary and secondary clamps 4720, 4704 have similar shapes.

FIGS. 32-38 illustrate various views of another embodiment of a suppressor cover assembly. The cover assembly 3200 is coupled to a suppressor 3202, and includes an insulating cover assembly 3210, one or more clamps 3220, and a plurality of standoffs (not visible). The insulating cover assembly 3200 can comprise a single layer, as illustrated, where the single layer comprises a rigid material or rigid skeleton, such that the insulating cover assembly 3200 maintains its generally cylindrical shape. Alternatively, the insulating cover assembly 3200 can include multiple layers, where one or more layers are rigid and one or more layers are not rigid (e.g., see FIGS. 31 and 39-43). The cover assembly 3200 can clamp or affix to the suppressor 3202 at one or more points or regions. For instance, in the illustrated embodiment, the cover assembly 3200 includes two clamps 3220, one proximal to a front end 3206 (closest to an exit aperture of the suppressor 3202) of the cover assembly 3200 and a second proximal to a rear end 3204 of the cover assembly 3200 (closest to an entry aperture of the suppressor 3202). The clamps 3220 can have generally cylindrical shapes and contact the suppressor 3202 via inside surfaces of these clamps 3220. In some embodiments, more than two clamps 3220 can be used, and in some embodiments, a single clamp 3220 can be used (e.g., see FIGS. 39-43). The clamps 3220 can be shaped to surround and affix to any shape of suppressor 3202. For instance, where the suppressor 3202 is non-cylindrical, the clamps 3220 can be correspondingly shaped.

Insulating Cover Assembly 3210

The insulating cover assembly 3210 can include multiple sub-components locked or coupled together. For instance, in the illustrated embodiment, the insulating cover assembly 3210 comprises a first insulating cover portion 3212, a second insulating cover portion 3214, and a third insulating cover portion 3216. In other embodiments, fewer than three or more than three portions may comprise the insulating cover assembly 3210. Although the insulating cover assembly 3210 is generally cylindrical, it may also include one or more indentations 3217 or other features that may enhance grip, comfort, thermal dissipation, direct thermal energy toward desired portions of the insulating cover assembly 3210, etc.

Where the insulating cover assembly 3210 comprises two or more separable portions (e.g., 3212, 3214, 3216), one or more clips 3242 can flexibly and removably couple adjacent portions together. For instance, in the illustrated embodiment, each of the three separable portions 3212, 3214, and 3216 includes four clips 3242 and four clip receiving portions 3244. The clips 3242 can be elongated and have a material and/or thickness enabling them to flex more readily than other portions of the insulating cover assembly 3210. The receiving portions 3244 can be shaped so as to receive the clips 3242 and lock them in place such that the separable portions 3212, 3214, 3216 of the insulating cover assembly 3210 remain removably connected. The tabs 3242 are illustrated as having an interlocking shape, although other shapes and arrangements can also be utilized.

The use of multiple portions for the insulating cover assembly 3210 may make ease removal of the insulating cover assembly 3210 since the multiple pieces can be separated and then removed. In some cases, the one or more clamps 3220 may not be accessible, or may be more easily accessible once the insulating cover assembly 3210, or at least one or more portions thereof, are removed. For instance, in the illustrated embodiment, the clamps 3220 are encircled by the insulating cover assembly 3210 and thus difficult to remove while the insulating cover assembly 3210 is in place. However, the illustrated insulating cover assembly 3210 is designed to allow for removal from the suppressor 3202 without removing the insulating cover assembly 3210. In particular, the illustrated clamp 3220 includes a flange 3222 having a slot 3224 and fastener 3226 passing through the flange 3222 perpendicular to a longitudinal axis 3213 of the cover assembly 3200. The slot 3224 enables the clamp 3220 to flexibly expand and contract such that tightening of the fastener 3226 (e.g., via rotation of a screwdriver, Allen wrench, or other tool) causes the clamp 3220 to tighten upon and become increasingly immovable relative to the suppressor 3202. Fastener apertures 3228 pass through the insulating cover assembly 3210 in a direction generally parallel with a longitudinal axis of the fasteners 3226 and have a diameter larger than a diameter of the fastener 3226. The fastener apertures 3228 may be greater in number than a number of fasteners 3226 such that the insulating cover assembly 3210 can be arranged in different rotational positions relative to the clamps 3220 while still aligning at least one of the fastener apertures 3228 with the fastener 3226 of the one or more clamps 3220. For instance, in the illustrated embodiment there is one fastener 3226 per clamp 3220, while there are three fastener apertures 3228 per clamp 3220 (i.e., not all of the fastener apertures 3228 may be used). A second set of fastener apertures 3228 can be seen at a second end or rear end 3204 of the cover assembly 3110 and at least one of these aligns with a fastener of a second clamp (not visible).

The insulating cover assembly 3210 also may include motion restriction apertures 3218 sized and arranged to accept at least a portion of standoff caps 3240. This interfacing prevents movement of the insulating cover assembly 3210 relative to the suppressor 3202 and the clamps 3220. The illustrated embodiment includes six motion restriction apertures 3218 corresponding to the six standoff caps 3240, three per clamp 3220. Each standoff cap 3240 is in contact with and can be fixed or removably attached to a standoff 3250, for instance in a male-female relationship. The standoff 3250 provides an air gap 3254 (see FIG. 34) between the suppressor 3202 and the insulating cover assembly 3210, and the standoff cap 3240 provides a means for attaching each standoff 3250 to the insulating cover assembly 3210. The air gap 3254 can be partially arranged on an inside and outside of the heat shield 3260 where a heat shield 3260 is used. The illustrated standoff caps 3240 have wider diameters than the standoffs 3250. The standoffs 3250 and the standoff caps 3240 can have generally cylindrical shapes, with the standoff caps 3240 having a top-hat shape with an aperture 3258 that accepts a standoff 3250 (see FIG. 38 for the aperture 3258).

The insulating cover assembly 3210 can comprise any insulating material such as polymers, ceramics, textiles, etc. The insulating cover assembly 3210 can also be rigid, thereby not requiring a separate rigid support.

The insulating cover assembly 3210 can include an outer surface 3246 and an inner surface 3248. The cover assembly 3200 can be designed such that the outer surface 3246 does not reach a predetermined temperature, such as 300° F., 1000° F., or 1400° F., to name a few non-limiting examples.

Clamps 3220

The cover assembly 3200 can include one or more clamps 3220, where the illustrated embodiment shows two clamps 3220, a first clamp **3220*a* (see FIG. 33) arranged proximal to a front end 3206 of the cover assembly 3200 and a second clamp 3220*b* arranged proximal to a rear end 3204 of the cover assembly 3200. The clamps 3220 can include a fastener flange 3220 that is separated into two halves by a slot 3224, where this slot 3224 enables a fastener 3226 to expand or collapse the size of the slot 3224 such that the clamp 3220 can expand or collapse upon the suppressor 3202 and thereby fix or release the cover assembly 3200 from the suppressor 3202**.

The clamps 3220 are generally cylindrical, and have a collar 3221, although other shapes can also be used. In some embodiments, the clamps 3220 can be formed from a material able to withstand direct contact with the suppressor 3202 (e.g., 1000° or 1400° F.).

Use of a single clamp 3220 may be preferable to reduce thermal transfer through the standoffs 3250 to the insulating cover assembly 3210. However, in other embodiments, more than one clamp 3220 may be preferable. In those cases, there may be three or fewer clamps 3220, for instance, two clamps 3220.

Standoffs 3250

Each clamp 3220 includes one or more standoffs 3250, where the illustrated embodiment includes three standoffs 3250 per clamp 3220. A radial dimension of each standoff at least partially determines a radial dimension of the air gap 3254. Standoffs 3250 having a larger radial dimension create a larger air gap 3254, which in turn decreases thermal transfer between the suppressor 3202 and the insulating cover assembly 3210.

A standoff 3250 can have a cylindrical shape having a radius that is minimized in order to minimize a thermal cross section and hence thermal transfer. At the same time, the radius should be sufficiently larger to provide structural rigidity and sufficient strength to avoid structural failure over periods of repeated and long term use.

Figure 32:
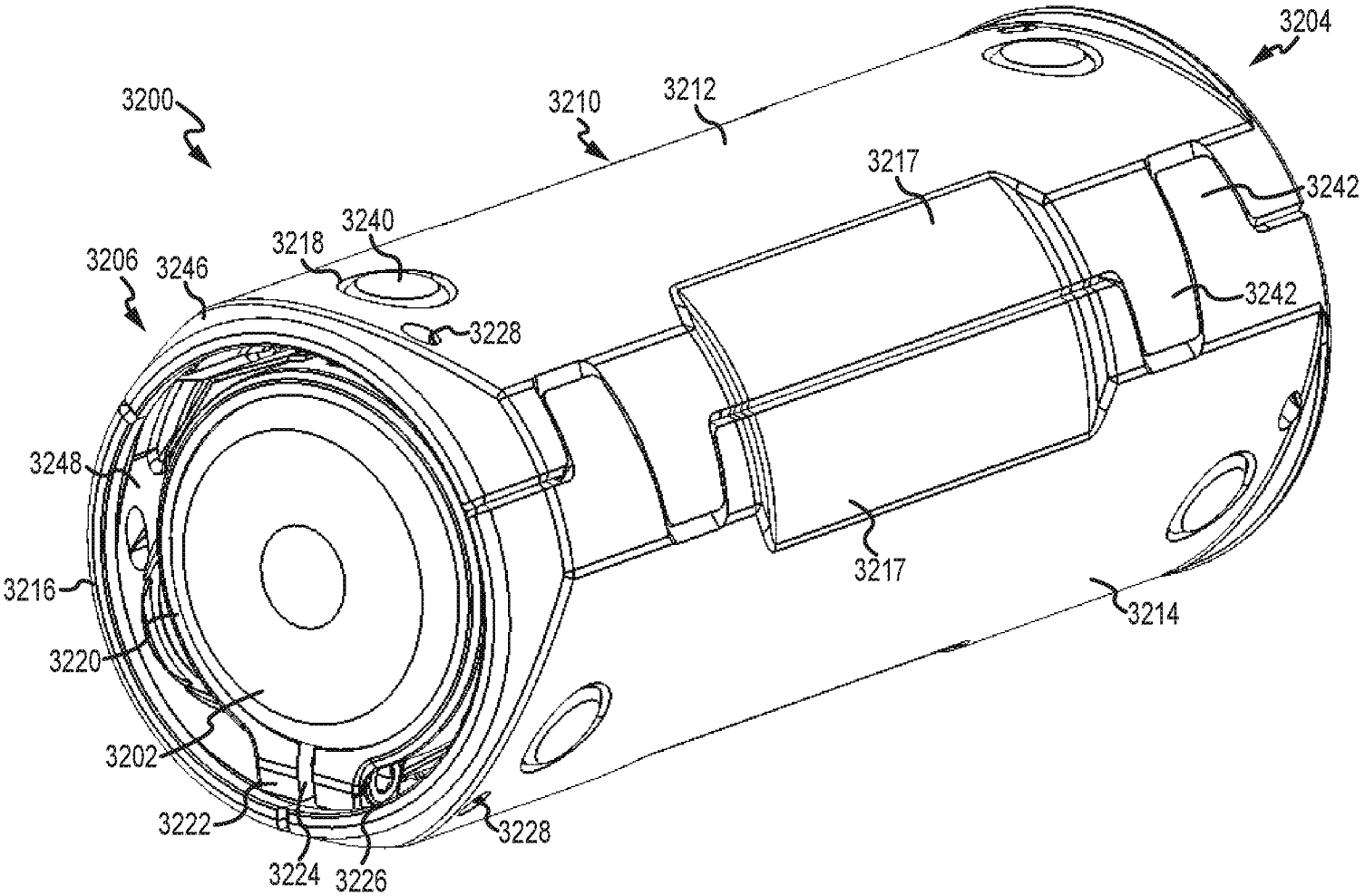
FIG. 32 illustrates a right front isometric view of components of a suppressor cover assembly according to some embodiments.
Figure 33:
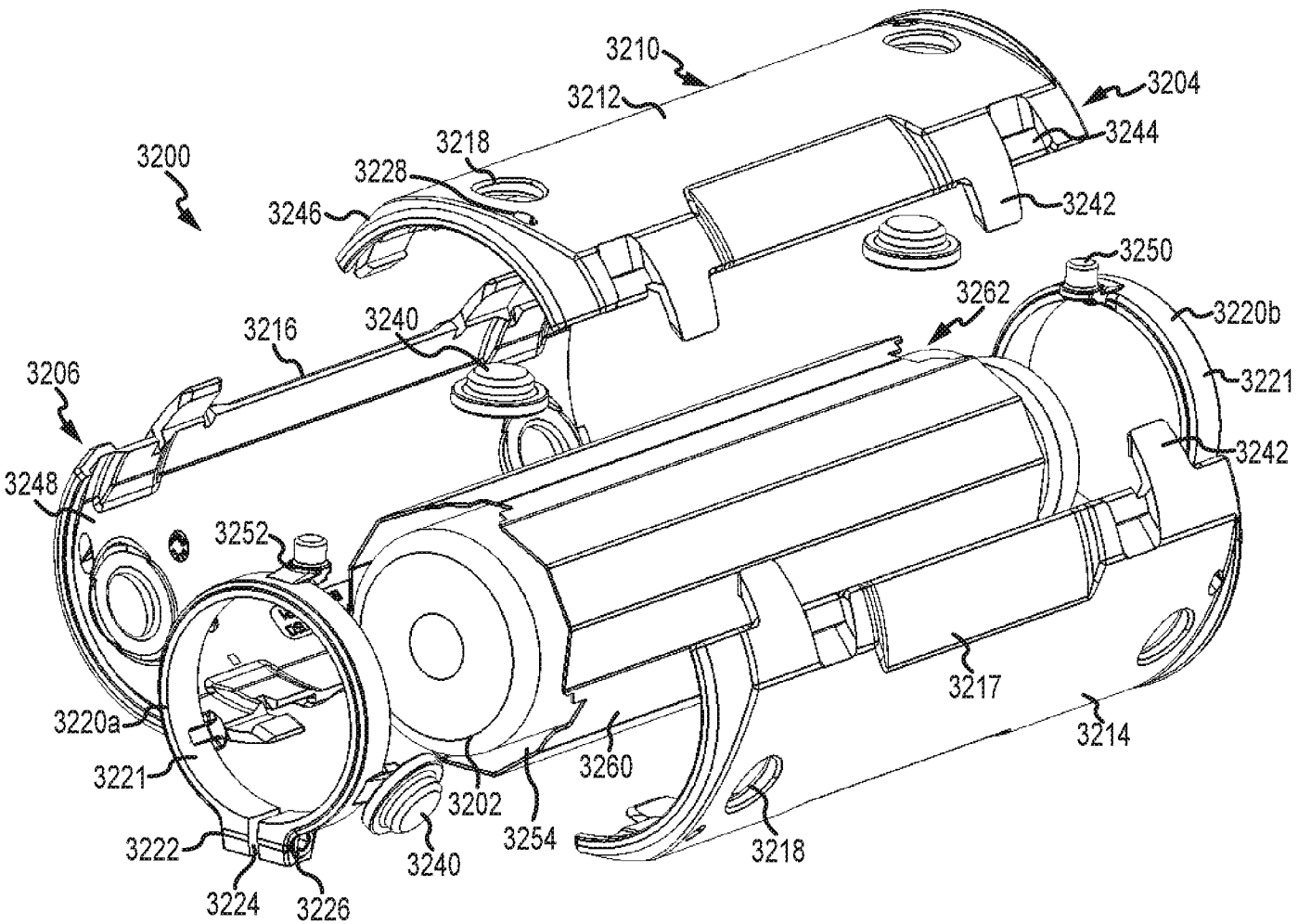
FIG. 33 illustrates a right front exploded isometric view of components of a suppressor cover assembly according to some embodiments
Figure 34:
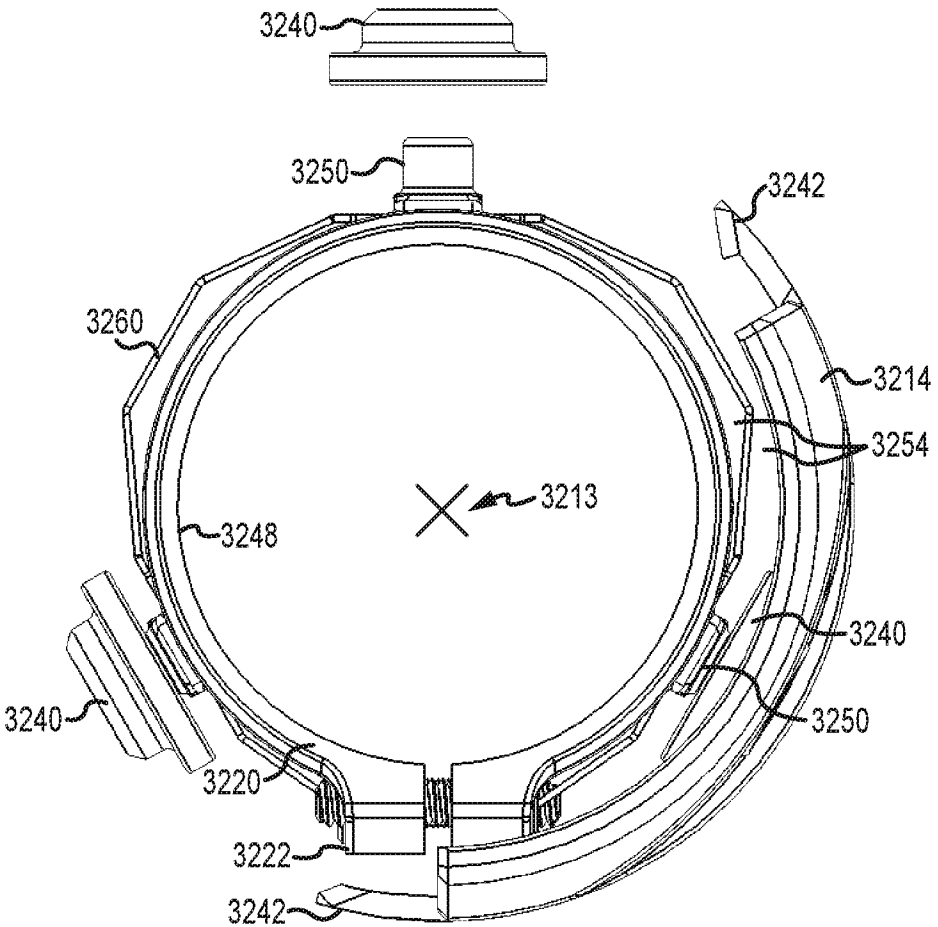
FIG. 34 illustrates a partially exploded front view of components of a suppressor cover assembly according to some embodiments, where parts of an insulating cover assembly are hidden.
Figure 35:
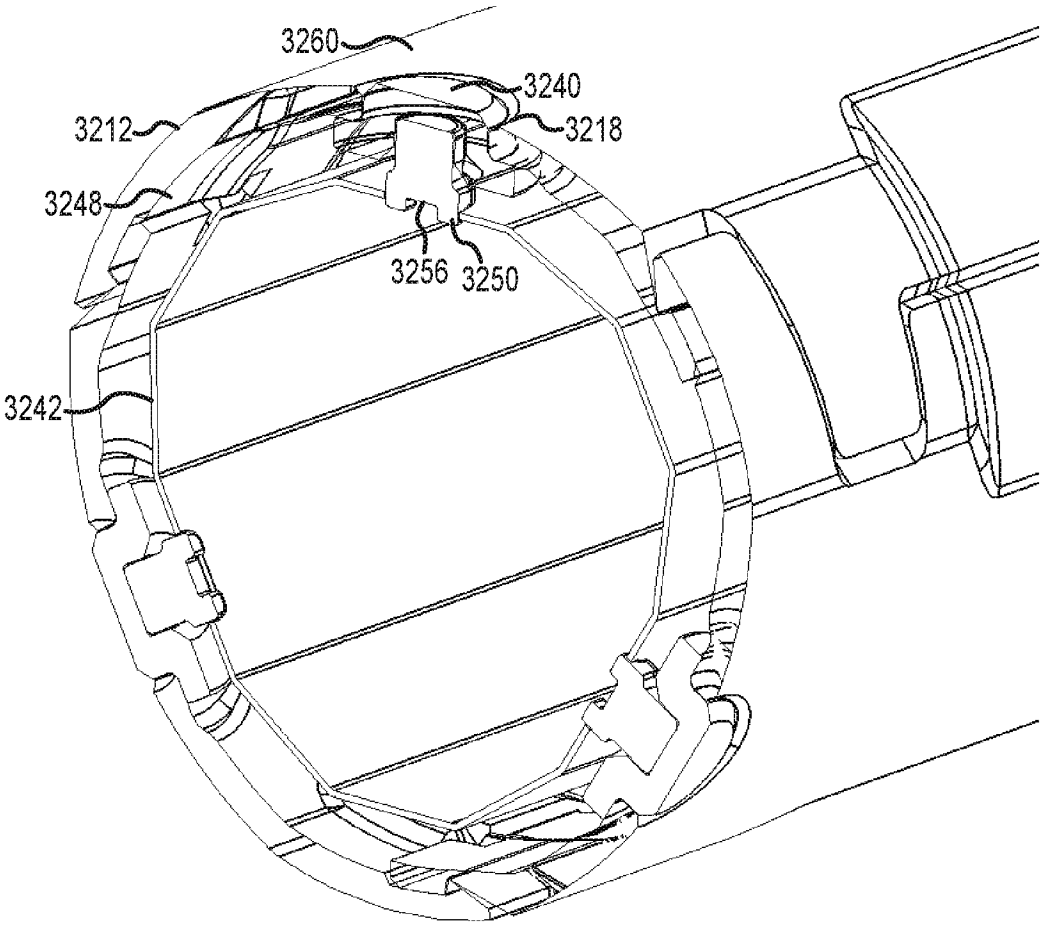
FIG. 35 illustrates a cross section of a right front isometric view of components of a suppressor cover assembly according to some embodiments.
Figure 36:
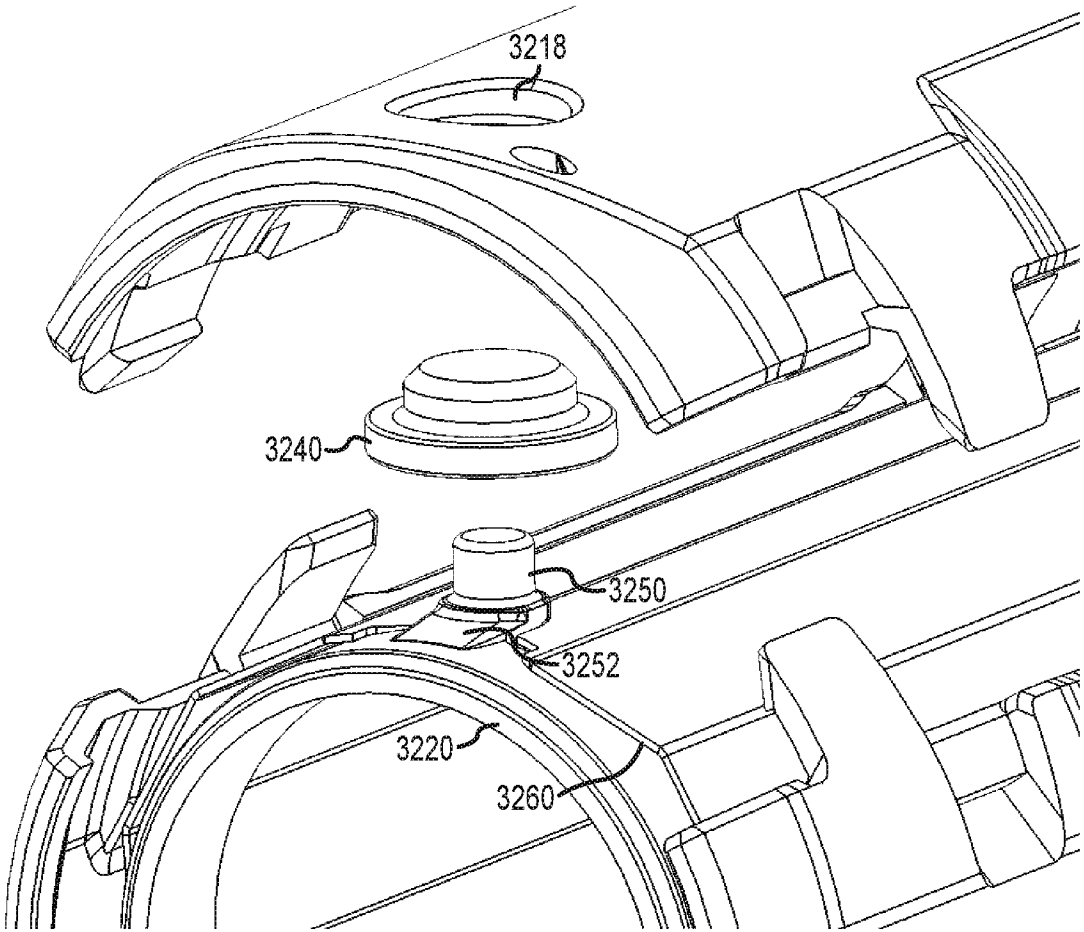
FIG. 36 illustrates a partially exploded right front isometric view of components of a suppressor cover assembly according to some embodiments.
Figure 37:
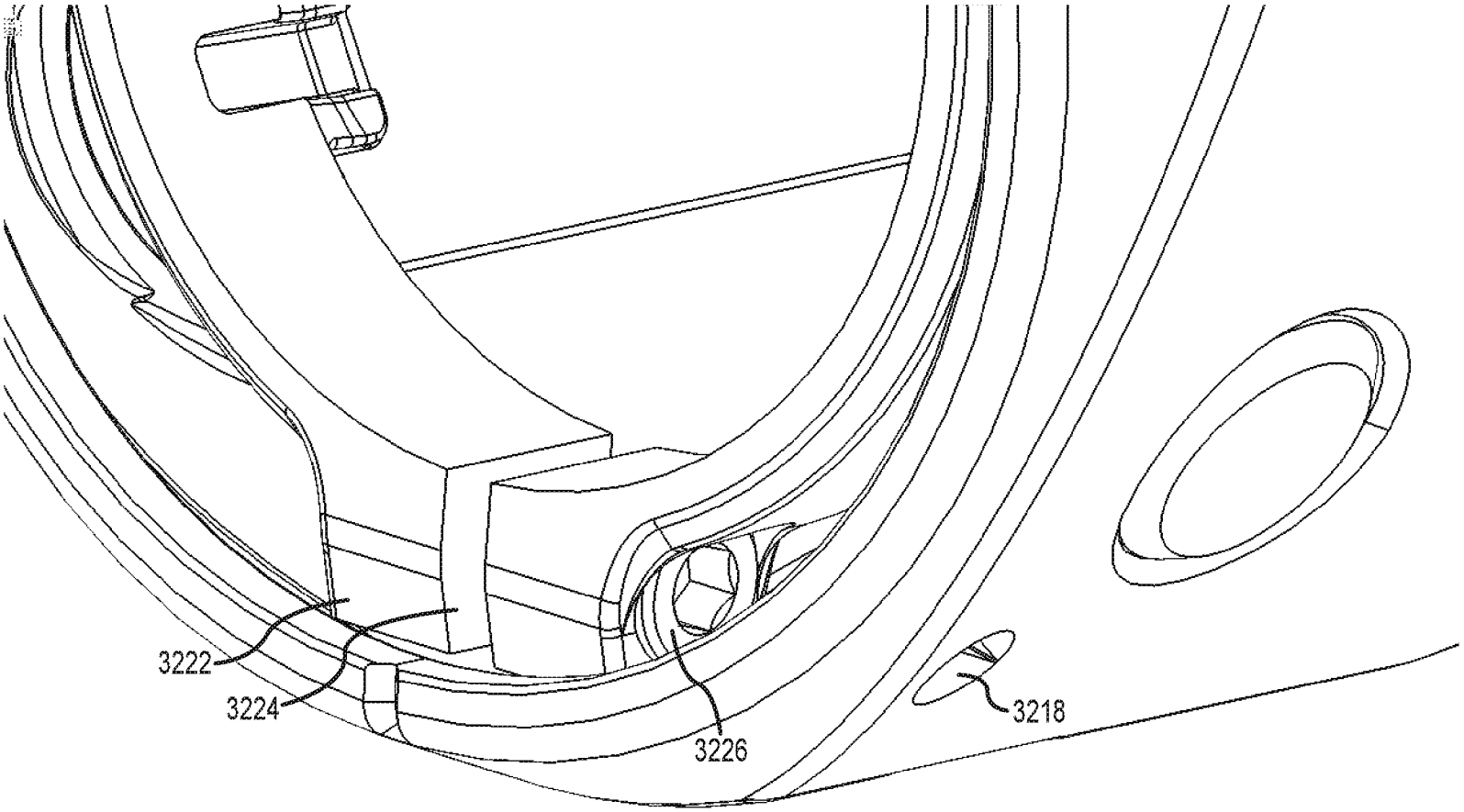
FIG. 37 illustrates a close up of a clamp and insulating cover assembly of a suppressor cover assembly according to some embodiments.
Figure 38:
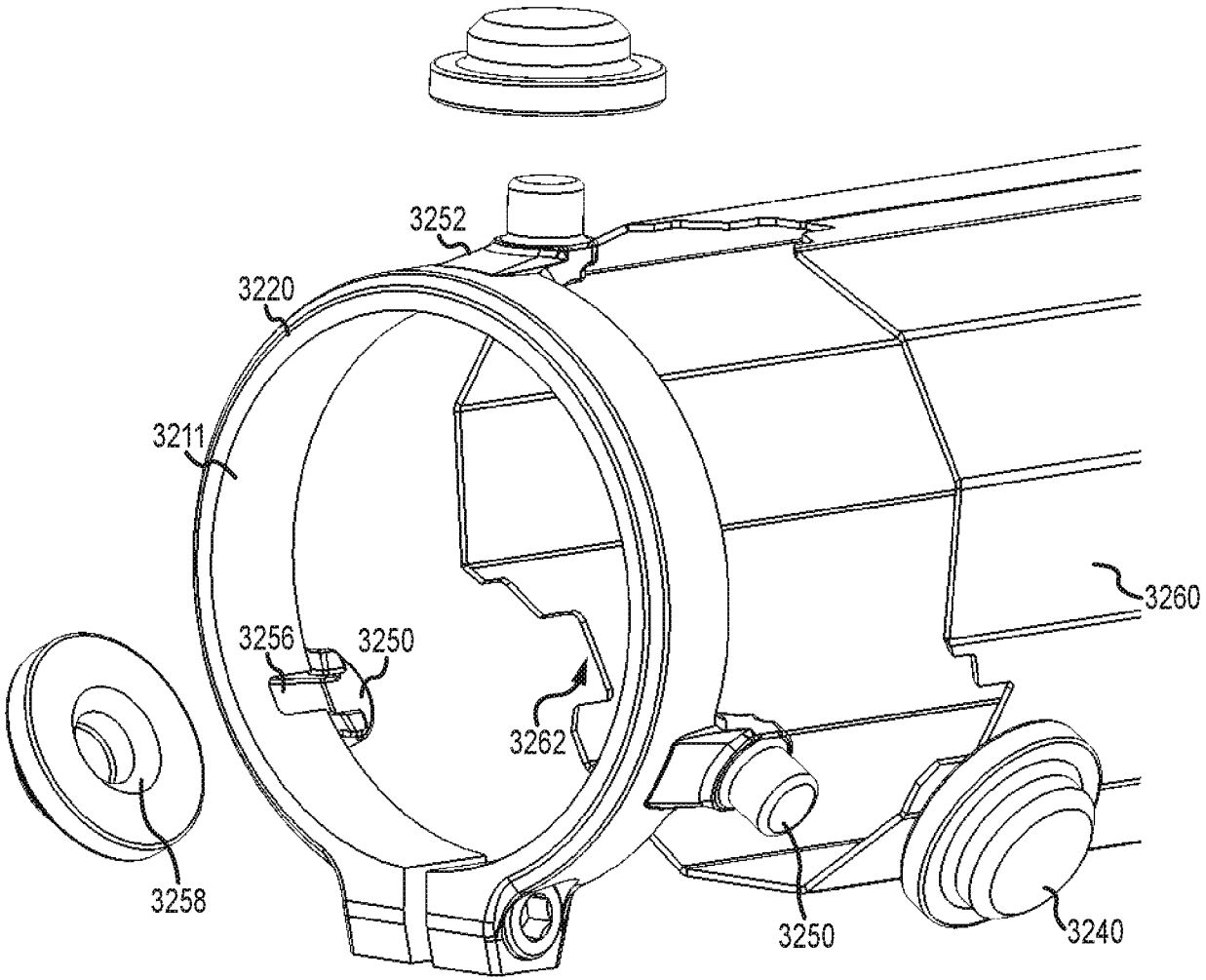
FIG. 38 illustrates a right front exploded isometric view of components of a suppressor cover assembly according to some embodiments.

Each standoff 3250 can be coupled to a corresponding clamp 3220 via a standoff leg 3252. The standoff leg 3252 can have various shapes, but in the illustrated embodiment has a somewhat rectangular cross section, and can be arranged at an angle between the clamp 3220 and the standoff 3250. The standoff leg 3252 can be formed to minimize a thermal cross section, for instance via a groove 3256 as seen in FIGS. 32, 35, and 38. The groove 3256 can be formed in the standoff leg 3252, and can extend into the collar 3221 of the clamp 3220.

The standoffs 3250 may be motion limiters; that is, the standoffs 3250 may limit motion of the heat shield 3260 relative to the clamps 3220. Additionally, the standoff caps 3240 may also be motion limiters; that is, the standoff caps 3240 may limit motion of the optional heat shield 3260 and/or the insulating cover assembly 3210 relative to the clamps 3220.

To encourage convection within the air gap 3254, the standoffs 3250 can be arranged such that longitudinal as well as circular convection is possible. For instance, were the standoffs 3250 extend the full length of the cover assembly 3200 or even a majority of that length, then circular convection in the air gap 3254 would be severely hampered. Therefore, the standoffs 3250 have a length (along a dimension parallel to the longitudinal axis 3213 (see FIG. 32) of the suppressor 3202) that is less than half the length of the cover assembly 3200, or less than a third of the length of the cover assembly 3200, or less than a quarter of the length of the cover assembly 3200, or less than 10% of the length of the cover assembly 3200, or less than 5% of the length of the cover assembly 3200. In another embodiment, the standoffs 3250 have a length that is comparable to their width. For instance, in FIGS. 33, 36, and 38, one sees that the standoffs 3250 have a circular cross section when viewed from a radial direction looking toward a center of the suppressor 3202, and thus the length and width dimensions are equal. Such dimensions of the standoffs 3250 leave an air gap 3254 that extends through most of the space between the suppressor 3202 and an inner surface 3248 of the insulating cover assembly 3210 and can include the heat shield 3260.

To further reduce thermal transfer across the standoffs 3250, a number of standoffs 3250 per clamp 3220 can be minimized. For instance, fewer than 9 standoffs 3250 per clamp 3220 may be used. In some embodiments, 3 or fewer standoffs 3250 per clamp 3220 may be used. In other embodiments, at least 30° of circular separation may exist between adjacent standoffs 3250. In some embodiments, at least 45° of circular separation may exist between adjacent standoffs 3250. In some embodiments, at least 60° of circular separation may exist between adjacent standoffs 3250.

Heat Shield 3260

The optional heat shield 3260 can have a generally cylindrical shape and may have multiple straight edges, thus forming a hexagon, decagon, or other similar shape. For instance, the illustrated heat shield 3260 has a dodecagon cross section. The heat shield 3260 may have a length equal to or slightly less than a length of the suppressor 3202. The heat shield 3260 can include standoff apertures 3262 (e.g., FIG. 33) each corresponding to and shaped to accept passage of a standoff 3250 there through. However, the standoff apertures 3262 may be smaller than a width or diameter of the standoff caps 3240, and thus the standoff caps 3240 help to secure the clamps 3220 to the heat shield 3260. In the illustrated embodiment there are six standoff apertures 3262. The standoff apertures 3262 can be arranged in ends of the heat shield 3260.

The standoffs 3250 and the heat shield 3260 may be in thermal contact such that thermal energy transferred into the clamps 3220 from the suppressor 3202 can be distributed through the much greater surface area of the heat shield 3260 and enable greater exposure to the air gap 3254. The standoff caps 3240 may also be in contact with the heat shield 3260.

The heat shield 3260 may be designed to reflect radiative thermal energy radiating from the suppressor 3202. This helps to reduce the radiative thermal energy reaching the insulating cover assembly 3210.

In addition to the heat shield 3260, or in lieu of the heat shield 3260, the insulating cover assembly 3210 may include a thermally reflective liner on the inner surface 3248 that is configured to reflect radiative thermal energy from the suppressor 3202. For instance, aluminum or other metal foil can be adhered to an inner surface 3248 of the insulating cover assembly 3210. Alternatively, a layer of metal paint or other metallic spray can be applied to the inner surface 3248 of the insulating cover assembly 3210.

Figure 39:
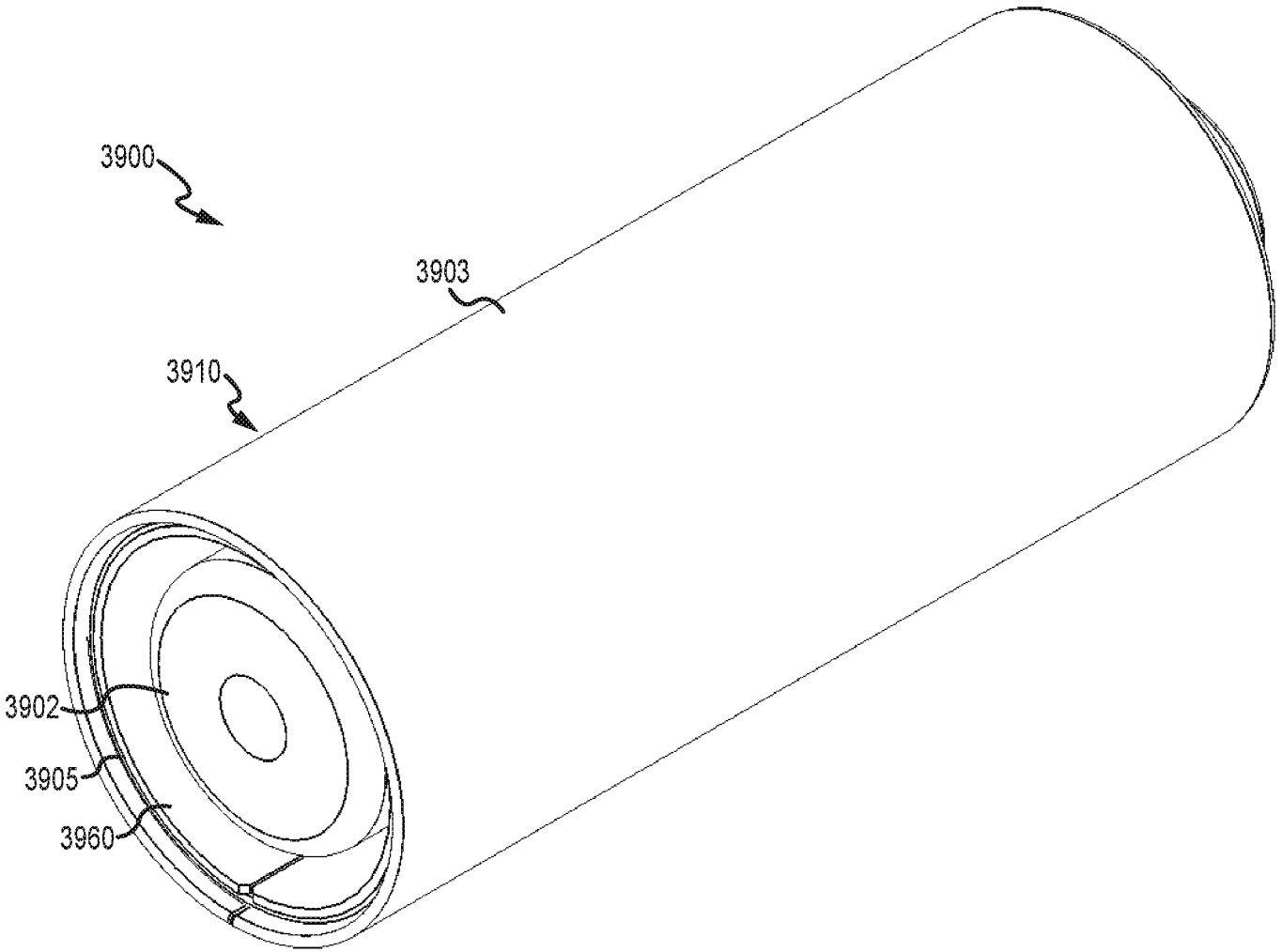
FIG. 39 illustrates a right front isometric view of components of a suppressor cover assembly according to some embodiments.

Turning now to FIG. 39, another embodiment of a cover assembly 3900 is illustrated. The cover assembly 3900 is configured for releasable coupling to a suppressor 3902, and includes an insulating cover assembly 3910, one or more clamps 3920, and a plurality of standoffs 3950. The one or more clamps 3920 can have generally cylindrical shapes and contact the suppressor 3902 via inside surfaces of these clamps 3920. The illustrated insulating cover assembly 3910 includes one clamp arranged near a rear of the cover assembly 3900. Since the rear of a suppressor tends to be cooler than a front of a suppressor, avoiding a clamp 3920 in a front of the cover assembly 3900 reduces a rate of transfer of thermal energy from the suppressor 3902 to the insulating cover assembly 3910. In other words, thermal energy at the hottest end of the suppressor 3902 must conduct (or radiate) to the rear of the suppressor 3902 before being able to conduct through the clamp 3920 to the insulating cover assembly 3910.

The illustrated insulating cover assembly 3910 includes two layers—a rigid layer 3905 and a non-rigid layer 3903 that are arranged outside of the heat shield 3960. The rigid layer 3905 can be in contact with the non-rigid layer 3903 and support and shape the non-rigid layer 3905 to maintain the generally cylindrical shape of the insulating cover assembly 3910.

The clamp 3920 can include a fastener flange 3922, a slot 3924 in the fastener flange 3922, and a first pair of fasteners 3926 that can be used to increase or decrease a size of the slot 3924 such that the clamp 3920 expands or contracts upon the suppressor 3902 and thereby releases or fixes the cover assembly 3900 to the suppressor 3902.

In this embodiment, there are three standoffs 3950 each attached to the clamp 3920 via second fasteners 3952 that pass through extensions 3954 of the clamp 3920. Each standoff 3950 has a T-shape where a top-horizontal portion of the T-shape rests outside the heat shield 3960 (see FIG. 40). Each standoff 3950 can pass through a standoff aperture 3956 in the heat shield 3960. The heat shield 3960 can also include a flange aperture 3962 shaped to allow the fastener flange 3922 to extend below an outer circumference of the heat shield 3960.

Figure 44:
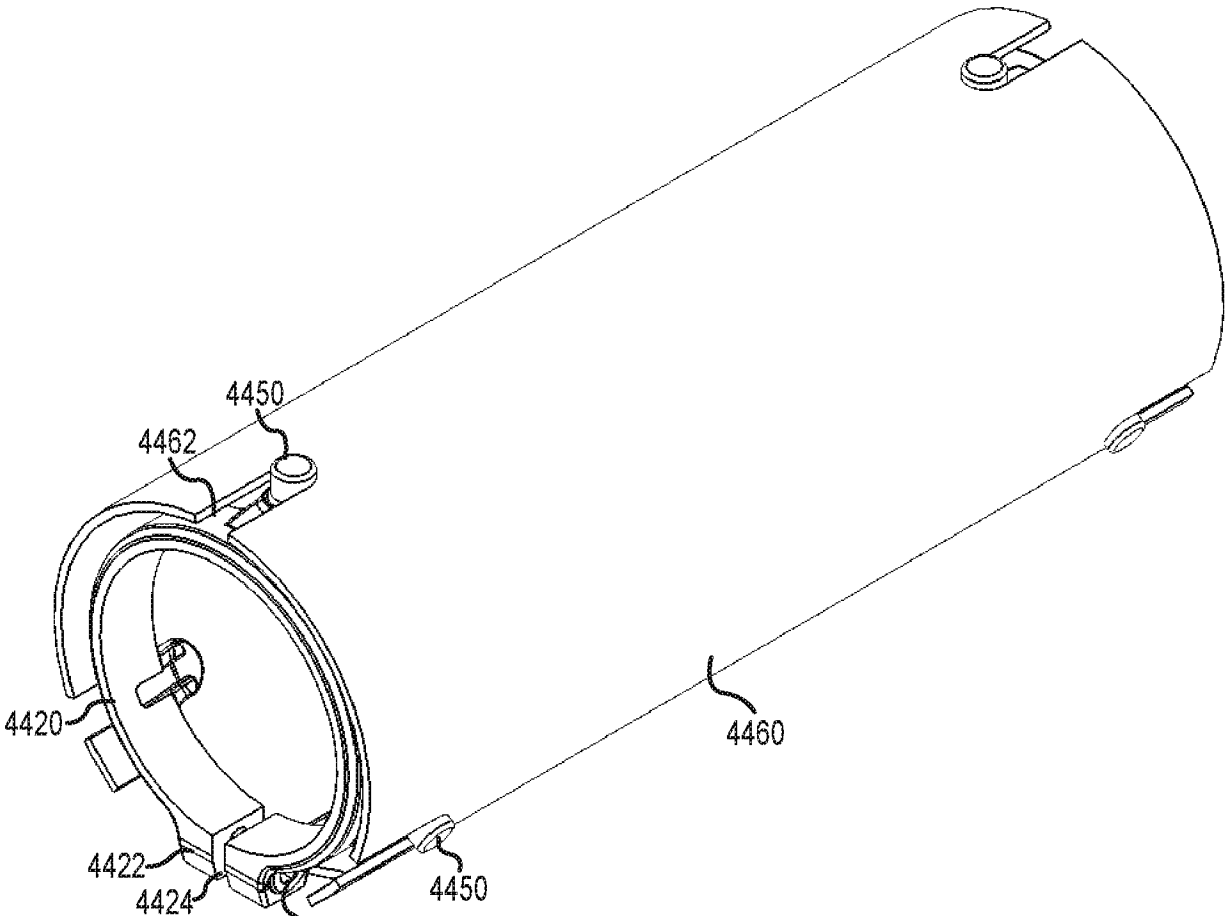
FIG. 44 illustrates a right front isometric view of a suppressor cover assembly with an insulating cover hidden to reveal the heat shield and clamps, according to some embodiments.
Figure 45:
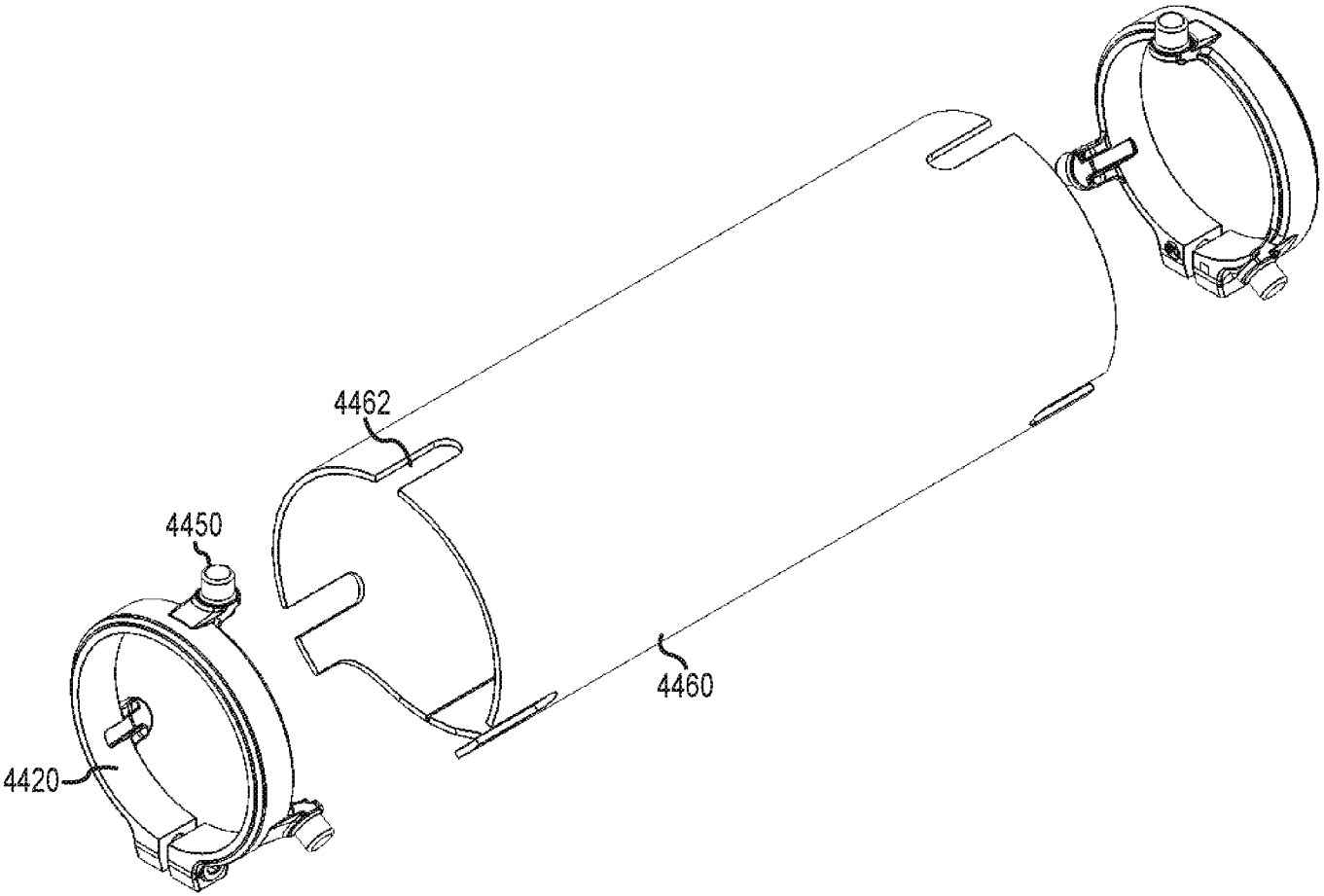
FIG. 45 illustrates an exploded right front isometric view of a suppressor cover assembly with an insulating cover hidden to reveal the heat shield and clamps, according to some embodiments.

FIG. 44 illustrates another embodiment of a cover assembly 4400 where the insulating cover assembly is hidden (or not visible). In this embodiment, two clamps 4420 are arranged at opposing ends of the cover assembly 4400, and include three standoffs 4450. The standoffs 4450 can be part of the clamps 4420, and in contact with the insulating cover assembly (not shown) such that an air gap is maintained between the suppressor 4402 and the insulating cover assembly. The cover assembly 4400 includes a heat shield 4460 having a generally cylindrical shape. The heat shield 4460 has standoff apertures 4462 at ends of the heatshield 4460 allowing the standoffs 4450 to pass there through. The heat shield 4460 can contact the clamps 4420 via the sides of the standoffs 4450.

Figure 48:
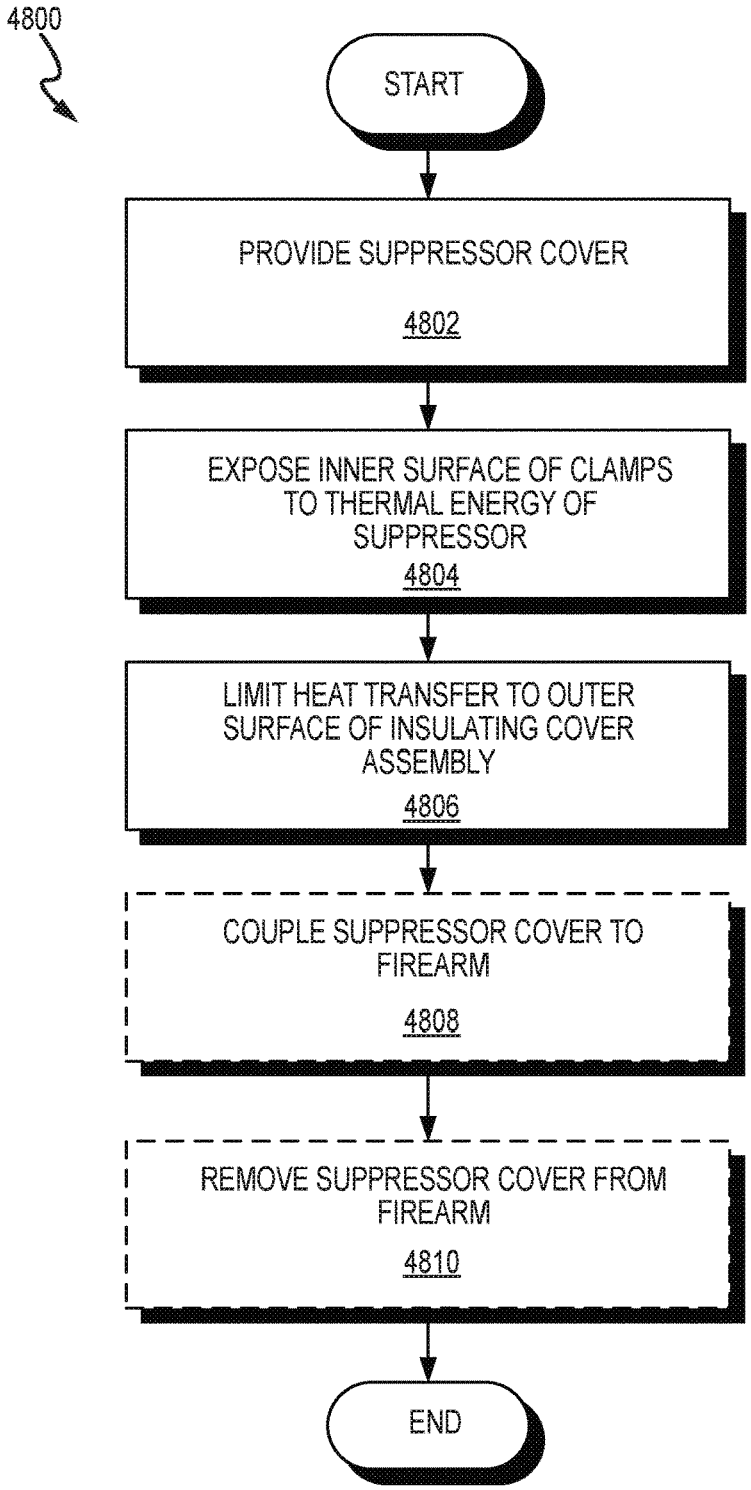
FIG. 48 illustrates a flow chart for a method of protecting a user from a hot suppressor according to some embodiments.

Turning now to FIG. 48, a method 4800 of protecting a user while firing a weapon is now described. The method 4800 includes providing a suppressor cover (Block 4802), exposing an inner surface of the suppressor cover to heat (Block 4804), and limiting heat transfer to an outer surface of the cover (Block 4806). The method 4800 may include coupling the cover to a firearm (Block 4808) and/or removing the cover from a firearm (Block 4810).

Providing 4802 a suppressor cover can be achieved by providing a suppressor cover 100 as previously described with reference to FIGS. 1-47. More specifically, providing 4802 includes providing an insulating cover assembly, a means for attaching the outer body to a suppressor (e.g., via releasable clamps 4804), and a means for separating the means for attaching from the insulating cover assembly (e.g., standoffs 4808).

Exposing 4804 an inner surface of the cover may include exposing an inner surface of a heat shield separate from or part of the insulating cover assembly, or an inner surface of the insulating cover assembly, to a temperature of up to about 1,000 degrees Fahrenheit (about 538 degrees Celsius). In some embodiments, exposing 4804 an inner surface of the cover may include exposing an inner surface of a heat shield separate from or part of the insulating cover assembly, or an inner surface of the insulating cover assembly, to a temperature of up to about 1,400 degrees Fahrenheit (about 760 degrees Celsius). In some embodiments, exposing 4804 an inner surface of the cover may include exposing an inner surface of a heat shield separate from or part of the insulating cover assembly, or an inner surface of the insulating cover assembly, to a temperature above about 1,400 degrees Fahrenheit (about 760 degrees Celsius).

Limiting 4806 heat transfer to an outer surface of the cover may include keeping the temperature of the outer surface to about 300 degrees Fahrenheit (about 149 degrees Celsius) or less while exposing 4804 the inner surface to the temperature of up to about 1,000 degrees Fahrenheit (about 538 degrees Celsius). In some embodiments, limiting 4806 heat transfer may be performed while exposing 4804 the inner surface to a temperature of up to or more than about 1,400 degrees Fahrenheit (about 760 degrees Celsius). Limiting 4806 may be achieved by providing a cover assembly 100 as previously described herein. Limiting 4806 may be achieved by providing a heat shield substantially surrounding and spaced apart from a suppressor, and coupled to the suppressor between the suppressor and an insulating cover assembly. Limiting may be achieved by maximizing heat transfer from the suppressor to the surrounding air through radiation, conduction, and convection.

Figure 49:
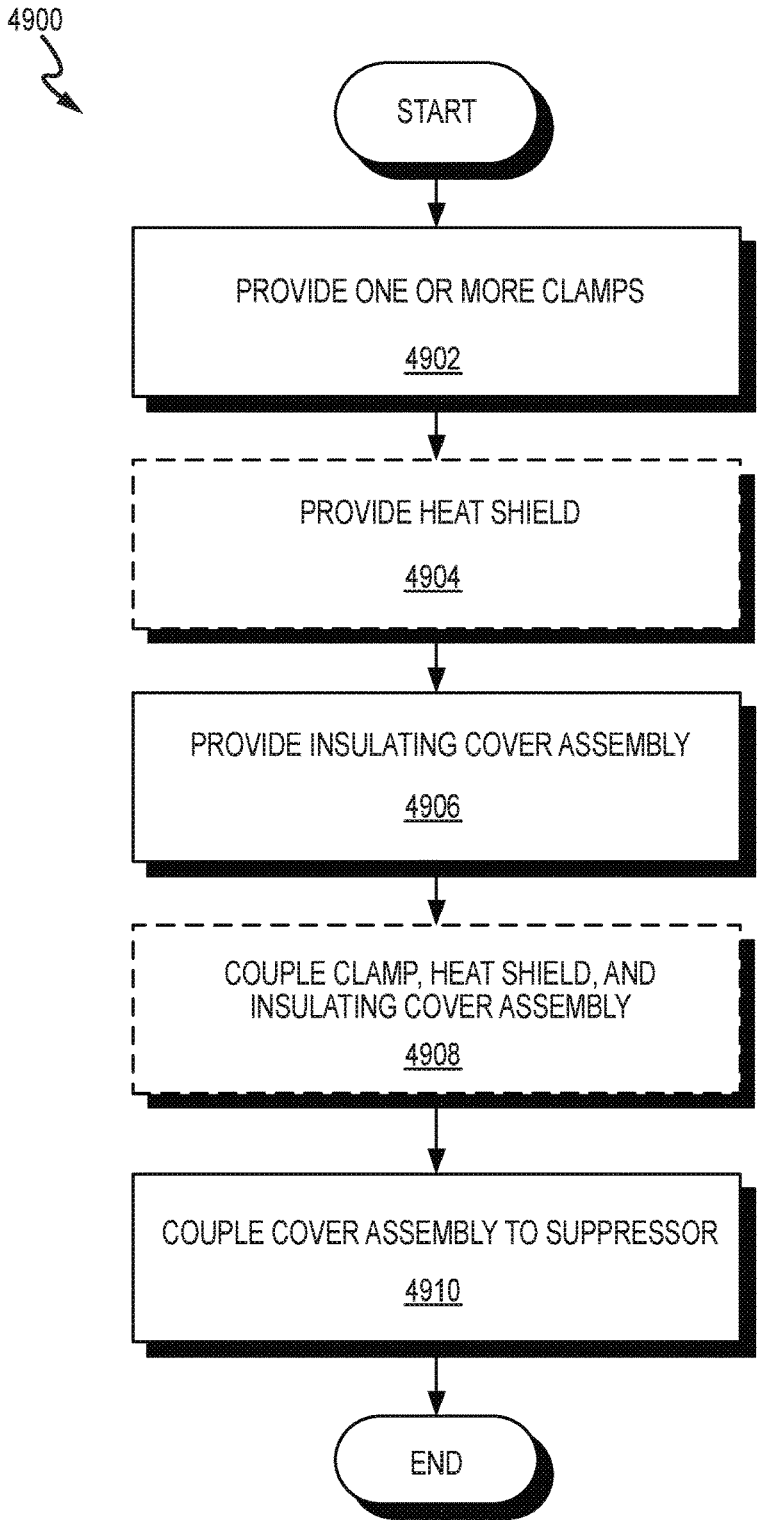
FIG. 49 illustrates a flow chart for a method of making a suppressor cover assembly according to some embodiments.

Turning now to FIG. 49, a method 4900 of making a suppressor cover is now described. The method 4900 includes providing a clamp (Block 4902), optionally providing a heat shield (Block 4904), providing an insulating cover assembly (Block 4906), assembling the clamp, heat shield, and outer body (Block 4908), and (optionally) coupling the cover assembly to a suppressor (Block 4910). The method 4900 may be achieved by providing a cover assembly as previously described herein and/or by forming or shaping the parts as described, and from the materials as described.

Figure 50:
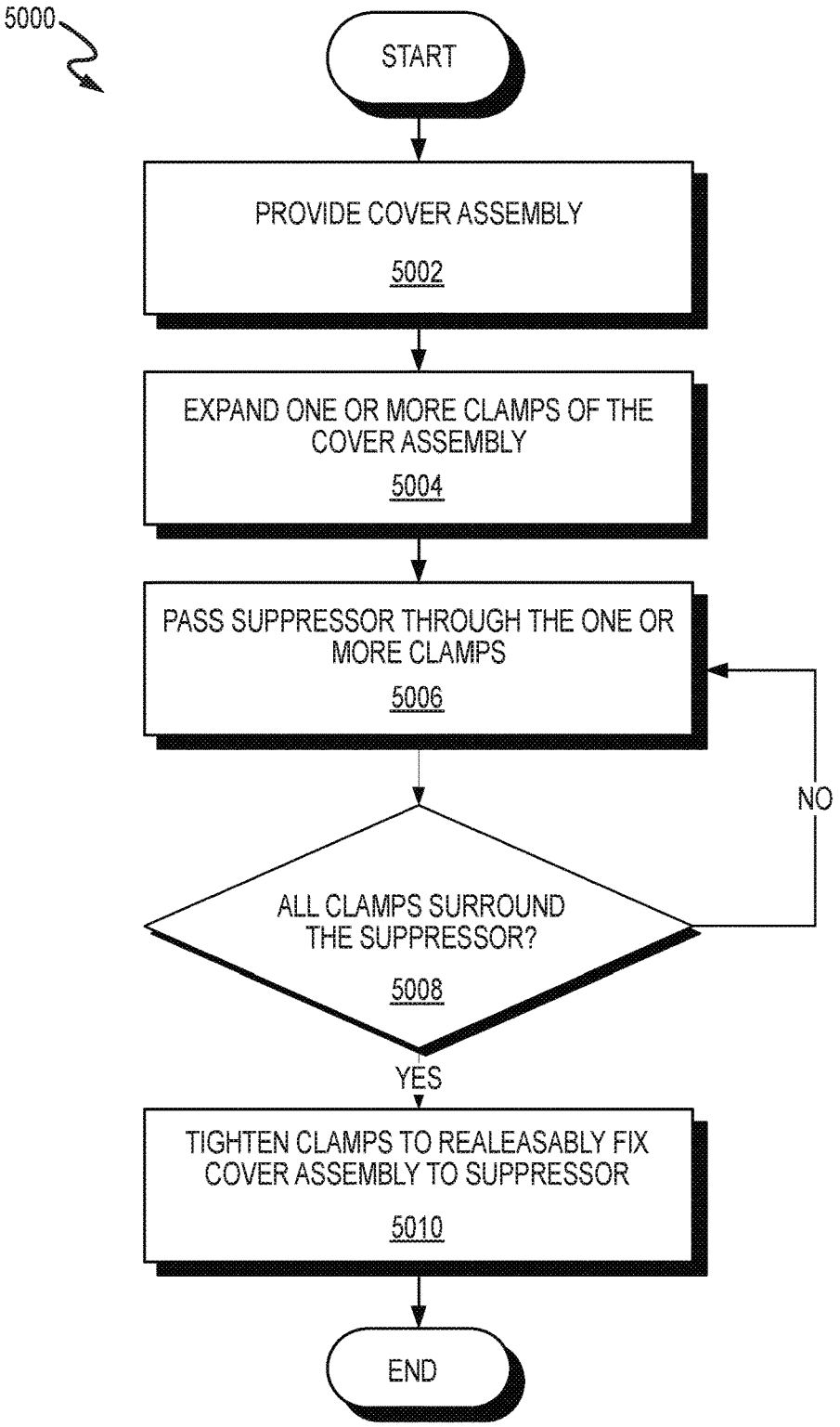
FIG. 50 illustrates another flow chart for a method of removably attaching a suppressor cover assembly to a suppressor.

FIG. 50 illustrates another method 5000 of removably attaching a cover assembly to a suppressor. The method 5000 includes providing a cover assembly comprising one or more clamps, an insulating cover assembly having a generally tubular shape, and one or more standoffs per clamp coupled to the one or more clamps and in contact with the insulating cover assembly to form and maintain an air gap between the one or more clamps and the insulating cover assembly (Block 5002). The method 5000 also includes expanding the one or more clamps (Block 5004), for instance, by loosening one or more fasteners that are arranged through the one or more clamps to control an inner radius of the one or more clamps. The method 5000 further includes passing a suppressor through the one or more clamps (Block 5006) until each of the one or more clamps surround at least a portion of the suppressor (Decision 5008). Once each of the one or more clamps are arranged to surround at least a portion of the suppressor, the one or more clamps can be tightened about the suppressor to engage the suppressor and releasably fix the cover assembly to the suppressor (Block 5010).

In some embodiments, a firearm suppressor cover assembly is disclosed comprising:

a generally cylindrical outer cover assembly;

one or more spacer clamps each having a corresponding collar, the corresponding collar shaped to fit around and couple to a feature of a suppressor assembly; and an optional heat shield coupled to and between the outer body and the one or more spacer clamps, wherein each of the one or more spacer clamps extend at least partially away from the corresponding collar in an axial direction thereby forming an air gap between the heat shield and the suppressor assembly, wherein the only conductive path between the suppressor assembly and the heat shield is the one or more spacer clamps.

In some embodiments, the one or more spacer clamps can include a plurality of spacer legs or standoffs extending between the collar and the heat shield, wherein the spacer legs or standoffs have two cross sectional dimensions that are each smaller than a length of any one of the spacer legs. In other words, an air gap formed by the spacer legs or standoffs between the collar and the heat shield is greater than a longitudinal dimension of any one of the spacer legs or standoffs (the longitudinal dimension being measured along an axis coextensive with or parallel to a longitudinal axis of the suppressor assembly and/or a barrel of a firearm).

In some embodiments, adjacent ones of the spacer legs or standoffs are arranged obliquely, where every other adjacent pair of spacer legs or standoffs intersect at an end region, the end region being coupled to the heat shield.

In some embodiments, the end region includes one or more flanges arranged between the heat shield and a longitudinal axis of the firearm suppressor cover assembly and configured to reduce axial movement of the heat shield toward the longitudinal axis of the firearm suppressor cover assembly.

In some embodiments, the end region includes one or more protrusions extending axially away from the longitudinal axis of the firearm suppressor cover assembly and interfacing with the heat shield to reduce any rotational or longitudinal movement of the heat shield relative to the longitudinal axis of the firearm suppressor cover assembly.

In some embodiments, the one or more spacer legs or standoffs trace a tortuous path between the collar and the heat shield.

In some embodiments, the one or more spacer legs or standoffs trace a tortuous path between the collar and the heat shield.

In some embodiments, the at least one first spacer clamp has at least one fastening mechanism, and the at least one fastening mechanism is shaped to adjust a radius of the at least one first spacer clamp thereby engaging or disengaging the firearm suppressor cover from the firearm suppressor cover assembly.

The terms and expressions employed herein are used as terms and expressions of description and not of limitation, and there is no intention, in the use of such terms and expressions, of excluding any equivalents of the features shown and described or portions thereof. In addition, having described certain embodiments, it will be apparent to those of ordinary skill in the art that other embodiments incorporating the concepts disclosed herein may be used without departing from the spirit and scope of the disclosure. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of an actuator should be understood to encompass disclosure of the act of actuating—whether explicitly discussed or not—and, conversely, were there only disclosure of the act of actuating, such a disclosure should be understood to encompass disclosure of an actuating mechanism. Such changes and alternative terms are to be understood to be explicitly included in the description.

The previous description of the disclosed embodiments and examples is provided to enable any person skilled in the art to make or use the present disclosure as defined by the claims. Thus, the present disclosure is not intended to be limited to the examples disclosed herein. Various modifications to these embodiments will be readily apparent to those skilled in the art, and the generic principles defined herein may be applied to other embodiments without departing from the spirit or scope of the disclosure as claimed.

What is claimed is:

1. A firearm suppressor cover assembly, comprising:

one or more clamps shaped to releasably couple the firearm suppressor cover assembly to a firearm suppressor, one of the one or more clamps arranged near a rear end of the firearm suppressor cover assembly, distal from a muzzle of the firearm;

an insulating cover assembly rigidly supported to maintain an elongated shape and shaped to at least partially surround the firearm suppressor; and two to nine standoffs extending outward from each of the one or more clamps, and in contact with the insulating cover assembly, the one or more clamps not in contact with a barrel of the firearm, the two to nine standoffs for each of the one or more clamps being circularly spaced from each other relative to a longitudinal axis of the firearm suppressor cover assembly.

2. The firearm suppressor cover assembly of claim 1, wherein the standoffs have a length in a direction parallel to a longitudinal axis of the firearm suppressor that is less than a length of the firearm suppressor cover assembly such that circular and longitudinal convection is possible in the air gap.

3. The firearm suppressor cover assembly of claim 1, wherein the one or more clamps include one to three clamps.

4. The firearm suppressor cover assembly of claim 3, wherein the one or more clamps include one clamp.

5. The firearm suppressor cover assembly of claim 3, further comprising two or three standoffs.

6. The firearm suppressor cover assembly of claim 5, wherein the insulating cover assembly comprises an insulating cover and a rigid support having a generally cylindrical shape and being in contact with the insulating cover to support and shape the insulating cover assembly.

7. The firearm suppressor cover assembly of claim 3, wherein the insulating cover assembly comprises an insulating cover and a rigid support having a generally cylindrical shape and being in contact with the insulating cover to support and shape the insulating cover.

8. The firearm suppressor cover assembly of claim 1, further comprising two or three standoffs.

9. The firearm suppressor cover assembly of claim 8, wherein the insulating cover assembly comprises an insulating cover and a rigid support having a generally cylindrical shape and being in contact with the insulating cover to support and shape the insulating cover.

10. The firearm suppressor cover assembly of claim 1, wherein the insulating cover assembly comprises an insulating cover and a rigid support having a generally cylindrical shape and being in contact with the insulating cover to support and shape the insulating cover.

11. The firearm suppressor cover assembly of claim 1, wherein the insulating cover assembly includes a thermally reflective liner on an inside surface configured to reflect radiative thermal energy.

12. The firearm suppressor cover assembly of claim 1, wherein the clamps are metal.

13. The firearm suppressor cover assembly of claim 1, further comprising at least two thermally conductive interruptions in a thermal path between the clamps and an outer surface of the cover assembly.

14. The firearm suppressor cover assembly of claim 1, wherein the clamps have a textured or ridged inner surface configured to contact the suppressor and reduce a thermal cross section between the suppressor and the clamps.

15. The firearm suppressor cover assembly of claim 1, wherein adjacent standoffs on the same clamp have at least 60° of circular separation as measured around the longitudinal axis of the firearm suppressor cover assembly.

16. A firearm suppressor cover assembly, comprising:

one or more clamps shaped to releasably couple the firearm suppressor cover assembly to a firearm suppressor, one of the one or more clamps arranged near a rear end of the firearm suppressor cover assembly, distal from a muzzle of the firearm;

an insulating cover assembly rigidly supported to maintain an elongated shape and shaped to at least partially surround the firearm suppressor; and two to nine standoffs extending outward from each of the one or more clamps, and in contact with the insulating cover assembly to form an air gap between the one or more clamps and the insulating cover assembly, the two to nine standoffs being circularly spaced from each other relative to a longitudinal axis of the firearm suppressor cover assembly.

* * * * *